US010844720B2

(12) United States Patent
Montie

(10) Patent No.: US 10,844,720 B2
(45) Date of Patent: Nov. 24, 2020

(54) ROTARY MACHINE WITH PRESSURE RELIEF MECHANISM

(71) Applicant: Rotoliptic Technologies Incorporated, Squamish (CA)

(72) Inventor: Greg John Montie, Squamish (CA)

(73) Assignee: Rotoliptic Technologies Incorporated, Squamish (CA)

( * ) Notice: Subject to any disclaimer, the term of this patent is extended or adjusted under 35 U.S.C. 154(b) by 302 days.

(21) Appl. No.: 15/924,173

(22) Filed: Mar. 16, 2018

(65) Prior Publication Data

US 2018/0291740 A1 Oct. 11, 2018

Related U.S. Application Data

(63) Continuation of application No. 14/296,433, filed on Jun. 4, 2014, now Pat. No. 10,087,758.
(Continued)

(51) Int. Cl.
*F01C 1/22* (2006.01)
*F01C 21/08* (2006.01)
*F01C 21/10* (2006.01)

(52) U.S. Cl.
CPC ..... *F01C 1/22* (2013.01); *F01C 21/08* (2013.01); *F01C 21/106* (2013.01);
(Continued)

(58) Field of Classification Search
CPC ..... F01C 1/22; F01C 21/106; F01C 21/08; F04C 2250/20; F02B 2730/018
See application file for complete search history.

(56) References Cited

U.S. PATENT DOCUMENTS 724,994 A 4/1903 Cooley
1,340,625 A 5/1920 Planche
(Continued)

FOREIGN PATENT DOCUMENTS

EP 1552124 A1 5/2006
EP 1988288 B1 11/2008
(Continued)

OTHER PUBLICATIONS

International Search Report and Written Opinion dated Nov. 13, 2019 issued in connection with International Application No. PCT/CA2019/051273.
(Continued)

*Primary Examiner* — Deming Wan
(74) *Attorney, Agent, or Firm* — Cook Alex Ltd.; Ryan M. Truesdale

(57) ABSTRACT

A rotary machine, for directing a quantity of fluid from an inlet to an outlet, comprises one or more elliptical or near-elliptical rotors having planetary rotation within a housing. The interior cavity of the housing comprises an inverse apex region that is in contact with the rotor during its rotation. In various embodiments the rotor and housing can be symmetric or asymmetric in cross-section. Features are described that can improve the operation of the machine for various end-use applications. Such features include cut-outs that are fluidly connected to the inlet or outlet ports of the machine, mechanisms for reducing variation in output flow rate from the rotary machine, linings for the interior cavity of the housing, pressure relief mechanisms, dynamic apex seals and other sealing mechanisms.

20 Claims, 46 Drawing Sheets

Related U.S. Application Data

(60) Provisional application No. 61/939,737, filed on Feb. 13, 2014, provisional application No. 61/865,604, filed on Aug. 13, 2013, provisional application No. 61/831,248, filed on Jun. 5, 2013.

(52) U.S. Cl.
CPC ..... *F04C 2230/91* (2013.01); *F04C 2250/20* (2013.01); *F04C 2250/301* (2013.01)

(56) References Cited

U.S. PATENT DOCUMENTS

| | | | | |
|---|---|---|---|---|
| 1,575,987 | A | 3/1926 | Gilman | |
| 1,636,486 | A | 7/1927 | Planche | |
| 1,686,569 | A | 10/1928 | McMillan | |
| 1,738,645 | A | 12/1929 | Gilman | |
| 1,892,217 | A | 12/1932 | Moineau | |
| 2,612,022 | A | 9/1952 | Keys | |
| 2,919,062 | A | 12/1959 | Tryhorn | |
| 2,988,008 | A | 6/1961 | Wankel | |
| 3,259,113 | A | 7/1966 | Hamada | |
| 3,279,388 | A | 10/1966 | Roudaut | |
| 3,296,874 | A | 1/1967 | Wyczalek | |
| 3,299,822 | A | 1/1967 | Eaton | |
| 3,302,870 | A | 2/1967 | Schell | |
| 3,387,772 | A * | 6/1968 | Wutz | F04C 18/22 418/61.2 |
| 3,398,643 | A | 8/1968 | Schudt | |
| 3,458,120 | A | 7/1969 | Pfaff et al. | |
| 3,465,729 | A | 9/1969 | Jones | |
| 3,533,716 | A | 10/1970 | Grun | |
| 3,728,049 | A | 4/1973 | Miller | |
| 3,764,239 | A | 10/1973 | Huf | |
| 3,917,437 | A | 11/1975 | Link | |
| 3,958,906 | A | 5/1976 | Catterson et al. | |
| 3,990,817 | A | 11/1976 | Ruf et al. | |
| 4,012,180 | A | 3/1977 | Berkowitz et al. | |
| 4,018,548 | A | 4/1977 | Berkowitz | |
| 4,028,021 | A | 6/1977 | Berkowitz | |
| 4,061,445 | A | 12/1977 | Doshi | |
| 4,118,157 | A | 10/1978 | Mayer | |
| 4,144,001 | A | 3/1979 | Streicher | |
| 4,218,199 | A | 8/1980 | Eiermann | |
| 4,296,500 | A | 10/1981 | Monties et al. | |
| 4,299,097 | A | 11/1981 | Shank et al. | |
| 4,330,240 | A | 5/1982 | Eslinger | |
| 4,395,206 | A | 7/1983 | Hoffmann | |
| 4,397,619 | A | 8/1983 | Alliquander et al. | |
| 4,407,639 | A | 10/1983 | Maruyama | |
| 4,410,305 | A | 10/1983 | Shank et al. | |
| 4,487,561 | A | 12/1984 | Eiermann | |
| 4,507,067 | A | 3/1985 | Hansen | |
| 4,519,206 | A | 5/1985 | Van Michaels | |
| 4,551,073 | A | 11/1985 | Schwab | |
| 4,594,060 | A | 6/1986 | Schwab | |
| 4,728,270 | A | 3/1988 | Hoffmann | |
| 4,802,830 | A | 2/1989 | Nakajima | |
| 4,934,325 | A | 6/1990 | Snyder | |
| 5,069,606 | A | 12/1991 | Bachellerie | |
| 5,096,004 | A | 3/1992 | Ide | |
| 5,127,377 | A | 7/1992 | Yang | |
| 5,169,298 | A | 12/1992 | Hekman et al. | |
| 5,171,138 | A | 12/1992 | Forrest | |
| 5,295,814 | A | 3/1994 | Uebel | |
| 5,302,096 | A | 4/1994 | Cavalleri | |
| 5,372,107 | A | 12/1994 | Smythe | |
| 5,379,736 | A | 1/1995 | Anderson | |
| 5,439,359 | A | 8/1995 | Leroy et al. | |
| 5,609,475 | A | 3/1997 | Eiermann | |
| 6,074,184 | A | 6/2000 | Imai | |
| 6,093,004 | A | 7/2000 | Varadan et al. | |
| 6,213,744 | B1 | 4/2001 | Choroszylow et al. | |
| 6,236,897 | B1 | 5/2001 | Lee et al. | |
| 6,530,357 | B1 | 3/2003 | Yaroshenko | |
| 6,718,938 | B2 | 4/2004 | Szorenyi | |
| 6,776,136 | B1 | 8/2004 | Kazempour | |
| 6,923,628 | B1 | 8/2005 | Otto | |
| 6,926,505 | B2 * | 8/2005 | Sbarounis | F01C 1/22 418/125 |
| 7,101,160 | B2 | 9/2006 | Gennami et al. | |
| 7,117,839 | B2 | 10/2006 | Horstin | |
| 7,395,805 | B1 | 7/2008 | MacMurray | |
| 7,540,728 | B2 | 6/2009 | Gorban | |
| 7,549,850 | B2 | 6/2009 | Trapalis | |
| 7,553,138 | B2 | 6/2009 | Gorban | |
| 7,726,115 | B2 | 6/2010 | Murrow et al. | |
| 7,837,451 | B2 | 11/2010 | Wiedenhoefer et al. | |
| 7,942,657 | B2 | 5/2011 | Gray | |
| 8,356,585 | B2 | 1/2013 | Hathaway et al. | |
| 8,523,545 | B2 | 9/2013 | Wilbourn et al. | |
| 8,523,546 | B2 | 9/2013 | Shkolnik et al. | |
| 8,539,930 | B2 | 9/2013 | Gray | |
| 8,539,931 | B1 | 9/2013 | Hanna | |
| 8,888,474 | B2 | 11/2014 | Hohl et al. | |
| 8,905,733 | B2 | 12/2014 | Guidry | |
| 9,051,780 | B2 | 6/2015 | Trushin | |
| 2002/0122722 | A1 | 9/2002 | Bertin et al. | |
| 2005/0017053 | A1 | 1/2005 | Sbarounis | |
| 2006/0073032 | A1 | 4/2006 | Parrett | |
| 2006/0233653 | A1 * | 10/2006 | Trapalis | F01C 1/22 418/54 |
| 2008/0031758 | A1 | 2/2008 | Rosam et al. | |
| 2008/0193309 | A1 | 8/2008 | Kothnur et al. | |
| 2009/0241536 | A1 | 10/2009 | Gale et al. | |
| 2010/0183454 | A1 | 7/2010 | Lübke et al. | |
| 2011/0262291 | A1 | 10/2011 | Fleger et al. | |
| 2012/0070326 | A1 | 3/2012 | Hammerbeck | |
| 2012/0156078 | A1 | 6/2012 | Guidry | |
| 2012/0177484 | A1 | 7/2012 | Lusted et al. | |
| 2012/0240885 | A1 | 9/2012 | Horn | |
| 2013/0028775 | A1 | 1/2013 | Gekht et al. | |
| 2015/0030492 | A1 | 1/2015 | Montie et al. | |
| 2016/0141921 | A1 | 5/2016 | Kubes | |
| 2017/0074100 | A1 | 3/2017 | Jarvis et al. | |
| 2017/0137005 | A1 | 5/2017 | Weh et al. | |
| 2017/0321697 | A1 | 11/2017 | Beinert et al. | |

FOREIGN PATENT DOCUMENTS

| | | | |
|---|---|---|---|
| JP | H1010141265 | A1 | 5/1998 |
| WO | 1999056004 | A1 | 11/1999 |
| WO | 2005078239 | A1 | 8/2005 |
| WO | 2009103528 | A2 | 10/2009 |
| WO | 2010131103 | A2 | 3/2011 |

OTHER PUBLICATIONS

International Search Report and Written Opinion dated Nov. 18, 2019 issued in connection with International Application No. PCT/CA2019/051274.

International Search Report and Written Opinion dated Nov. 19, 2019 issued in connection with International Application No. PCT/CA2019/051272.

Ansdale, R., The Wankel RC Engine, (1968), p. 20.

Hydra, L., The Development of Outer-Envelope Trochoidal Compressors, International Compressor Engineering Conference (1986), pp. 282-292.

Wrede et al., Recent Status of Trochoidal Type Compressors for Heat Pumps in Germany, International Compressor Engineering Conference (1986), pp. 254-282.

* cited by examiner

FIG. 25A
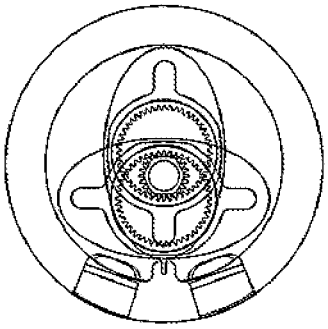
FIG. 25B
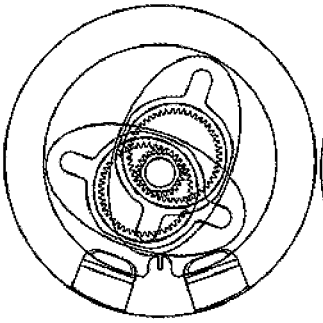
FIG. 25C
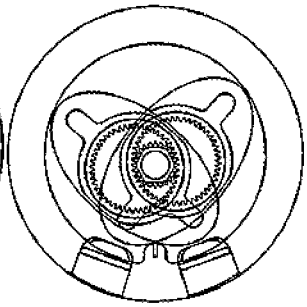
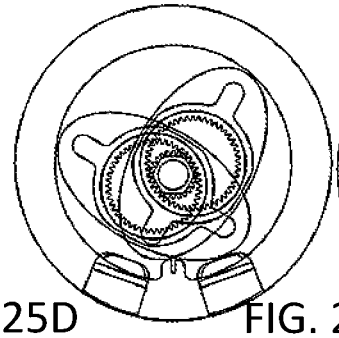
FIG. 25D
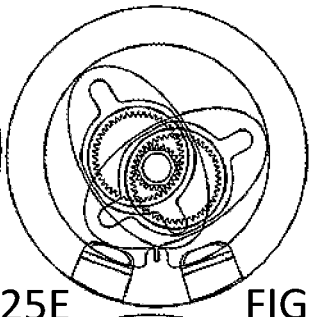
FIG. 25E
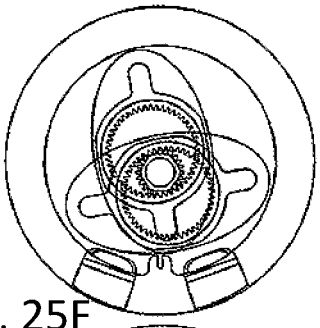
FIG. 25F
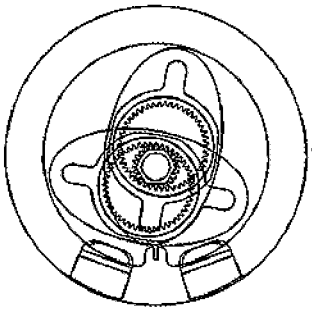
FIG. 25G
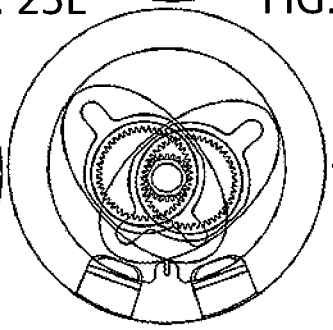
FIG. 25H
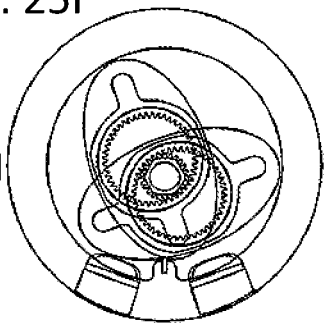
FIG. 25I

ROTARY MACHINE WITH PRESSURE RELIEF MECHANISM

CROSS-REFERENCE TO RELATED APPLICATIONS

This application is a continuation of U.S. patent application Ser. No. 14/296,433 filed on Jun. 4, 2014, entitled "Rotary Machine". The '433 application claims priority benefits, in turn, from U.S. provisional patent application Ser. No. 61/831,248, filed on Jun. 5, 2013, entitled "Rotary Machine With Elliptical Rotor", from U.S. provisional patent application Ser. No. 61/865,604, filed on Aug. 13, 2013, entitled "Rotary Pump", and from U.S. provisional patent application Ser. No. 61/939,737, filed on Feb. 13, 2014, entitled "Rotary Machine". The '433, '248, '604 and '737 applications are each hereby incorporated by reference herein in their entirety.

FIELD OF THE INVENTION

The present invention relates to rotary machines, particularly rotary compressors, pumps or expansion engines in which at least one rotor has planetary motion within a housing.

BACKGROUND OF THE INVENTION

Rotary machines, in which at least one rotor has planetary motion within a housing, can be employed, for example, as rotary compressors, pumps (including positive displacement pumps, dynamic pumps and vacuum pumps) or expansion engines.

Conventional rotary machines can have one or more rotors. Various shapes of rotors are known, including circular, elliptical, triangular and, in some cases, the rotors incorporate vanes. Vanes can be mounted on a rotor in a housing, and can be of variable length or urged to maintain contact with the interior surface of the housing as the rotor rotates. The housing for the rotor is most commonly cylindrical although other housing shapes such as trochoidal (either hypo- or epitrochoidal) shapes are known. There is a class of rotary machines for which the rotor is trochoidal and the housing is also trochoidal, wherein the housing has one more apex than the rotor. Trochoidal shapes can be generated by tracing a point on the circumference of a first circle as it is rolled around the circumference of a second circle either on the inside (producing a hypotrochoidal shape) or outside (producing an epitrochoidal shape).

A configuration in which the housing (or an outer rotor) has one more apex (or tooth) than the inner rotor is known as a generated rotor or gerotor. A gerotor is a positive displacement pump and can comprise a trochoidal inner rotor and an outer rotor formed by a circle with intersecting arcs.

Various gerotor configurations can be designed by rotating an inner rotor about a first point moving in a circle about a second point wherein the second point is fixed. The inner rotor can comprise two or more apexes, and can rotate in the same direction or in the opposite direction as the rotation of the first point about the second point. The relative rotational rates of the rotor and the first point about the second point can be adjusted to achieve a desired gerotor configuration.

Rotary pumps are known devices that can move a fluid from one place to another. There is a wide range of end uses for rotary pumps including irrigation, fire-fighting, flood control, water supply, gasoline supply, refrigeration, chemical movement and sewage transfer.

Rotary pumps are typically positive displacement pumps comprising a fixed housing, gears, cams, rotors, vanes and similar elements. Rotary pumps usually have close running clearances, do not require suction or discharge valves, and are often lubricated only by the fluid being pumped.

A positive displacement pump moves the fluid by trapping a volume of fluid and forcing the trapped volume into a discharge pipe. Some positive displacement pumps employ an expanding cavity on the suction side and a decreasing cavity on the discharge side. Fluid flows into the pump as the cavity on the suction side expands and the fluid flows out of the discharge pipe as the cavity collapses. The output volume is the same for each cycle of operation. Theoretically, a positive displacement pump can produce the same flow rate at a given pump speed regardless of the discharge pressure.

A rotodynamic pump is a kinetic machine in which energy is imparted continuously to the fluid by means of a rotating impeller, propeller, or rotor.

Rotary machines, such as those described above, can be designed for various applications. The design and configuration of rotary machines can offer particular advantages for certain applications. For example, rotary pumps, such as those described above, can be designed for various applications with suitable capacity and discharge pressure. The design and configuration of rotary pumps can offer particular advantages, such as high volumetric efficiency, for certain applications.

SUMMARY OF THE INVENTION

A rotary machine comprises:

(a) a rotor comprising an outer surface having an elliptical cross-section;

(b) a crankshaft for providing rotational force to rotate the rotor about a first axis of rotation at a first angular velocity;

(c) a mechanical coupling between the crankshaft and the rotor, the coupling configured such that:

(i) rotation of the crankshaft about the first axis of rotation induces rotation of the rotor about an instantaneous second axis of rotation at a second angular velocity proportional to the first angular velocity, the second axis of rotation positioned at a fixed distance from the first axis of rotation; and (ii) the second axis of rotation orbits about the first axis of rotation at the first angular velocity;

(d) a housing having an inlet and an outlet formed therein, the housing having an interior cavity within which the rotor is configured to rotate, the housing interior cavity comprising an inner surface having a cross-sectional profile defined by a locus of a set of points on the rotor outer surface for which an instantaneous velocity vector is perpendicular to a line drawn from a member of the set of points to the second axis of rotation as the rotor completes one revolution of rotation, the housing cavity inner surface having an interiorly-extending inverse apex region between the inlet and the outlet that is in contact with the rotor during rotation of the rotor thereby providing separation between the inlet and the outlet.

The housing cavity inner surface further comprises a first cut-out formed therein that extends circumferentially and is fluidly connected to one of the inlet or the outlet.

Upon connecting the inlet to a fluid source, rotation of the rotor draws fluid into a space formed between the rotor and the housing cavity inner surface and discharges the fluid from the outlet.

The housing inner surface can further comprise a second cut-out, wherein the first cut-out is fluidly connected to the inlet and the second cut-out is fluidly connected to the outlet. In some embodiments, the first cut-out can be configured to increase the amount of fluid drawn via the inlet into the space formed between the rotor and the housing cavity inner surface during rotation of the rotor. In some embodiments, the second cut-out is configured to reduce mechanical restraint of the rotor during discharge of an incompressible fluid via the outlet. The cut-outs can be connected to the housing cavity inner surface by a transition region.

In preferred embodiments of the rotary machine, the crankshaft induces rotation of the rotor about the second axis of rotation at a second angular velocity that is half the first angular velocity.

In some embodiments, the rotary machine further comprises a second rotor comprising an outer surface having an elliptical cross-section, and the second rotor is configured to rotate out of phase with respect to the first rotor.

In preferred embodiments of the rotary machine, the crankshaft is connected to a drive assembly for rotating the crankshaft at a rotational rate that varies during the period of each rotation of the crankshaft. In some embodiments the drive assembly can comprise a motor, a driveshaft and a universal joint. The driveshaft of the motor is configured to rotate at a substantially constant rate, and the universal joint is configured to provide a variation in the rotational rate of the crankshaft. In other embodiments, the drive assembly comprises transmission comprising a non-circular gearing mechanism, with the non-circular gearing mechanism configured to provide a variation in the rotational rate of the crankshaft.

In preferred embodiments of the rotary machine, the inverse apex region comprises a dynamic apex seal.

A rotary pump comprises:

(a) a rotor comprising an outer surface having an elliptical cross-section;

(b) a crankshaft for providing rotational force to rotate the rotor about a first axis of rotation at a first angular velocity;

(c) a mechanical coupling between the crankshaft and the rotor, the coupling configured such that:

(i) rotation of the crankshaft about the first axis of rotation induces rotation of the rotor about an instantaneous second axis of rotation at a second angular velocity proportional to the first angular velocity, the second axis of rotation positioned at a fixed distance from the first axis of rotation; and (ii) the second axis of rotation orbits about the first axis of rotation at the first angular velocity;

(d) a housing having an inlet and an outlet formed therein, the housing having an interior cavity within which the rotor is configured to rotate.

The housing interior cavity is substantially circular in cross-section and comprises an interiorly-extending inverse apex region between the inlet and the outlet. The inverse apex region is in contact with the rotor during rotation of the rotor thereby providing separation between the inlet and the outlet.

Upon connecting the inlet to a fluid source, rotation of the rotor draws fluid into a space formed between the rotor and the housing cavity inner surface and discharges the fluid from the outlet.

In a preferred embodiment, the crankshaft induces rotation of the rotor about the second axis of rotation at a second angular velocity that is half the first angular velocity.

In a preferred embodiment, the rotor has a pair of oppositely disposed tips, the rotor tips separated by a distance that provides a substantially continuous gap between the tips and the housing cavity inner surface.

In some embodiments, the housing cavity inner surface has a first cut-out formed therein that extends circumferentially and is fluidly connected to one of the inlet or the outlet.

In some embodiments, the pump can further comprise a second rotor comprising an outer surface having an elliptical cross-section. The second rotor is preferably configured to rotate out of phase with respect to the first rotor.

In preferred embodiments of the rotary pump, the crankshaft is connected to a drive assembly for rotating the crankshaft at a rotational rate that varies during the period of each rotation of the crankshaft. In some embodiments the drive assembly can comprise a motor, a driveshaft and a universal joint. The driveshaft of the motor is configured to rotate at a substantially constant rate, and the universal joint is configured to provide a variation in the rotational rate of the crankshaft. In other embodiments, the drive assembly comprises transmission comprising a non-circular gearing mechanism, with the non-circular gearing mechanism configured to provide a variation in the rotational rate of the crankshaft.

In preferred embodiments, the inverse apex region comprises a dynamic apex seal.

The rotary pump can further comprise at least one lining disposed along at least a portion of the housing cavity inner surface. The lining can be formed of a material that is less abradable than the housing cavity inner surface. The lining can have uniform or non-uniform thickness.

An improved rotary machine directs a quantity of fluid from an inlet to an outlet. The apparatus comprises:

(a) a rotor comprising an outer surface having an elliptical cross-section;

(b) a crankshaft for providing rotational force to rotate the rotor about a first axis of rotation at a first angular velocity;

(c) a mechanical coupling between the crankshaft and the rotor, the coupling configured such that:

(i) rotation of the crankshaft about the first axis of rotation induces rotation of the rotor about an instantaneous second axis of rotation at a second angular velocity proportional to the first angular velocity, the second axis of rotation positioned at a fixed distance from the first axis of rotation; and (ii) the second axis of rotation orbits about the first axis of rotation at the first angular velocity;

(d) a housing having an interior cavity within which the rotor is capable of rotating, the housing interior cavity comprising an interior surface having a cross-sectional profile defined by a locus of a set of points on the rotor outer surface for which an instantaneous velocity vector is perpendicular to a line drawn from a member of the set of points to the second axis of rotation as the rotor completes one revolution of rotation.

In a preferred embodiment, the crankshaft induces rotation of the rotor about the second axis of rotation at a second angular velocity that is half the first angular velocity.

In a preferred embodiment, the rotor has a major axis ending in pair of oppositely disposed tips, and the rotor tips contact the housing interior surface. Alternatively, the rotor tips can be spaced from the housing interior surface.

In a preferred embodiment, the inlet is formed within the housing for introducing the fluid quantity into the interior cavity and the outlet is formed within the housing for discharging the fluid quantity from the interior cavity. Rotation of the rotor about the second axis of rotation preferably divides the interior cavity into three separate chambers during at least a portion of the revolution of the rotor about the second axis of rotation. Preferably, the fluid quantity is introduced via the inlet into one of the chambers and substantially all of the fluid quantity is discharged from the one of the chambers upon completion of the one revolution of rotation, thereby fully scavenging the fluid quantity from the interior chamber.

In a preferred embodiment, the housing has a through-hole formed therein for introducing fluid into the interior cavity, and the rotor superimposes the through-hole during the one revolution of rotation. The rotor can have at least one interior chamber formed therein such that the rotor interior chamber fluidly communicates with the through-hole when the rotor interior chamber superimposes the through-hole. The fluid introduced via the through-hole can have a composition that is different from the composition of the fluid introduced to the interior chamber via the inlet.

An improved method directs a quantity of fluid from an inlet to an outlet. The method comprises:

(a) encasing a rotor within an interior cavity formed in the housing, the rotor comprising an outer surface having an elliptical cross-section, the housing interior cavity comprising an interior surface having a cross-sectional profile defined by a locus of a set of points on the rotor outer surface for which an instantaneous velocity vector is perpendicular to a line drawn from a member of the set of points to an instantaneous axis of rotation as the rotor completes one revolution of rotation;

(b) mechanically coupling a crankshaft and the rotor, the crankshaft having a first axis of rotation, the coupling configured such that:

(i) rotation of the crankshaft about the first axis of rotation induces rotation of the rotor about the instantaneous axis of rotation at a second angular velocity proportional to the first angular velocity, the instantaneous axis of rotation positioned at a fixed distance from the first axis of rotation; and (ii) the instantaneous axis of rotation orbits about the first axis of rotation at the first angular velocity;

(c) applying rotational force to the crankshaft, thereby inducing rotation of the rotor about the instantaneous axis of rotation, the rotor contacting the interior cavity at three locations during at least a portion of the revolution of the rotor about the instantaneous axis of rotation, thereby dividing the interior cavity into three chambers that may or may not be fluidly isolated from one another;

(d) introducing the fluid quantity via the inlet into one of the chambers; and (e) discharging substantially all of the fluid quantity from the one of the chambers upon completion of the one revolution of rotation, thereby fully scavenging the fluid quantity from the interior chamber.

In a preferred method embodiment, the crankshaft induces rotation of the rotor about the second axis of rotation at a second angular velocity that is half the first angular velocity.

In a preferred method embodiment, the rotor has a major axis ending in pair of oppositely disposed tips, and the rotor tips contact the housing interior surface. Alternatively, the rotor tips can also be spaced from the housing interior surface.

In a preferred method embodiment, the inlet is formed within the housing for introducing the fluid quantity into the interior cavity and the outlet is formed within the housing for discharging the fluid quantity from the interior cavity. The fluid quantity is preferably introduced via the inlet into one of the chambers and substantially all of the fluid quantity is discharged from the one of the chambers upon completion of the one revolution of rotation, thereby fully scavenging the fluid quantity from the interior chamber.

In a preferred method embodiment, the housing has a through-hole formed therein for introducing fluid into the interior cavity, and the rotor superimposes the through-hole during the one revolution of rotation. The rotor preferably has at least one interior chamber formed therein such that the rotor interior chamber fluidly communicates with the through-hole when the rotor interior chamber superimposes the through-hole. The fluid introduced via the through-hole can have a composition that is different from the composition of the fluid introduced to the interior chamber via the inlet.

An improved rotary pump comprises:

(a) a rotor comprising an outer surface having an elliptical cross-section;

(b) a crankshaft for providing rotational force to rotate the rotor about a first axis of rotation at a first angular velocity;

(c) a mechanical coupling between the crankshaft and the rotor, the coupling configured such that:

(i) rotation of the crankshaft about the first axis of rotation induces rotation of the rotor about an instantaneous second axis of rotation at a second angular velocity proportional to the first angular velocity, the second axis of rotation positioned at a fixed distance from the first axis of rotation; and (ii) the second axis of rotation orbits about the first axis of rotation at the first angular velocity;

(d) a housing having an inlet and an outlet formed therein, the housing having an interior cavity within which the rotor is configured to rotate, the housing interior cavity comprising an inner surface having a cross-sectional profile defined by a locus of a set of points on the rotor outer surface for which an instantaneous velocity vector is perpendicular to a line drawn from a member of the set of points to the second axis of rotation as the rotor completes one revolution of rotation;

(e) a front plate and a rear plate attached at opposite sides of the housing for fluidly encasing the housing interior cavity.

Upon connecting the inlet to a fluid source, rotation of the rotor draws fluid into a space formed between the rotor and the housing cavity inner surface and discharges the fluid from the outlet.

In a preferred embodiment, the rotary pump, the crankshaft induces rotation of the rotor about the second axis of rotation at a second angular velocity that is half the first angular velocity.

In another preferred embodiment, the rotor has a pair of oppositely disposed tips, and the rotor tips are separated by a distance that provides a substantially continuous gap between the tips and the housing cavity inner surface.

In another preferred embodiment, the housing cavity inner surface has an interiorly-extending inverted apex portion between the inlet and the outlet and a pair of cut-outs formed therein adjacent the inlet and the outlet. The cut-outs extending circumferentially away from the inverted apex portion and axially between the front plate and the rear plate. The cut-outs can extend partially between the front plate and the rear plate. Each of the cut-outs can be connected to the housing cavity inner surface by a transition portion. In this embodiment, the rotor preferably has a pair of oppositely disposed tips, the rotor tips separated by a distance that provides a substantially continuous gap between the tips and the housing cavity inner surface.

In another preferred embodiment, the rotary pump further comprises at least one lining disposed along at least a portion of the housing cavity inner surface. The at least one lining is preferably formed of a material that is less abradable than the housing cavity inner surface. The at least one lining can be replaceable. The at least one lining can be a plurality of stacked linings, each of the linings having a thickness such that when stacked an adjustable gap is formed between the elliptical rotor tips and the housing cavity inner surface. The linings can have a uniform thickness or thicknesses that vary such that the gap differs in radial distance at different locations along the housing cavity inner surface.

In another preferred embodiment, the rotor has a circumferential edge, and the rotary pump further comprises a compressible seal disposed around the elliptical rotor circumferential edge.

In another preferred embodiment, the elliptical rotor has a front face and a rear face and the elliptical rotor further comprises at least one friction feature disposed on at least one of the elliptical rotor front face and rear face. The at least one friction feature is preferably formed of abradable material.

In another embodiment, the rotary pump further comprises a second elliptical rotor capable of undergoing eccentric rotation within the housing interior cavity, and the elliptical rotors are separated within the housing interior cavity by a central plate. The rotary pump can further comprise a valve operatively associated with the central plate for relieving internal pressure within a volume defined by at least a portion of the housing cavity on one side of the central plate to a volume defined by at least a portion of the housing cavity on the other the of the central plate.

In another embodiment, the rotary pump further comprises a valve for relieving internal pressure within a volume defined by at least a portion of the housing cavity. The valve can be a one-way sprung check valve.

In another preferred embodiment, the inverse apex is hinged and biased such that the inverse apex is rotatable away from a position substantially perpendicular to a tangent to the housing cavity inner surface to form a gap between the housing cavity inner surface and the elliptical rotor, thereby relieving pressure in an adjacent volume formed in the housing cavity.

Another improved rotary pump comprising:

(a) a rotor comprising an outer surface having an elliptical cross-section;

(b) a crankshaft for providing rotational force to rotate the rotor about a first axis of rotation at a first angular velocity;

(c) a mechanical coupling between the crankshaft and the rotor, the coupling configured such that:

(i) rotation of the crankshaft about the first axis of rotation induces rotation of the rotor about an instantaneous second axis of rotation at a second angular velocity proportional to the first angular velocity, the second axis of rotation positioned at a fixed distance from the first axis of rotation; and (ii) the second axis of rotation orbits about the first axis of rotation at the first angular velocity;

(d) a housing having an inlet and an outlet formed therein, the housing having an interior cavity within which the rotor is configured to rotate, the housing interior cavity encased by a front plate and a rear plate attached at opposite sides of the housing, the housing interior cavity comprising an interiorly-extending inverted apex portion between the inlet and the outlet.

Upon connecting the inlet to a fluid source, rotation of the rotor draws fluid into a space formed between the rotor and the housing cavity inner surface and discharges the fluid from the outlet.

An improved method directs fluid from an inlet to an outlet formed in a housing having an interior cavity. The method comprises:

(a) rotating a crankshaft mechanically coupled to a rotor comprising an outer surface having an elliptical cross-section, the crankshaft rotating the rotor within the housing interior cavity about a first axis of rotation at a first angular velocity, the coupling configured such that:

(i) rotation of the crankshaft about the first axis of rotation induces rotation of the rotor about an instantaneous second axis of rotation at a second angular velocity proportional to the first angular velocity, the second axis of rotation positioned at a fixed distance from the first axis of rotation; and (ii) the second axis of rotation orbits about the first axis of rotation at the first angular velocity;

(b) connecting the inlet to a fluid source.

The housing interior cavity comprises an inner surface having a cross-sectional profile defined by a locus of a set of points on the rotor outer surface for which an instantaneous velocity vector is perpendicular to a line drawn from a member of the set of points to the second axis of rotation as the rotor completes one revolution of rotation.

Rotation of the rotor draws the fluid into a space formed between the rotor and the housing cavity inner surface and discharges the fluid from the outlet.

Another improved method directs fluid from an inlet to an outlet formed in a housing having an interior cavity encased by a front plate and a rear plate attached at opposite sides of the housing. The method comprises:

(a) rotating a crankshaft mechanically coupled to a rotor comprising an outer surface having an elliptical cross-section, the crankshaft rotating the rotor within the housing interior cavity about a first axis of rotation at a first angular velocity, the coupling configured such that:

(i) rotation of the crankshaft about the first axis of rotation induces rotation of the rotor about an instantaneous second axis of rotation at a second angular velocity proportional to the first angular velocity, the second axis of rotation positioned at a fixed distance from the first axis of rotation; and (ii) the second axis of rotation orbits about the first axis of rotation at the first angular velocity;

(b) connecting the inlet to a fluid source.

The housing interior cavity comprising an interiorly-extending inverted apex portion between the inlet and the outlet.

Rotation of the rotor draws the fluid into a space formed between the rotor and the housing cavity inner surface and discharges the fluid quantity from the outlet.

A rotary machine has a rotor with at least two rotor apexes. In some embodiments the rotor is elliptical in cross section. The rotor is located in a housing in which it can undergo eccentric rotation when driven by a crankshaft. The rotation of the crankshaft can be an integer multiple of the rotation rate of the rotor and in the same direction of the rotor. In some embodiments with an elliptical rotor, the integer multiple is two.

The rotor is in contact with at least one point of the interior surface of the housing during its rotation and forms multiple chambers from which different inlet and outlet ports can be connected. The rotary machine can also contain a dynamic apex seal which is formed at an inverse apex region of the interior of the housing. In a preferred embodiment, the inverse apex region can be shaped like the arc of a circle. In other embodiments, the inverse apex region can be shaped, among other things, like a portion of a parabolic curve, a portion of a polynomial of degree higher than two, and/or a portion of a sinusoidal curve.

In at least one embodiment, multiple rotors are used in the housing and are configured to rotate out of phase with respect to each other to reduce the variation in the net output flow rate.

In some embodiments, the crankshaft is coupled to a driveshaft of a motor via a universal joint wherein the driveshaft is configured to rotate at a substantially constant rate, and the universal joint is configured to provide a variation in the rotational rate of the crankshaft. Alternatively, or in addition, in some embodiments, the transmission can comprise a non-circular gearing mechanism that is configured to provide a variation in the rotational rate of the crankshaft.

In one embodiment, the rotary machine also includes a sun gear, a ring gear, and a mechanical coupling. The ring gear rotates via the mechanical coupling when the crankshaft rotates. The sun gear can contain a protrusion which is configured to connect the sun gear to the rotor via a socket located on the surface of the rotor. In one embodiment the protrusion is a hexagonal key.

BRIEF DESCRIPTION OF THE DRAWINGS

FIGS. 25A-25I are schematics illustrating the geometry of the rotodynamic pump assembly of FIG. 22 at different stages of rotation of the two elliptical rotors.

DETAILED DESCRIPTION OF PREFERRED EMBODIMENT(S)

The present apparatus and method relate to rotary machines in which at least one rotor has planetary motion within a housing, wherein the housing is shaped to provide advantages for applications including, but not limited to, rotary compressors, positive displacement pumps, dynamic pumps, vacuum pumps and expansion engines.

Figure 1:
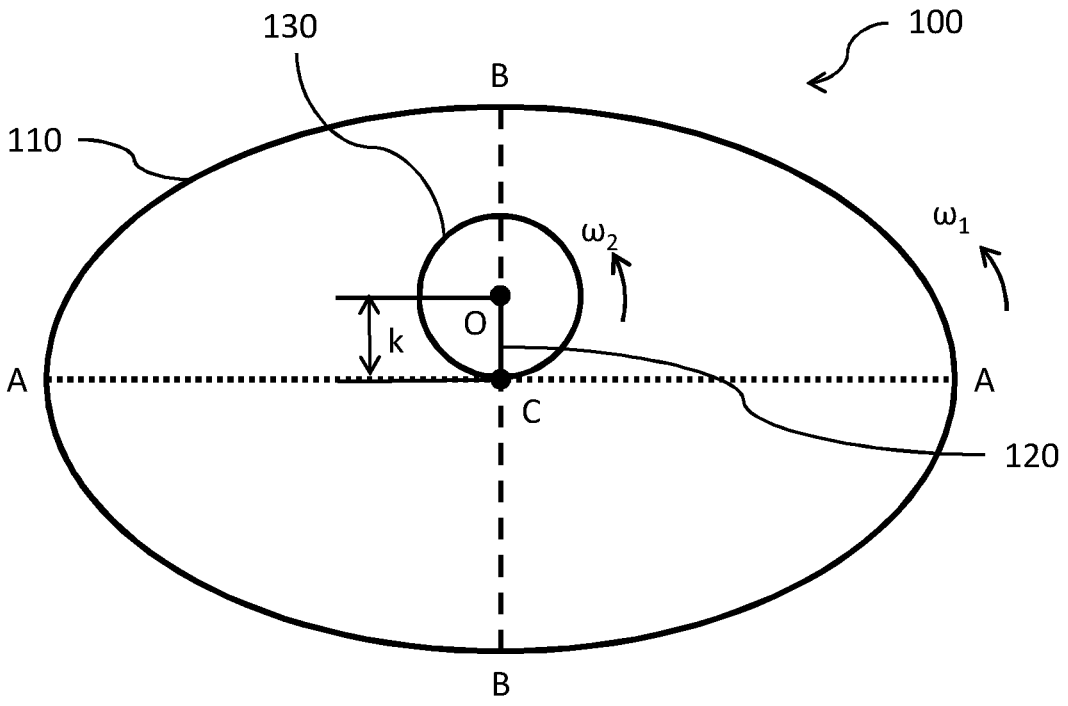
FIG. 1 is a schematic illustrating the geometry of an ellipse rotating about the rotating end of a rotating radial arm.

FIG. 1 is a schematic illustrating the geometry of an ellipse rotating about the head of a rotating radial arm. In geometric configuration 100, ellipse 110 has a center C, a major axis indicated by dotted line AA and a minor axis indicated by dashed line BB. Major axis AA is the longest diameter of ellipse 110, and minor axis BB is the shortest diameter of ellipse 110. Ellipse 110 rotates about center C at an angular velocity $\omega_1$ in a counter-clockwise direction relative to a frame of reference in which center C is stationary. Centre C is located at the head of a rotating radial arm 120. Radial arm 120 has length k and rotates about a fixed end O at an angular velocity $\omega_2$ in a counter-clockwise direction relative to a frame of reference in which fixed end O is stationary.

If angular velocity $\omega_1$ is negative, it indicates that rotation of ellipse 110 about center C is in a clockwise direction relative to a frame of reference in which center C is stationary. If angular velocity $\omega_2$ is negative, it indicates that rotation of radial arm 120 about fixed end O is in a clockwise direction relative to a frame of reference in which fixed end O is stationary.

Depending on the relative magnitude of $\omega_1$ and $\omega_2$, ellipse 100 may appear to rotate in a clockwise direction relative to a frame of reference in which fixed end O is stationary even when $\omega_1$ and $\omega_2$ are both positive.

Circle 130 is the locus of the head of radial arm 120 as it rotates about fixed end O. Line OC is also referred to as the crank arm, and length k is also referred to as the crank radius.

Angular velocities $\omega_1$ and $\omega_2$ can be different from one another, and can be positive or negative; that is, rotation of ellipse 110 and/or rotation of radial arm 120 can be in a counter-clockwise or clockwise direction.

When angular velocity $\omega_1$ is half angular velocity $\omega_2$, ellipse 110 rotates half as fast as radial arm 120, and radial arm 120 completes two full revolutions for each full revolution of ellipse 110. There can be an initial phase lag between the rotations of ellipse 110 and radial arm 120 at the start of rotation. The initial phase lag is an angle describing the phase difference between the rotational motion of ellipse 110 and the rotational motion of radial arm 120. When the initial phase lag is $3\pi/4$ radians (or equivalently 135 degrees), major axis AA of ellipse 210 is horizontal when radial arm 120 is vertical, with center C of ellipse 210 directly below fixed end O of radial arm 120. This is the configuration shown in FIG. 1.

Figure 2:
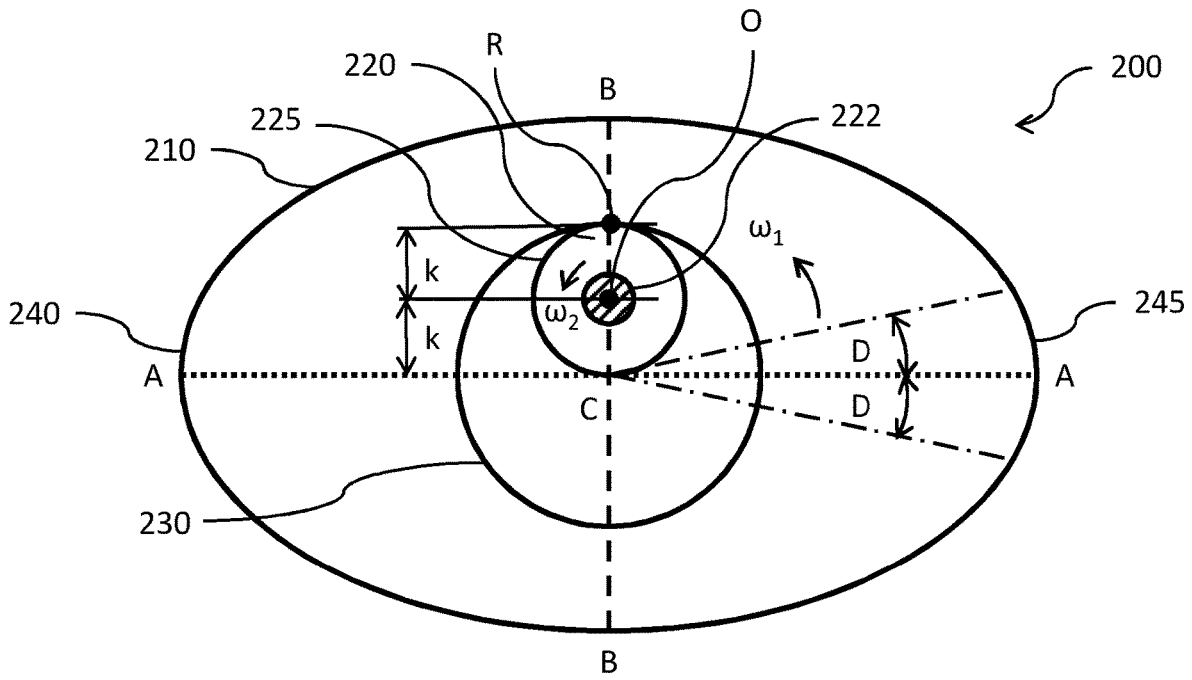
FIG. 2 is a schematic illustrating the geometry of an elliptical rotor assembly in cross-section.

FIG. 2 is a schematic illustrating the geometry of an elliptical rotor assembly in cross-section. Elliptical rotor assembly 200 comprises a rotor 210 having an elliptical cross-section. Rotor 210 is referred to as an elliptical rotor. Dotted line AA is the major axis of elliptical rotor 210. Dashed line BB is the minor axis of elliptical rotor 110.

In operation, elliptical rotor 210 rotates in a manner as described for ellipse 110 in FIG. 1. The rotation can be achieved mechanically in a number of ways. In the embodiment show in FIG. 2, elliptical rotor assembly 200 comprises a sun gear 220, a crankshaft 222, a ring gear 230 and a mechanical coupling (not shown in FIG. 2). Sun gear 220 is fixed (for example to non-rotating components not shown in FIG. 2) and does not rotate. Sun gear 220 is meshed with a ring gear 230 fixed to elliptical rotor 210. When crankshaft 222 rotates, ring gear 230 is made to rotate by means of the mechanical coupling. The mechanical coupling is configured to hold ring gear 230 against sun gear 220, keeping crank arm length k constant at all times during rotation.

The angular velocity (rotational rate) of elliptical rotor 210 about its instantaneous center of rotation R is $\omega_1$. The angular velocity of crankshaft 222 is $\omega_2$. In the example embodiment of elliptical rotor assembly 200 shown in FIG. 2, $\omega_1$ and $\omega_2$ are both in a counter-clockwise direction. The angular velocity of crankshaft 222 and the angular velocity of elliptical rotor 210 can be different. In an example embodiment, $\omega_2$ is twice $\omega_1$; that is, the angular velocity of crankshaft 222 is twice the angular velocity of elliptical rotor 210. In the example embodiment, crankshaft 222 makes two complete revolutions for each complete revolution of elliptical rotor 210. In the example embodiment, the tooth count and pitch diameter of ring gear 230 are twice the tooth count and pitch diameter of sun gear 220 on crankshaft 222.

In the configuration described above, an instantaneous center of rotation R of elliptical rotor 210 lies at a point 2*k* from center C of elliptical rotor 210 on a line drawn from center C through the center O of crankshaft 222.

Circle 225 is the circumference of sun gear 220 and is the locus of instantaneous center of rotation R of elliptical rotor 210 as crankshaft 222 rotates.

Rotor tips 240 and 245 are defined as regions on the outer surface of elliptical rotor 210 at or close to the ends of major axis AA. For the purposes of the present description, the rotor tips are defined as places on the outer surface of elliptical rotor 210 that subtend an angle equal to or less than angle D from major axis AA at center C.

The magnitude of angle D varies with the relative lengths of major axis AA and minor axis BB. In an example embodiment, the ratio of major axis AA to minor axis BB can be approximately 1.85 and angle D can be approximately 12 degrees.

The term "rotolliptic motion" is defined to mean the motion of a rotary machine comprising a rotor having two or more rotor apexes (or lobes) and a housing in which the rotor undergoes eccentric rotation driven by a crankshaft, the rotation rate of the crankshaft being substantially an integer multiple of the rotation rate of the rotor, the rotations being in the same direction and the integer multiple being equal to the number of rotor apexes, wherein the rotor is in contact with one or more fixed points or localized regions on the interior surface of the housing throughout its rotation.

FIGS. 3A-3D are schematics illustrating the geometry of an elliptical rotor assembly in cross-section as it undergoes eccentric rotation. Eccentric rotation is defined as rotation of the elliptical rotor about an instantaneous center of rotation that travels in a circle about a fixed point.

Figure 3A:
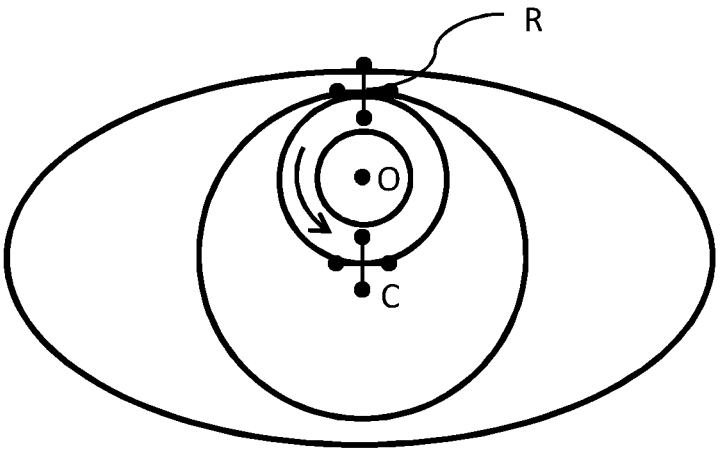
FIGS. 3A-3D are schematics illustrating the geometry of an elliptical rotor assembly in cross-section as it undergoes eccentric rotation.

FIG. 3A shows a first position of elliptical rotor 210 of FIG. 2, with major axis AA of elliptical rotor 210 in a horizontal orientation and crank arm OC (which is equivalent to radial arm 120 in the geometry of FIG. 1) in a vertical orientation. Instantaneous center of rotation R is located 2k from center C on a line drawn from C through O.

Figure 3B:
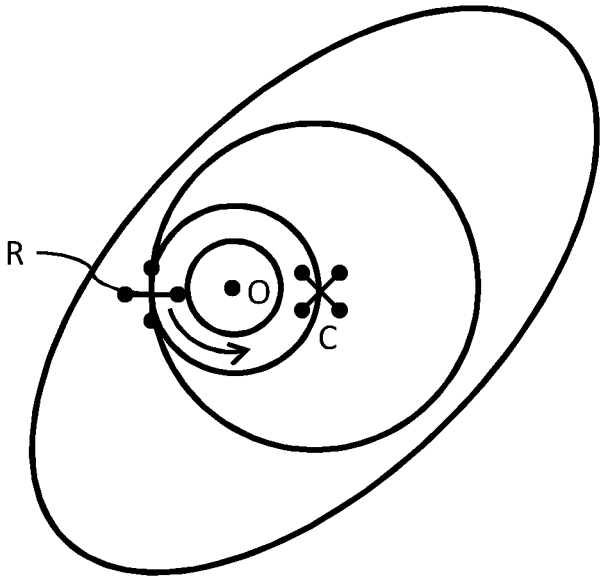

FIG. 3B shows a second position of elliptical rotor 210 of FIG. 2, after counter-clockwise rotation of crankshaft 222 of FIG. 2 through an angle of $\pi/2$ radians (90 degrees). Elliptical rotor 210 has rotated through an angle of $\pi/4$ radians (45 degrees). Instantaneous center of rotation R has rotated through an angle of $\pi/2$ radians (90 degrees), and (as in FIG. 3A) is located 2k from center C on a line drawn from center C to instantaneous center of rotation R through origin O. Line CR is the diameter of a circle with radius k.

Figure 3C:
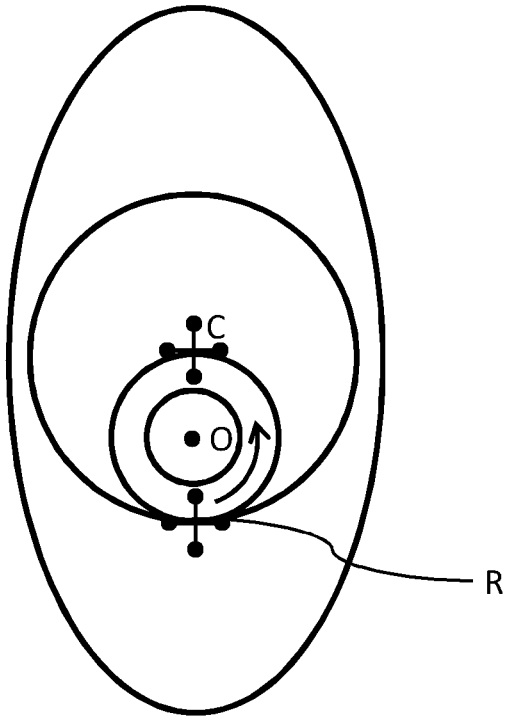

FIG. 3C shows a third position of elliptical rotor 210 of FIG. 2, after counter-clockwise rotation of crankshaft 222 of FIG. 2 through an angle of $\pi/2$ radians (90 degrees) relative to the second position (FIG. 3B). Elliptical rotor 210 has rotated through an angle of $\pi/4$ radians (45 degrees) relative to the second position (FIG. 3B). Instantaneous center of rotation R has rotated through an angle of $\pi/2$ radians (90 degrees) relative to the second position (FIG. 3B), and (as in FIGS. 3A and 3B) is located 2k from center C on a line drawn from C through O. Major axis AA of elliptical rotor 210 is in a vertical orientation and line OC is also in a vertical orientation.

Figure 3D:
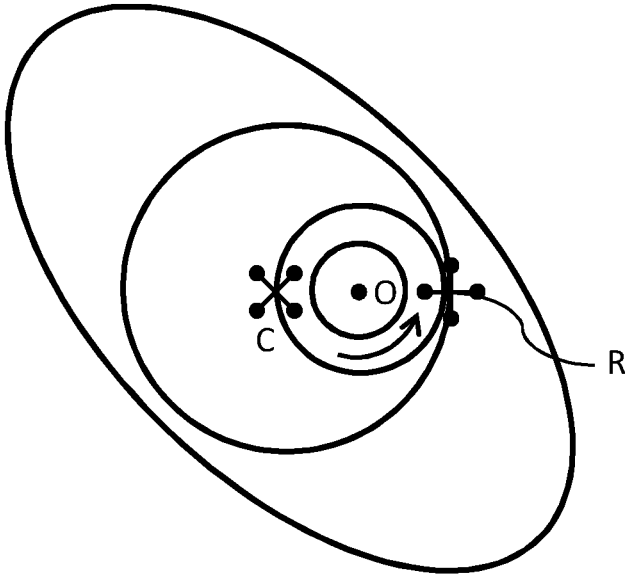

FIG. 3D shows a fourth position of elliptical rotor 210 of FIG. 2, after counter-clockwise rotation of crankshaft 222 of FIG. 2 through an angle of $\pi/2$ radians (90 degrees) relative to the third position (FIG. 3C). Elliptical rotor 210 has rotated through an angle of $\pi/4$ radians (45 degrees) relative to the third position (FIG. 3C). Instantaneous center of rotation R has rotated through an angle of $\pi/2$ radians (90 degrees) relative to the third position (FIG. 3C), and (as in FIGS. 3A-3C) is located 2k from center C on a line drawn from C through O.

Figure 4:
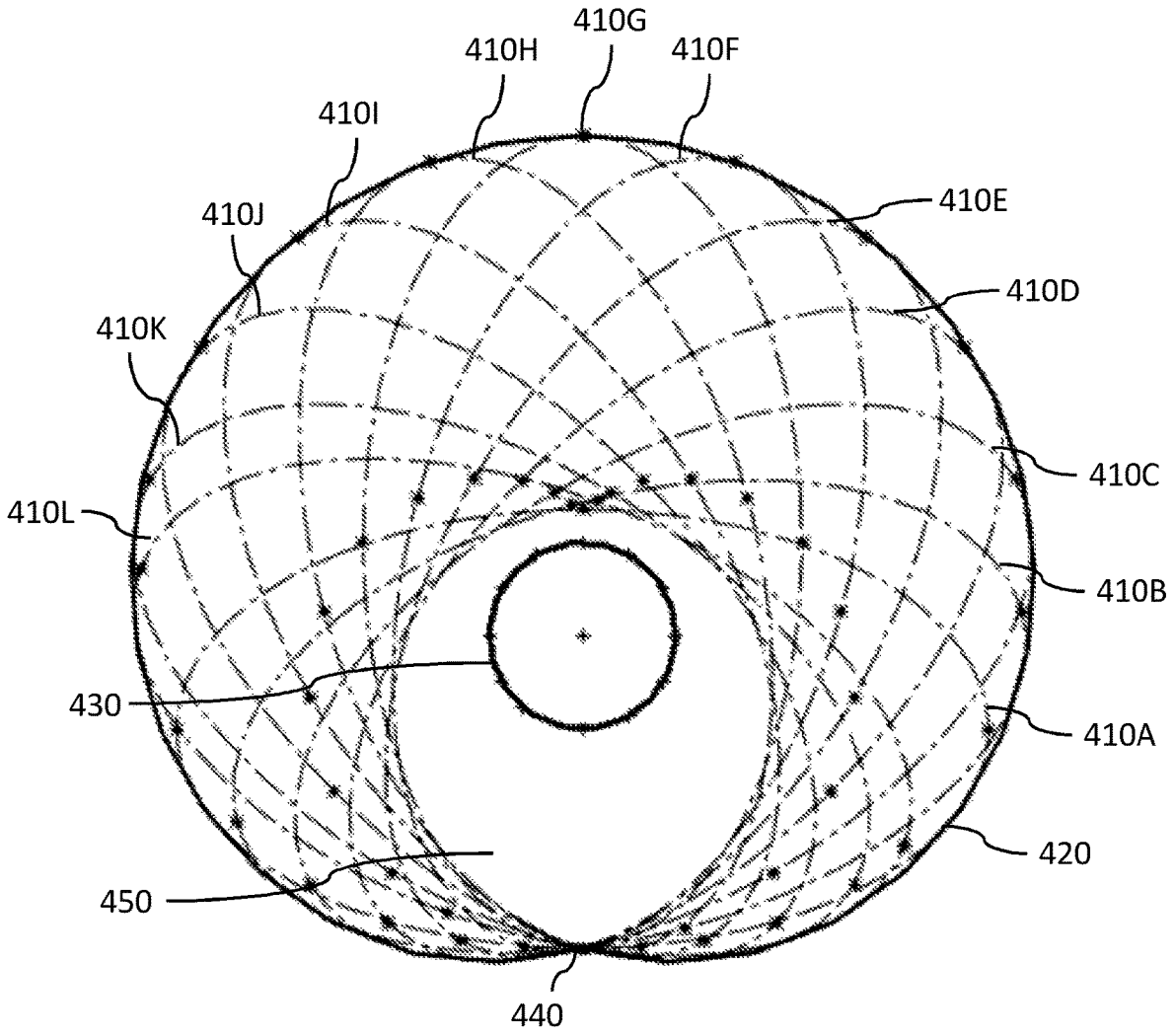
FIG. 4 is a schematic illustrating the profile generated by an elliptical rotor assembly in cross-section as it undergoes eccentric rotation.

FIG. 4 is a schematic illustrating the profile generated by an elliptical rotor assembly in cross-section as it undergoes eccentric rotation as described above. Ellipse profiles 410A-410L show the orientation of elliptical rotor 210 of FIG. 2 as it rotates when crankshaft 222 of FIG. 2 is rotated. The outer envelope of profiles 410A-410L, and all intervening profiles that could be generated by rotation of elliptical rotor 210, describes the shape 420 of the inner surface of a housing in which elliptical rotor 210 can be situated.

Circle 430 is the locus of the instantaneous center of rotation of ellipse 410.

Shape 420 encloses elliptical rotor 210 for all angles of rotation. The instantaneous velocity vector at a given point on ellipse 410 lies perpendicular to a line joining the given point to the instantaneous center of rotation (shown as R in FIGS. 2 and 3A-3D). For a given ellipse profile (such as 410A-410L and all intervening profiles that could be generated by rotation of ellipse 410), there exists a set of points lying on the ellipse at which the instantaneous velocity vector is tangential to the ellipse. The locus of all such sets of points for all ellipse profiles describes shape 420.

Shape 420 has three places of contact with ellipse 410 at all angles of rotation; that is for ellipse profiles 410A-410L and all intervening profiles that could be generated by rotation of elliptical rotor 210, with the exception of when the major axis of ellipse 410 is oriented vertically in which case shape 420 has just two points of contact with ellipse 410. Ellipse 410 is always in contact with the "inverse apex" 440.

The asterisks drawn in FIG. 4 indicate the ends of the major and minor axes of ellipse profiles 410A-410L.

As shown in FIG. 4, the places of contact of ellipse profiles 410A-410L with shape 420 do not necessarily coincide with the ends of the major and minor axes of the ellipse profiles.

Region 450 is the region having no ellipse profile lines within it. All points belonging to region 450 lie within all ellipse profiles 410A-410L and all intervening profiles that could be generated by rotation of elliptical rotor 210.

The following paragraphs describe the design and configuration of a rotary machine using the geometry described heretofore in the present application.

Figure 5:
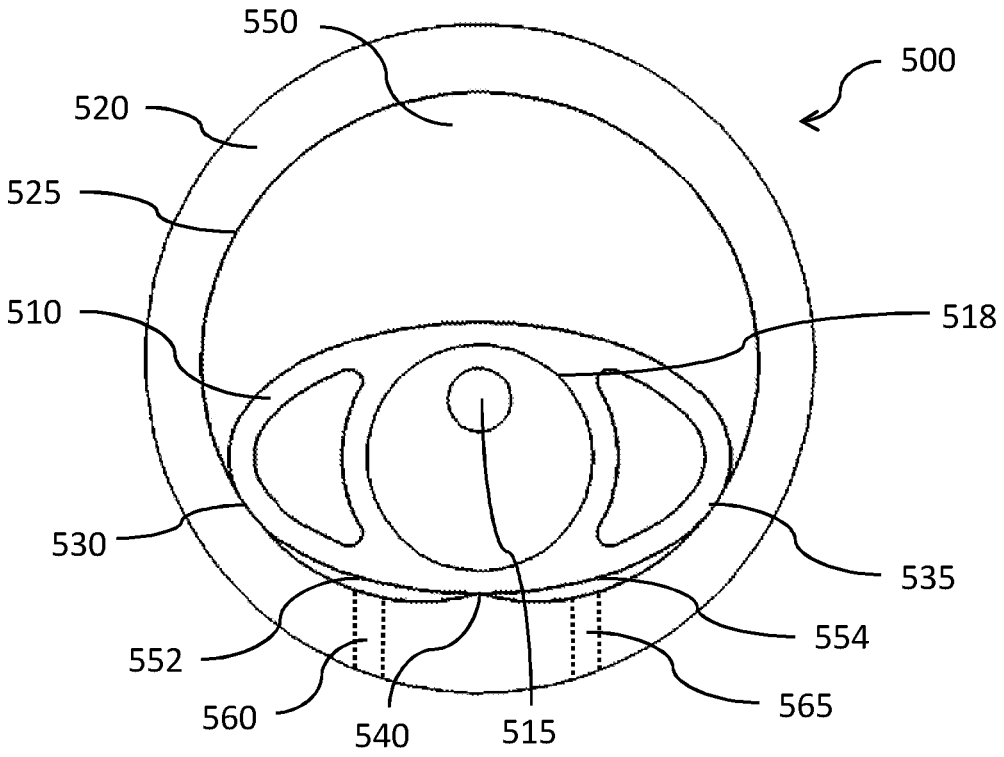
FIG. 5 is a schematic illustrating the geometry of an elliptical rotor and housing assembly in cross-section.

FIG. 5 is a schematic illustrating the geometry of an elliptical rotor and housing assembly in cross-section. Assembly 500 comprises elliptical rotor 510, crankshaft 515 and housing 520 having a characteristic shape defined in FIG. 4. Elliptical rotor 510 can have the geometry shown in FIG. 2 and described above.

Inner surface 525 of housing 520 in cross-section is designed such that at least a portion of each of rotor tips 530 and 535 is in contact with housing surface 525 at all times during a complete revolution of elliptical rotor 510.

Housing surface 525 comprises an inverse apex 540. For operation of assembly 500, it is desirable that inverse apex 540 is in contact with the outer surface of elliptical rotor 510 at all times during a complete revolution of elliptical rotor 510. Referring to the geometry shown in FIG. 2, the desired contact of elliptical rotor 510 with inverse apex 540 can be achieved by configuring the geometry of assembly 500 such that the difference between major axis AA and minor axis BB of elliptical rotor 510 is four times crank radius k. In an example embodiment, major axis AA is 200 mm, minor axis BB is 108 mm, and crank radius k is 23 mm.

The contact of elliptical rotor 510 with housing 520 at three positions, as described above, divides the interior volume of housing 520 into three chambers 550, 552 and 554. When elliptical rotor 510 is in contact with housing 520 at only two distinct positions (for example when the major axis of elliptical rotor 510 is oriented vertically), elliptical rotor 510 divides the interior volume of housing 520 into just two chambers.

In some embodiments, housing 520 comprises ports 560 and 565 for inflow and outflow of fluid as desired during operation.

Circular element 518 is the mechanical coupling referred to in the paragraphs describing FIG. 2.

FIG. 6A-6G are schematics illustrating the geometry of elliptical rotor and housing assembly 500 of FIG. 5 at different stages of a single revolution of elliptical rotor 510.

Figure 6A:
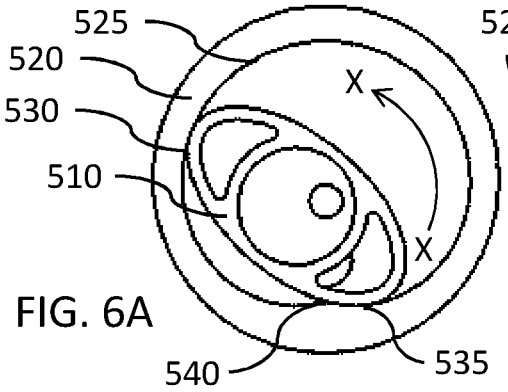
FIGS. 6A-6G are schematics illustrating the geometry of the elliptical rotor and housing assembly at different stages of a single revolution of the elliptical rotor.

FIG. 6A shows elliptical rotor 510 in a first position in housing 520. A portion of each of rotor tips 530 and 535 is in contact with inner surface 525, and outer surface of rotor 510 is in contact with inverse apex 540, as described above. In an example embodiment, rotor 510 rotates in the direction indicated by arrow XX (counter-clockwise) about its instantaneous center of rotation (as illustrated by elliptical rotor 210 and instantaneous center of rotation R of FIG. 2).

Figure 6B:
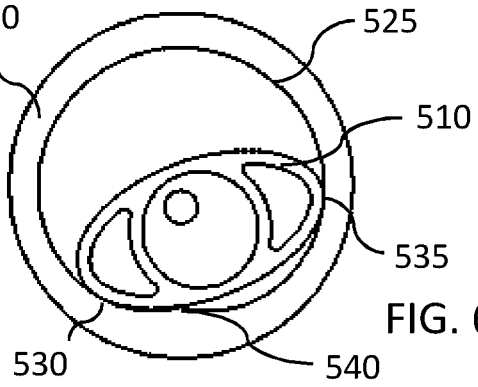
Figure 6C:
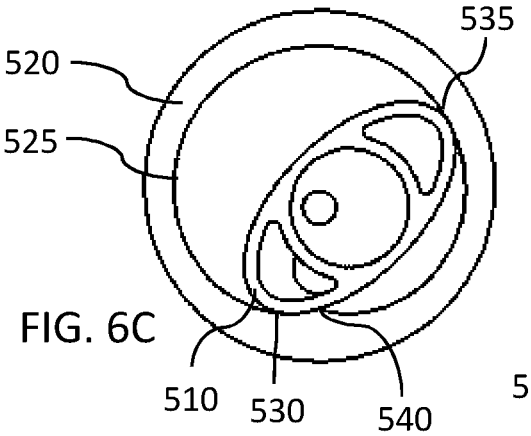
Figure 6D:
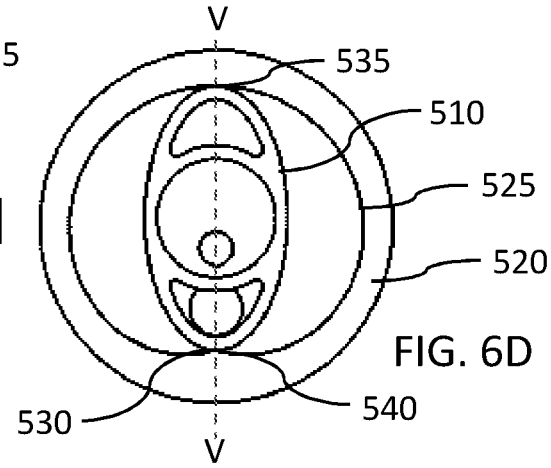

FIG. 6B shows elliptical rotor 510 in a second position after rotor 510 has rotated through an angle of approximately 60 degrees. A portion of each of rotor tips 530 and 535 remains in contact with inner housing surface 525, and outer surface of rotor 510 remains in contact with inverse apex 540, as previously described FIG. 6C shows elliptical rotor 510 in a third position after a further rotation of approximately 30 degrees. FIG. 6D shows elliptical rotor 510 in a fourth position with its major axis oriented vertically, as indicated by dashed line VV. A portion of rotor tip 530 is in contact with inverse apex 540 and a portion of rotor tip 535 is in contact with inner surface 525 directly above inverse apex 540.

For the remainder of the description below for FIGS. 6E-6G, numeral 510 for the elliptical rotor has been omitted for clarity, but it should be understood to be the same elliptical rotor shown in FIGS. 6A-6D.

Figure 6E:
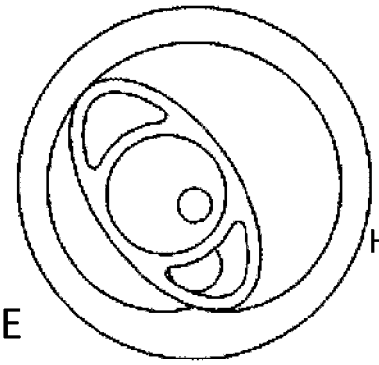
Figure 6F:
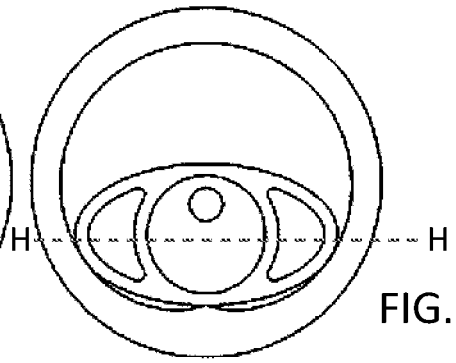
Figure 6G:
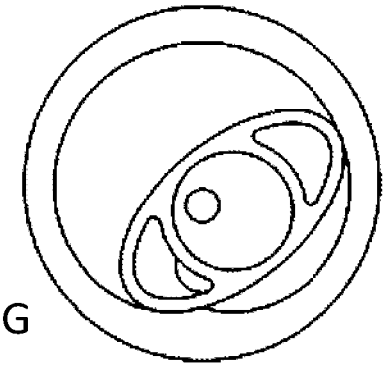

FIGS. 6E-6G show elliptical rotor 510 after further rotations in a counter-clockwise direction. FIG. 6F shows elliptical rotor 510 in a position with its major axis oriented horizontally. In a preferred embodiment, the sun and ring gears described above are configured to mesh correctly to achieve a substantially horizontal orientation of the major axis of elliptical rotor 510, as indicated by dashed line HH.

Herein, the terms horizontal, vertical, front, rear and like terms related to orientation are used in reference to the Figures with the particular orientations illustrated. Nonetheless, the rotary mechanism and rotary machine assemblies described herein can be placed in any orientation suitable for their end use application.

FIGS. 7A-7D show various views of a through-hole 570 that can be formed in the elliptical rotor and housing assembly 500 of FIG. 5. (FIGS. 7A-7D are essentially the same as FIGS. 6C-6F.) Numerals as used in FIG. 5 are used to describe the same or similar elements in FIGS. 7A-7D.

Through-hole 570 is a passage that can be formed through elliptical rotor and housing assembly 500 of FIG. 5. It traverses assembly 500 from a hole in a first planar wall (not shown in FIG. 5) on one side of assembly 500 to a hole in a second planar wall on the other side of assembly 500.

Referring again to FIG. 4, there is a region 450 that always lies within the bounds of ellipse 410 (or equivalently elliptical rotor 510). Through-hole 570 can pass through region 450 of FIG. 4 without intersecting working chambers 550, 552 or 554 of assembly 500 of FIG. 5.

Through-hole 570 does not compromise the integrity of any of the two or three working chambers such as 550, 552 and 554 of assembly 500. There is no path from the interior of through-hole 570 to the interior of working chambers 550, 552 or 554. Therefore, there is no path from the interior of the working chambers to the atmosphere outside assembly 500, and consequently no loss of pressure or fluids that may be contained within the working chambers provided the boundaries of the working chambers are sealed.

Figures 7A, 7B, 7C, 7D:
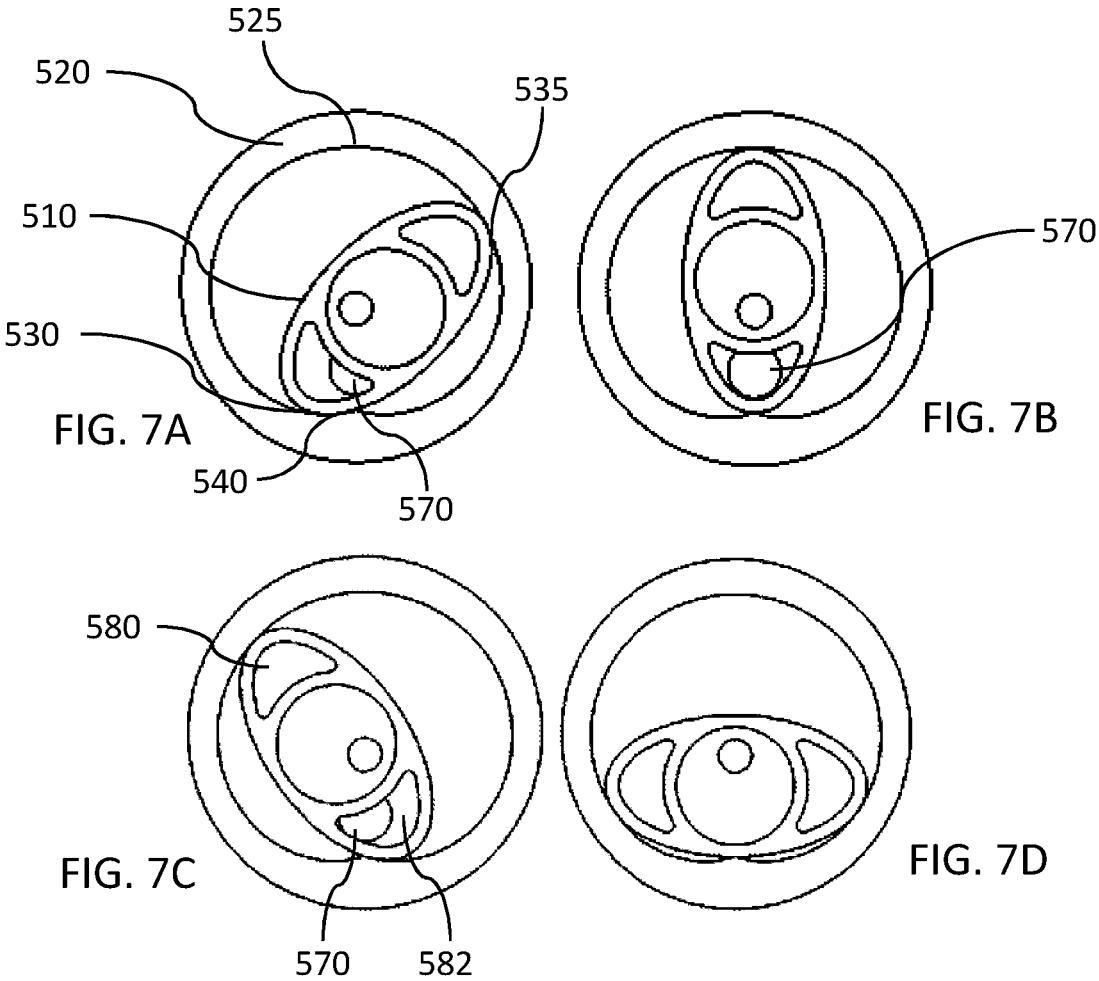
FIGS. 7A-7D show various views of a through-hole in the elliptical rotor and housing assembly of FIG. 5.

FIGS. 7A-7C illustrate a substantially straight-through path for through-hole 570 when elliptical rotor 510 is in the positions shown. Openings 580 and 582 in rotor 510 provide a path for fluid traversing assembly 500 via through-hole 570.

In FIG. 7D, through-hole 570 is hidden from view by rotor 510. Nonetheless, the sides of rotor 510 can be constructed to provide a path from one side to the other, and therefore a continuous path traversing assembly 500 via through-hole 570 and openings 580 and 582.

Through-hole 570 can be used for cooling, lubrication or other suitable purpose. In some embodiments, a first fluid introduced via through-hole 570 has a different composition than a second fluid that passes through working chambers 550, 552 and 554 of assembly 500. In other embodiments, the fluid that passes through working chambers 550, 552 and 554 can be directed through assembly 500 via through-hole 570 either before it enters the working chambers or having been discharged from the working chambers.

In the illustrated embodiment of FIG. 5, a portion of each of rotor tips 530 and 535 is substantially in contact with inner surface 525 of housing 520 at all times during rotation. In this configuration, the rotary machine can, for example, operate as a positive displacement pump, and the machine is fully scavenging, that is the machine is capable of expelling fluid from the entire volume of each of chambers 550, 552 and 554.

In another embodiment, assembly 500 can be designed such that rotor tips 530 and 535 are not always in contact with inner surface 525 of housing 520 during rotation. In this configuration, the rotary machine can, for example, operate as a dynamic pump.

Figure 8:
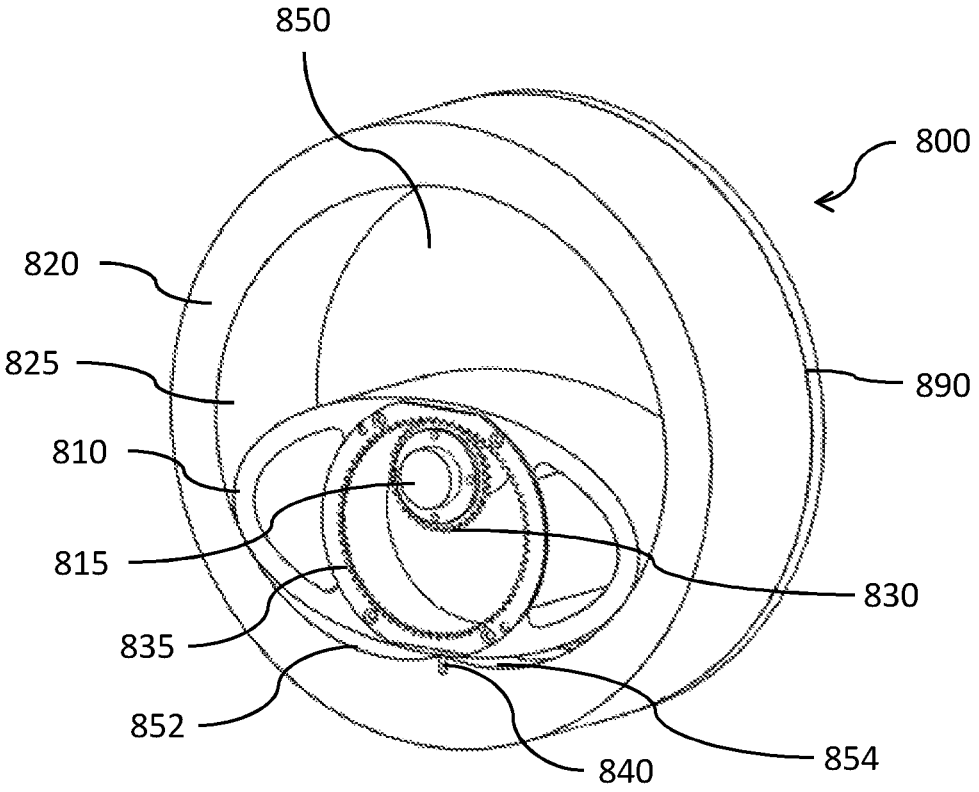
FIG. 8 is an isometric projection of an embodiment of an elliptical rotor and housing assembly.

FIG. 8 is an isometric projection of an embodiment of an elliptical rotor and housing assembly 800. Assembly 800 comprises an elliptical rotor 810 and a housing 820. Housing 820 has an inner surface 825 which in cross-section has shape 420 of FIG. 4. Inner surface 825 has an inverse apex 840 that is in contact with elliptical rotor 810 throughout rotation of elliptical rotor 810. Assembly 800 has a crankshaft 815 that turns a ring gear 835 by means of a mechanical coupling (not shown). The mechanical coupling is configured to hold ring gear 835 against a sun gear 830, keeping the crank arm length constant at all times during rotation. Ring gear 835 is fixed to elliptical rotor 810, and rotates about sun gear 830, resulting in eccentric rotation of elliptical rotor 810 about the center axis of crankshaft 815. As described in reference to FIG. 5, elliptical rotor 810 is in contact with inner surface 825 at two or three places, and divides the interior volume of housing 820 into two or three working chambers, for example chambers 850, 852 and 854 of FIG. 8. Elliptical rotor 810 is held within housing 820 by a first planar wall 890 at the rear of assembly 800 and a second planar wall (not shown) at the front of assembly 800.

Figure 9A:
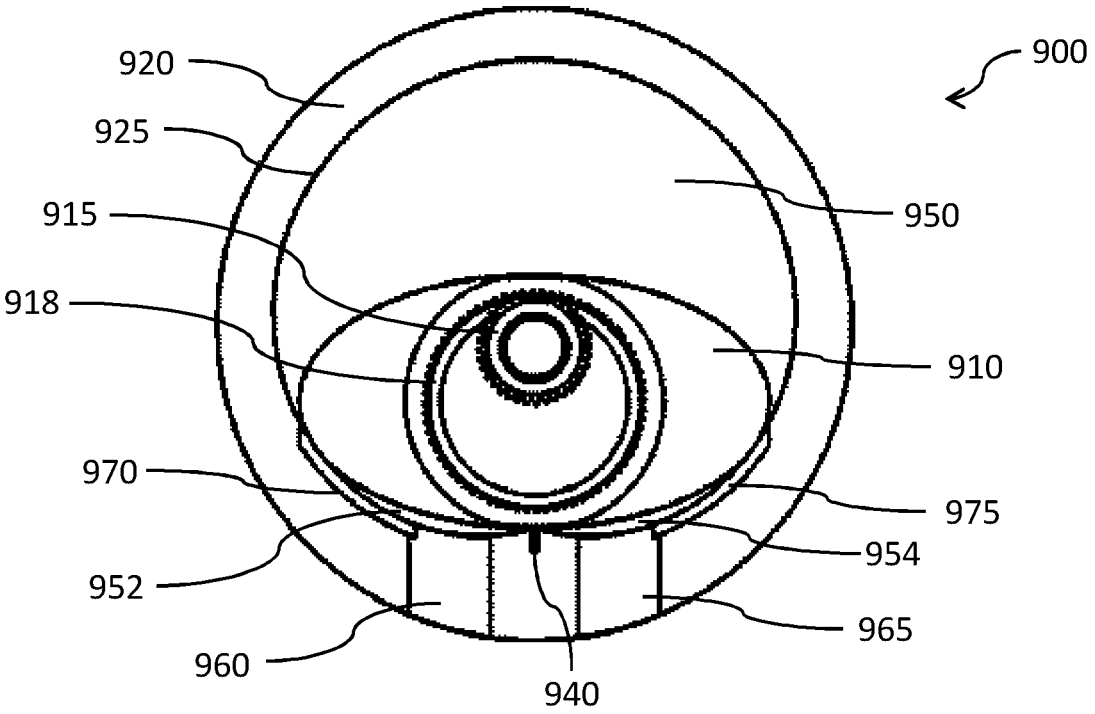
FIG. 9A is a schematic illustrating the geometry of an embodiment of a positive displacement rotary pump in cross-section.

FIG. 9A is a schematic illustrating the geometry of an embodiment of a positive displacement rotary pump assembly 900 in cross-section. Pump assembly 900 comprises an elliptical rotor 910 and a housing 920. Housing 920 has an inner surface 925 which in cross-section has shape 420 of FIG. 4. Inner surface 925 has an inverse apex 940 that is in contact with elliptical rotor 910 throughout rotation of elliptical rotor 910. Assembly 900 has a crankshaft (not shown) that turns a ring gear 918 by means of a mechanical coupling (not shown). The mechanical coupling is configured to hold ring gear 918 against a sun gear 915, keeping the crank arm length constant at all times during rotation. Ring gear 918 is fixed to elliptical rotor 910, and rotates about sun gear 915, resulting in eccentric rotation of elliptical rotor 910 about the center axis of the crankshaft.

As described in reference to FIG. 5, elliptical rotor 910 is in contact with inner surface 925 at either two or three places, and divides the interior volume of housing 920 into either two or three working chambers, respectively, for example chambers 950, 952 and 954.

As described above, inner surface 925 of pump assembly 900 of FIG. 9A is described by the outer envelope of profiles of elliptical rotor 910 generated by eccentric rotation of elliptical rotor 910.

Figure 9B:
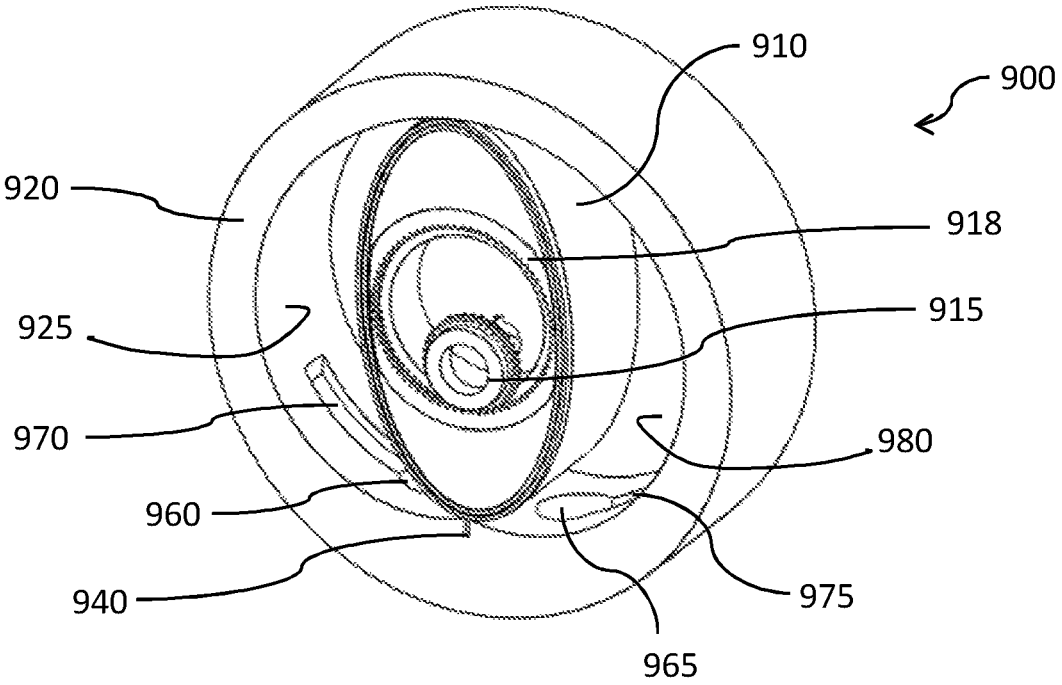
FIG. 9B is an isometric projection of the positive displacement rotary pump assembly of FIG. 9A.

FIG. 9B is an isometric projection of the positive displacement rotary pump assembly 900 of FIG. 9A. Elliptical rotor 910 is encased within housing 920 by a first plate 980 at the rear of assembly 900 and a second plate (not shown) at the front of assembly 900.

Referring to FIGS. 9A and 9B, the volume enclosed by housing 920 and first (rear) plate 980 of FIG. 9B and second (front) plate (not shown) is divided by rotor 910 into two or three chambers. Chamber 950 is at its maximum volume when rotor 910 is in an essentially horizontal orientation, as shown in FIG. 9A. For situations where the fluid being pumped is essentially incompressible (such as a liquid like water), it is beneficial to modify the inner surface of the housing, as described in more detail below.

As rotor 910 rotates clockwise, the volume of chamber 952 of FIG. 9A increases, and the volume of chamber 954 decreases.

Housing 920 has an inlet 960 and an outlet 965 for flow of fluid in and out of pump assembly 900 respectively.

Housing 920 has two cut-outs 970 and 975. Cut-outs 970 and 975 are shown in FIG. 9B as being cut into the middle of housing 920. In other embodiments, cut-outs 970 and 975 can extend from the front of housing 920 to the rear.

For pumping compressible fluids, cut-out 970 adjacent to inlet 960 is optional, and has a benefit of reducing a constriction on the flow of fluid into pump 900 through inlet 960. Cut-out 975 is not desirable for pumping compressible fluids because it would allow back-bleed of the fluid being compressed and would impair the ability of pump 900 to be fully scavenging.

For pumping incompressible fluids, cut-outs 970 and 975 are desirable to alleviate unwanted effects at inlet 960 and outlet 965. For example, cut-outs 970 and 975 can alleviate hydrolock, reduce constriction and allow greater flow.

In some embodiments of a pump assembly, elliptical rotor (such as 810 of FIG. 8 or 910 of FIG. 9A) can be fixed and the corresponding housing (820 of FIG. 8 or 920 of FIG. 9A) can be configured to rotate in an eccentric manner about the fixed rotor to obtain an essentially equivalent operation of the pump assembly. In other embodiments, the crank arm (line OC in FIG. 1) can be fixed to achieve essentially equivalent operation of the pump assembly. In yet other embodiments, a combination of rotations of elliptical rotor, housing and crank arm can be configured to achieve relative eccentric rotation and obtain an essentially equivalent operation of the pump assembly.

FIGS. 10A-10D are schematics illustrating how the cross-sectional geometry of the housing of positive displacement rotary pump assembly like that shown in FIG. 9A can be modified to create an embodiment of a rotodynamic pump assembly.

The modifications are described in two steps. The first step is illustrated in FIGS. 10A and 10B, and the second step is illustrated in FIGS. 10C and 10D.

Figure 10A:
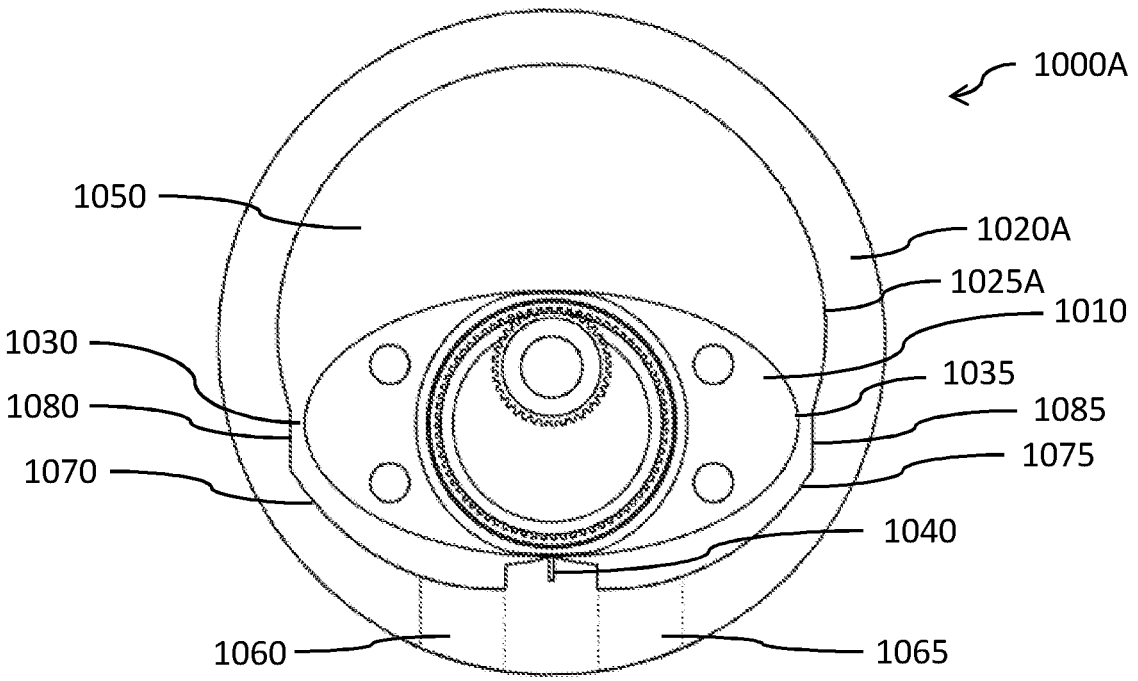
FIGS. 10A-10D are schematics illustrating how the cross-sectional geometry of the housing of the positive displacement rotary pump assembly of FIG. 9A can be modified to create an embodiment of a rotodynamic pump assembly.
Figure 10B:
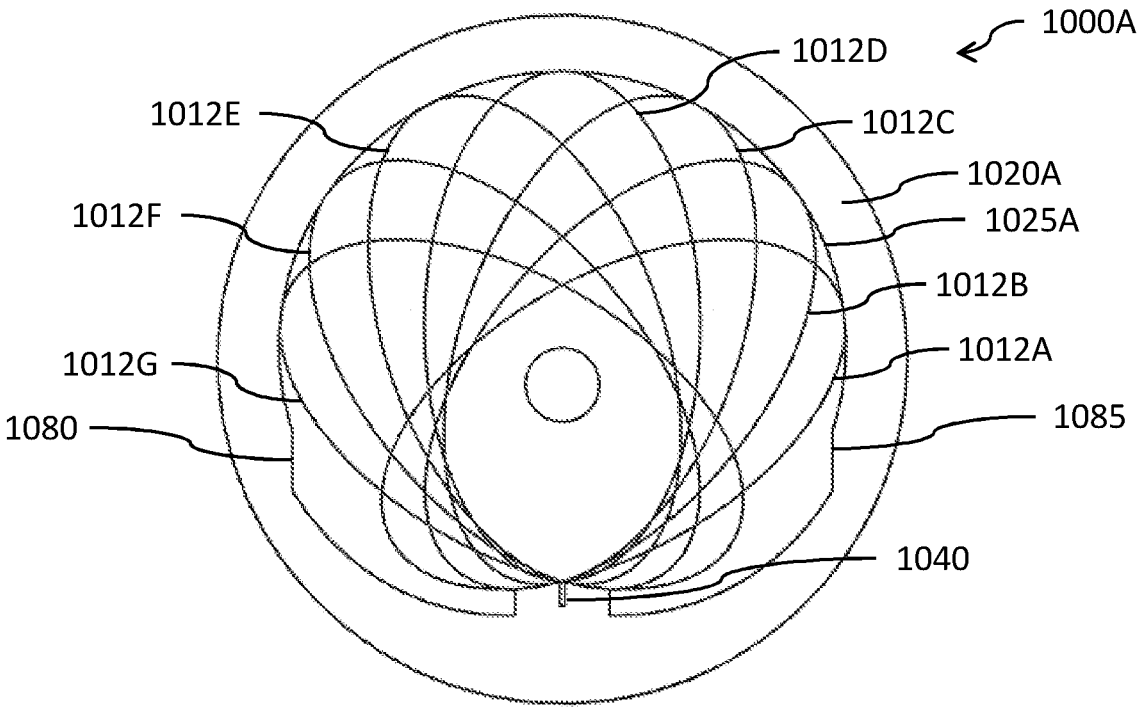
Figure 10C:
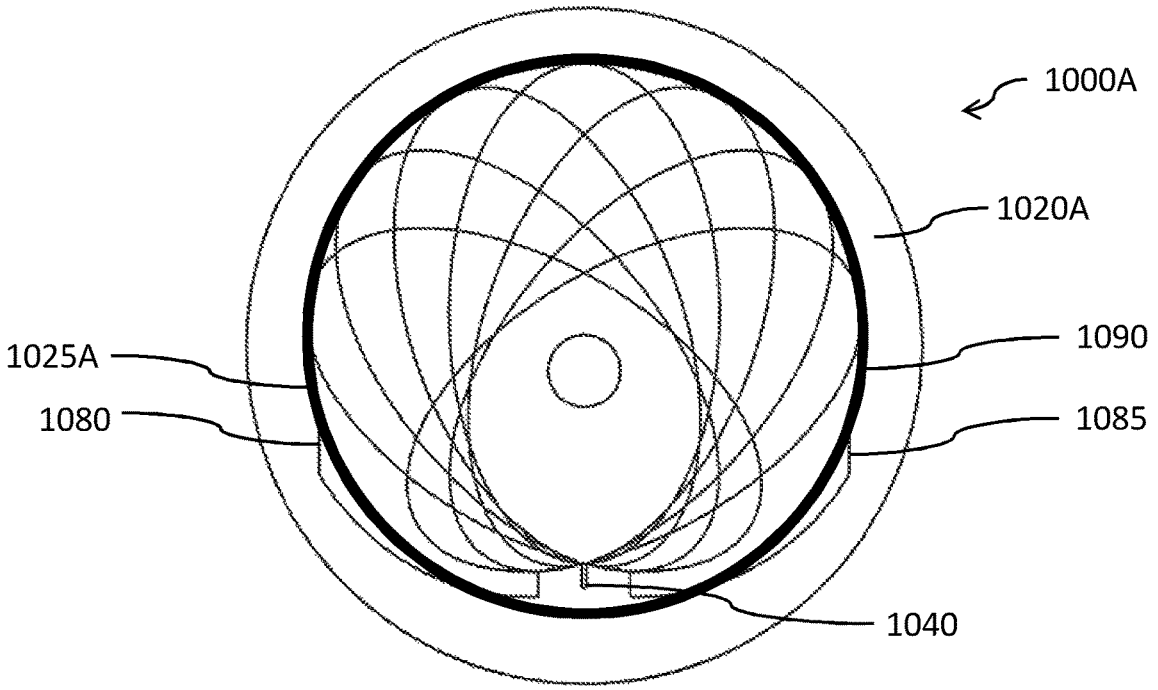
Figure 10D:
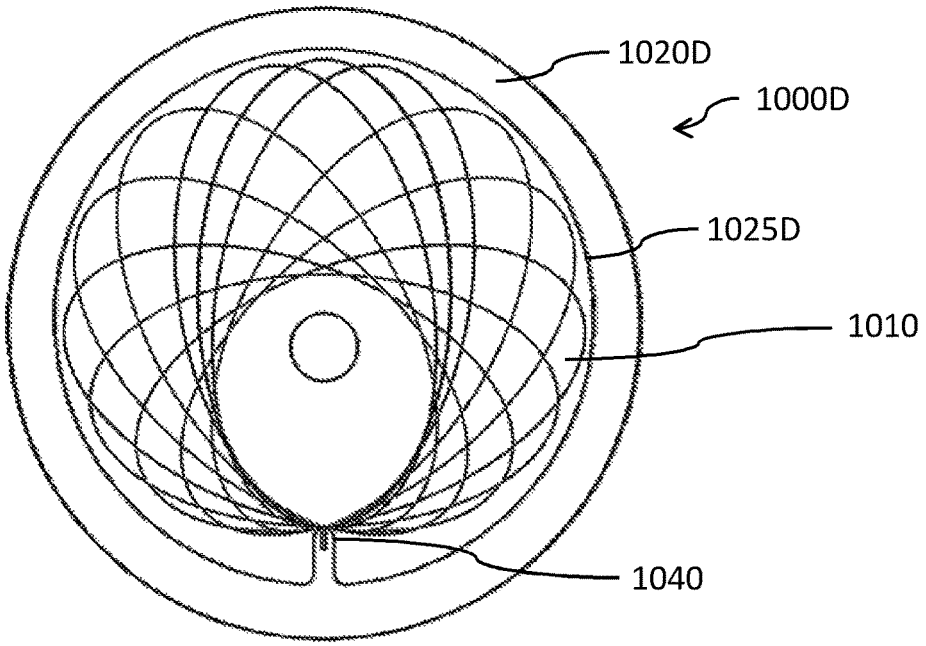

FIG. 10A shows an embodiment of rotodynamic pump assembly 1000A in cross-section. Pump assembly 1000A comprises an elliptical rotor 1010 within a housing 1020A. Elliptical rotor 1010 has rotor tips 1030 and 1035. Housing 1020A has an inlet 1060 and an outlet 1065. Housing 1020A has an inner surface 1025A that is a modified version of surface 925 of pump assembly 900 of FIGS. 9A and 9B. Surface 1025A comprises cut-outs 1070 and 1075, and transition regions 1080 and 1085. Surface 1025A comprises an inverse apex 1040. Inverse apex 1040 is in contact with rotor 1010 during rotation of rotor 1010 within housing 1020A. Rotor 1010 undergoes eccentric rotation within housing 1020A as described above.

Cut-outs 1070 and 1075 in housing 1020A extend the width of rotor 1010 from the front wall of pump assembly 1000A to the rear wall. Cut-out 1070 can be configured to allow chamber 1050 to increase the amount of fluid drawn in via inlet 1060 up to substantially the maximum volume possible in this embodiment. Cut-out 1075 can be configured to reduce mechanical restraint of the rotor when discharging an incompressible fluid via outlet 1065, thereby reducing the likelihood of hydrolock.

Transition regions 1080 and 1085 connect the cut-outs to the remainder of inner surface 1025A.

FIG. 10B shows the position of rotor 1010 in housing 1020A of pump assembly 1000A at seven points during its rotation. The outline of rotor 1010 at each of the seven positions is indicated by profiles 1012A-1012G. As shown in FIG. 10B, rotor 1010 is in contact with inverse apex 1040 during rotation, and rotor tips 1030 and 1035 (shown in FIG. 10A) are in contact with inner surface 1025A in the region above and between transition regions 1080 and 1085.

FIG. 10C shows pump 1000A of FIGS. 10A and 10B with a circle 1090 superimposed. Circle 1090 is a close approximation to inner surface 1025A of pump 1000A in the region above and between transition regions 1080 and 1085.

FIG. 10D is a cross-sectional schematic of pump 1000D comprising elliptical rotor 1010 (shown in multiple positions during its rotation) and housing 1020D. Housing 1020D has an inner surface 1025D that is circular in cross-section. One benefit of a circular cross-section is that it can be easier to manufacture than other shapes (such as the one illustrated in FIG. 10C). Another benefit of inner surface 1025D having a circular cross-section is that it can be configured to create a gap between rotor tips 1030 and 1035 (shown in FIG. 10A) and inner surface 1025D except at inverse apex 1040 for all positions of rotor 1010. Such a gap can be beneficial if the fluid being pumped contains particles or other solid matter that might be abrasive to internal surfaces and/or inhibit smooth operation of pump 1000D.

FIGS. 11A-11D are schematics illustrating the geometry of an embodiment of a rotodynamic pump at different stages of a single revolution of the elliptical rotor. Rotodynamic pump 1100 comprises an elliptical rotor 1110 and a housing 1120. Housing 1120 has an inner surface 1125 which has a substantially circular cross-section similar to housing 1020D of FIG. 10D. Inner surface 1125 has an inverse apex 1140 that is in contact with elliptical rotor 1110 throughout rotation of elliptical rotor 1110.

Figure 11A:
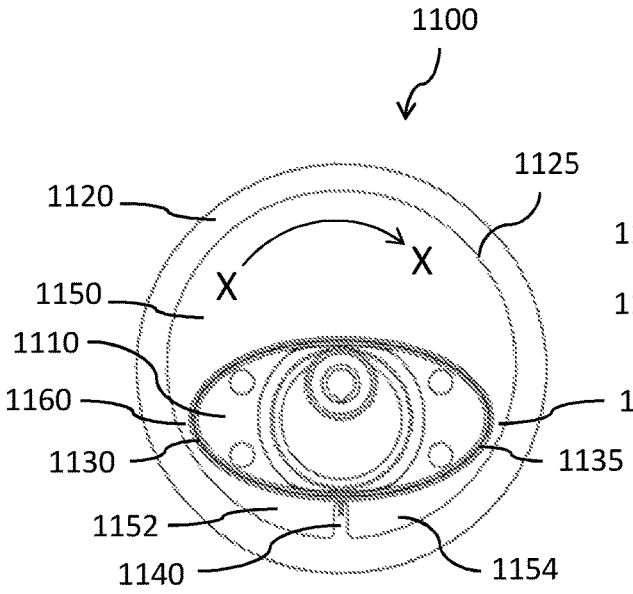
FIGS. 11A-11D are schematics illustrating the geometry of an embodiment of a rotodynamic pump assembly at different stages of a single revolution of the elliptical rotor.

FIG. 11A shows elliptical rotor 1110 in a substantially horizontal position. Elliptical rotor 1110 is in contact with inverse apex 1140. Elliptical rotor 1110 has first and second rotor tips 1130 and 1135 respectively, where the rotor tips are regions defined in the same way as rotor tips 240 and 245 of FIG. 2. There is a first gap 1160 between first rotor tip 1130 and inner surface 1125 of housing 1120, and a second gap 1162 between second rotor tip 1135 and inner surface 1125.

Elliptical rotor 1110 rotates within housing 1120 in a clockwise direction as indicated by arrow XX.

Elliptical rotor 1110 divides the interior volume of housing 1120 into three chambers 1150, 1152 and 1154 that are not fluidly isolated from one another. Fluid can move between chambers 1150 and 1152, and also between 1150 and 1154, via gaps 1160 and 1162 respectively.

Figure 11B:
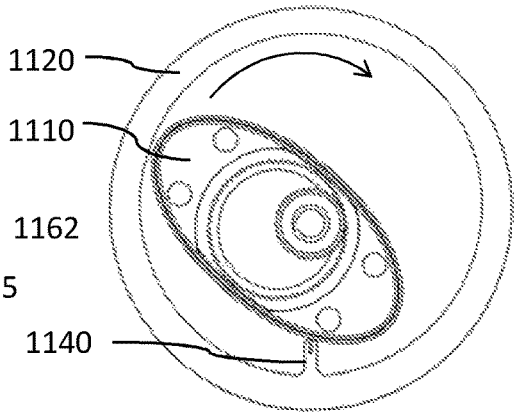

FIG. 11B shows elliptical rotor 1110 after clockwise rotation from the substantially horizontal position of FIG. 11A. Elliptical rotor 1110 remains in contact with inverse apex 1140 as it rotates.

Figure 11C:
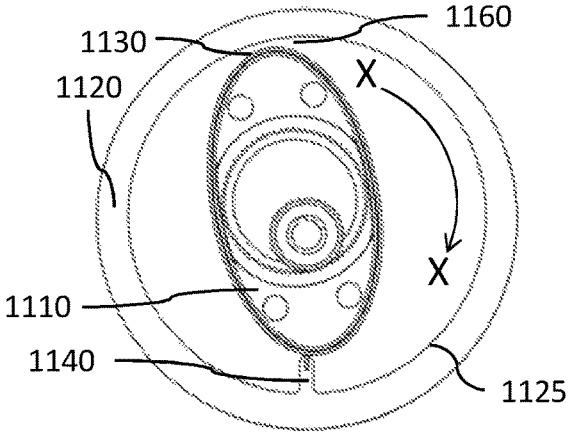

FIG. 11C shows elliptical rotor 1110 after further clockwise rotation from the position shown in FIG. 11B. Elliptical rotor 1110 is in an almost vertical position. There is still a gap 1160 between rotor tip 1130 and inner surface 1125 of housing 1120. Elliptical rotor 1110 remains in contact with inverse apex 1140. Elliptical rotor 1110 divides the interior volume of housing 1120 into two chambers separated by gap 1160 between rotor tip 1130 and inner surface 1125.

Figure 11D:
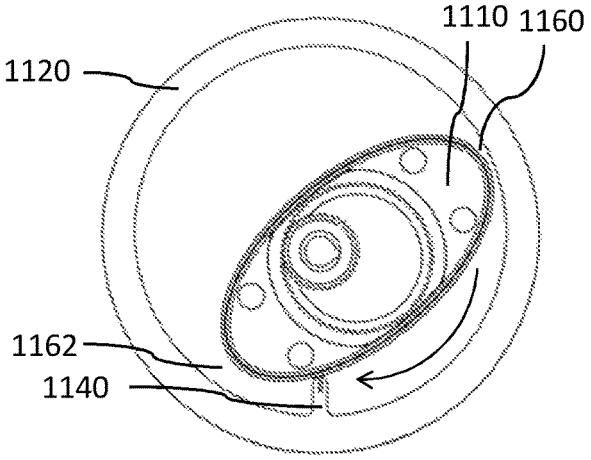

FIG. 11D shows elliptical rotor 1110 after further clockwise rotation in the direction of arrow X-X, as elliptical rotor 1110 approaches the horizontal position.

Figure 12:
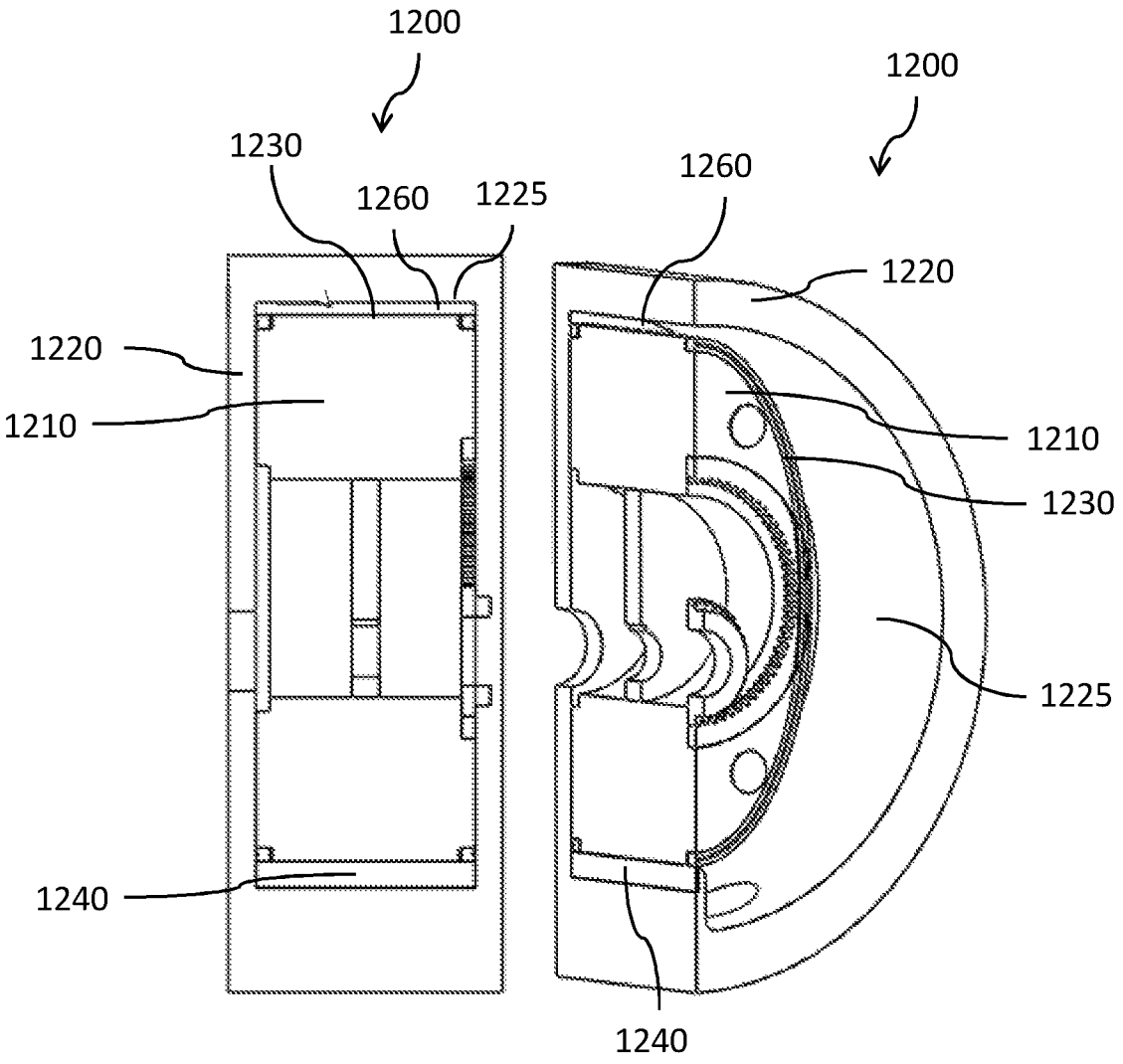
FIG. 12 is a composite schematic illustrating a first embodiment of a rotodynamic pump, like that illustrated in FIGS. 11A-11D, in side cross-section and cut-away isometric views.

FIG. 12 is a schematic illustrating a first embodiment of a rotodynamic pump like that illustrated in FIGS. 11A-11D in side cross-section and cut-away isometric views. Rotodynamic pump 1200 comprises an elliptical rotor 1210 in a housing 1220. Housing 1220 has an inverse apex 1240 with which elliptical rotor 1210 remains in contact as it rotates in housing 1220 as described above. There is a gap 1260 between rotor tip 1230 and inner surface 1225 of housing 1220.

Figure 13A:
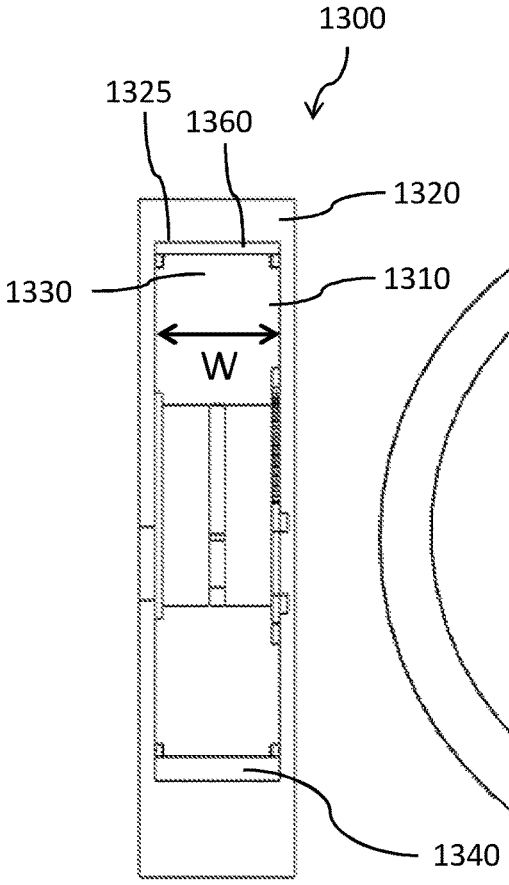
FIGS. 13A and 13B are schematics illustrating a second embodiment of a rotodynamic pump, with features similar to the rotodynamic pump illustrated in FIGS. 11A-11D, in orthogonal cross-sectional views.
Figure 13B:
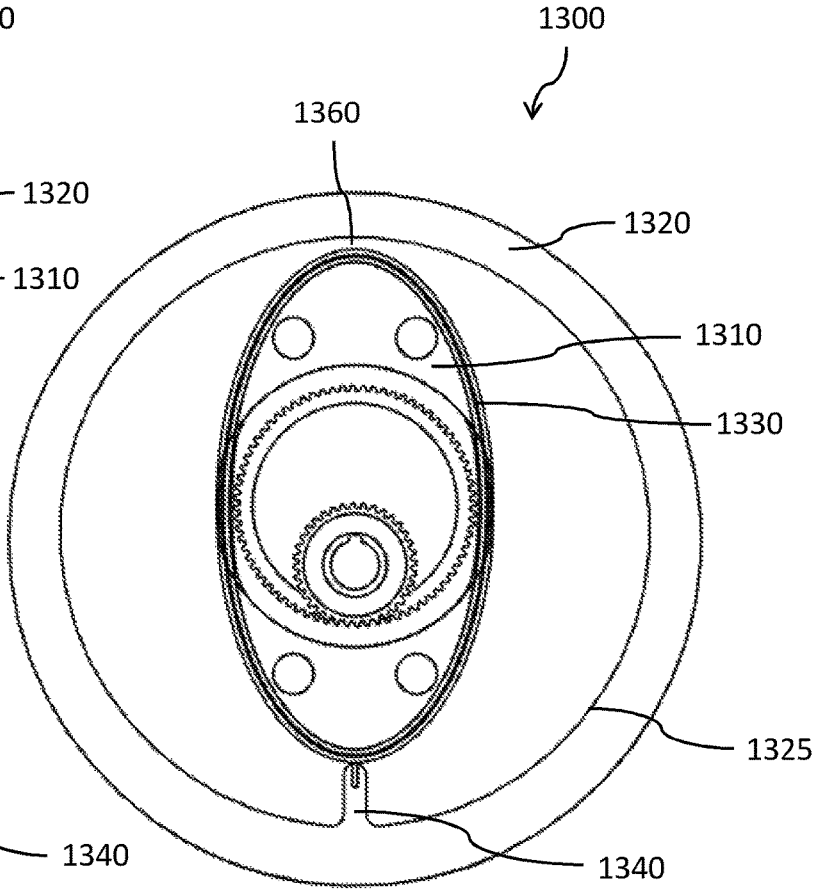

FIGS. 13A and 13B are schematics illustrating a second embodiment of a rotodynamic pump similar to that illustrated in FIGS. 11A-11D in orthogonal cross-sectional views. FIG. 13A shows a side view of a cross-section through rotodynamic pump 1300. Pump 1300 comprises an elliptical rotor 1310 in a housing 1320, in contact with an inverse apex 1340. There is a gap 1360 between rotor tip 1330 and inner surface 1325 of housing 1320. The dimension W of elliptical rotor 1310 is less than the corresponding dimension of elliptical rotor 1210 of FIG. 12, while at the same time the corresponding dimension of the interior cavity of housing 1320 within which rotor 1310 rotates is narrowed. The major and minor axes of elliptical rotor 1310 and the dimensions of housing 1320 are increased from the corresponding dimensions of pump 1200 to maintain substantially the same volume within housing 1320 as housing 1220 in FIG. 12.

A benefit of rotodynamic pump 1300 over rotodynamic pump 1200 is that, for a given distance between housing inside surface 1325 and the adjacent rotor tip, gap 1360 has a lower cross-sectional area than gap 1260 when gaps 1260 and 1360 have the same height and pumps 1200 and 1300 are dimensioned to have substantially the same volume within housings 1220 and 1320 respectively. The benefit of reducing the cross-sectional area of gap 1360 while maintaining the same volume within the housing of pump 1300 will be discussed in more detail in the following paragraph.

In rotodynamic pump 1300, gap 1360 between housing inside surface 1325 and the adjacent rotor tip is chosen to be large enough so that particles entrained in the fluid (such as in the case of a sludge), will not interfere with rotation of the rotor and will not cause significant gouging or abrading of housing inside surface 1325. Gap 1360 thus allows a deliberate leak of fluid between housing inside surface 1325 and the adjacent rotor tip and thereby degrades performance of the pump. It is therefore desirable for gap 1360 to be large enough to accommodate particles entrained in the fluid while as small as possible to reduce the detrimental impact the gap will have on performance. Having a "thinner" rotor (one with less depth, namely, a smaller W in FIG. 13A) reduces the cross-sectional area of gap 1360 for a fixed gap size (namely, the distance between housing inside surface 1325 and the adjacent rotor tip). Pump 1300 can be configured to have the same volume displacement per revolution as one with a "thicker" rotor (larger dimension W) by increasing the dimensions of elliptical rotor 1310, namely, by increasing the major and minor axes of elliptical rotor 1310.

Rotolliptic motion can be applied to geometries other than those having elliptical rotors. Rotary machines similar to those described above can comprise a rotor having a non-elliptical shape in cross-section. Examples of such embodiments are described in the following paragraphs.

Figure 14:
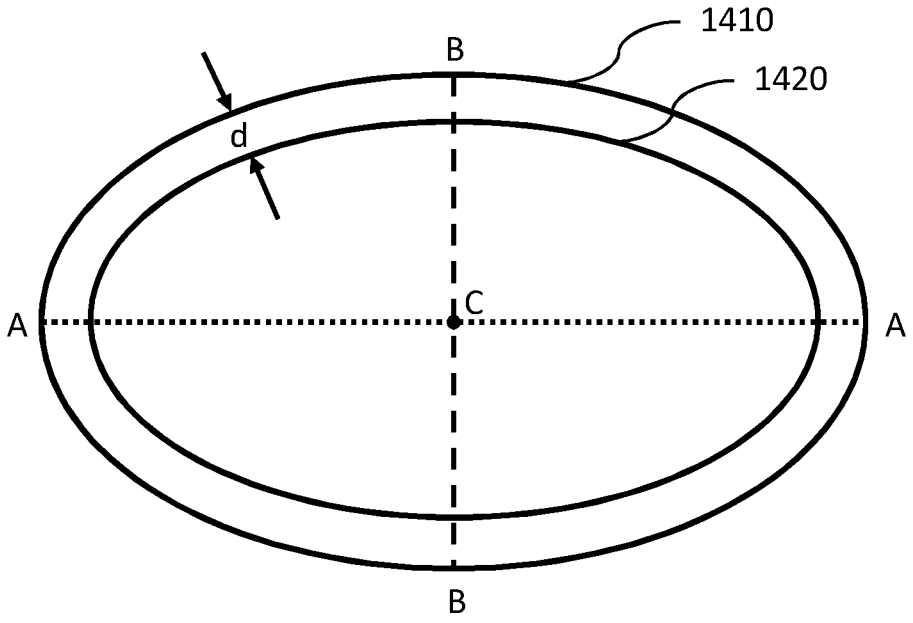
FIG. 14 is a schematic illustrating the geometry of an elliptical rotor and a second smaller rotor having the same center of mass as the elliptical rotor.

FIG. 14 is a schematic illustrating the geometry of an elliptical rotor 1410 and second smaller rotor 1420 having the same center of mass C as the elliptical rotor. Elliptical rotor 1410 has a cross-section with an elliptical outline having major axis AA and minor axis BB. Rotor 1420 has a cross-section with an outline that is inwardly offset at each point around the outline of elliptical rotor 1410 by a fixed distance d measured perpendicular to a tangent to the outline of elliptical rotor 1410 at that point. The resulting outline of rotor 1420 is not an ellipse. For the purposes of the present description, rotor 1420 is called a near-elliptical rotor.

Figure 15A:
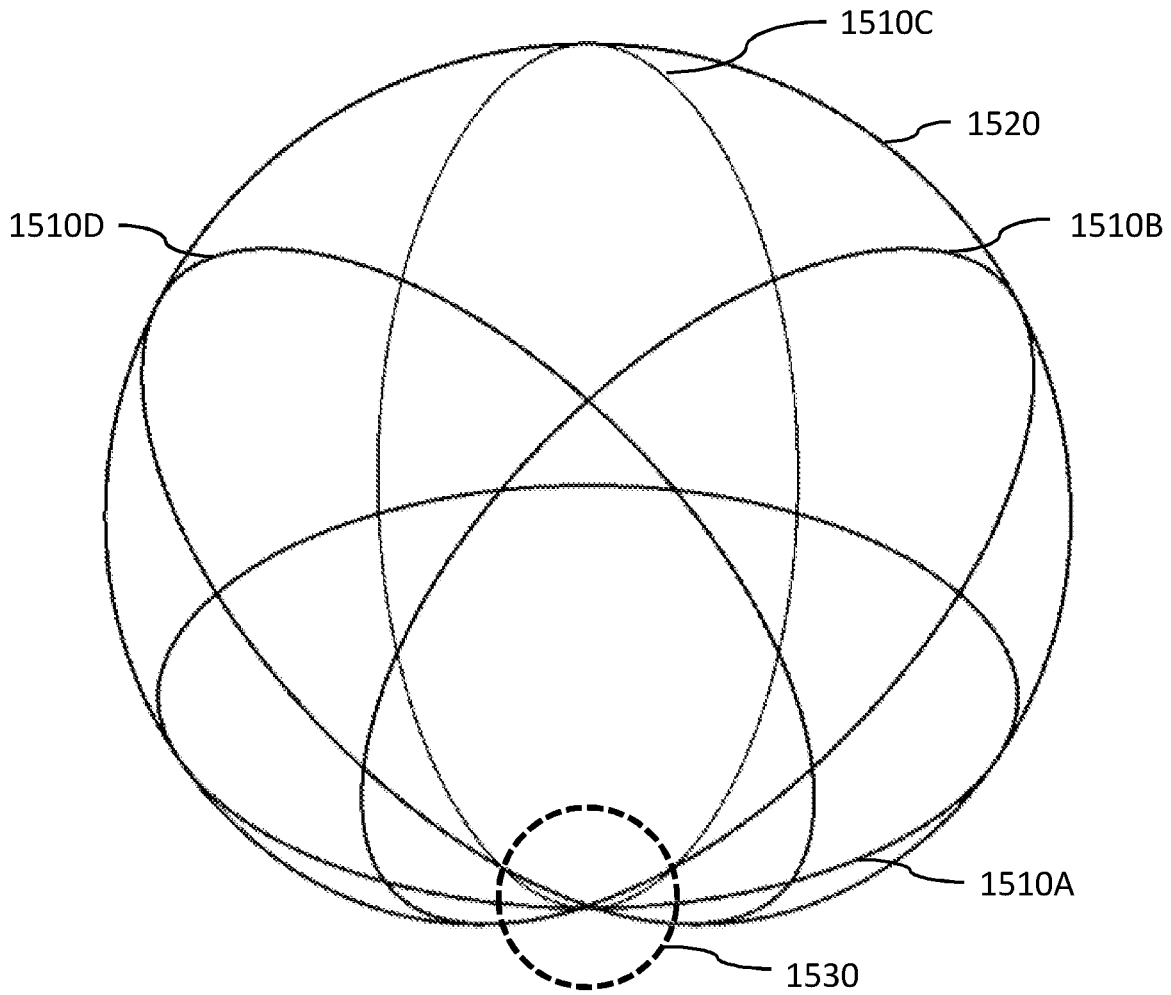
FIG. 15A is a schematic illustrating the profile generated by a near-elliptical rotor assembly in cross-section as it undergoes eccentric rotation as described herein.

FIG. 15A is a schematic illustrating the profile generated by a near-elliptical rotor assembly in cross-section as it undergoes rotolliptic motion as described above. Profiles 1510A-1510D show the orientation of near-elliptical rotor 1420 of FIG. 14 as it rotates when a crankshaft (not shown) is rotated to provide eccentric rotation of rotor 1420. The outer envelope of profiles 1510A-1510D, and all intervening profiles that could be generated by rotation of near-elliptical rotor 1420, describes the shape 1520 of the inner surface of a housing in which near-elliptical rotor 1420 can be situated.

Shape 1520 encloses near-elliptical rotor 1420 for all angles of rotation. The instantaneous velocity vector at a given point on the outline of the cross-section of near-elliptical rotor 1420 lies perpendicular to a line joining the given point to the instantaneous center of rotation. For a given profile (such as 1510A-1510D and all intervening profiles that could be generated by rotation of near-elliptical rotor 1420), there exists a set of points lying on the profile at which the instantaneous velocity vector is tangential to the profile. The locus of all such sets of points for all profiles describes shape 1520.

Figure 15B:
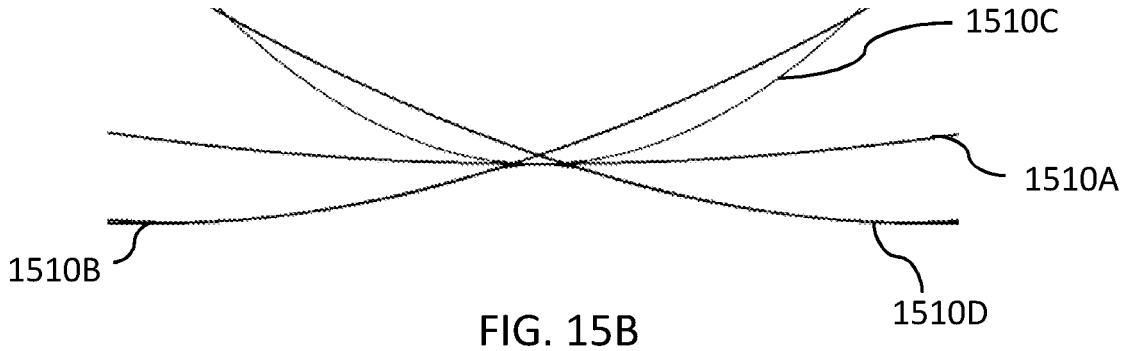
FIG. 15B is a schematic showing the inverse apex region in a close-up view.

FIG. 15B is a schematic showing the base of shape 1520 in a close-up view. Profiles 1510A-1510D show the motion of rotor 1420 at the base of shape 1520 as rotor 1420 undergoes rotolliptic motion as described above. The region at the base of shape 1520 is known as an inverse apex region. Unlike shape 420 of FIG. 4 (or equivalently inner surface 525 of FIG. 5), shape 1520 does not have a discontinuity in the inverse apex region. Instead, the inverse apex region is a smooth transition between the left- and right-hand sides of shape 1520.

Figure 16A:
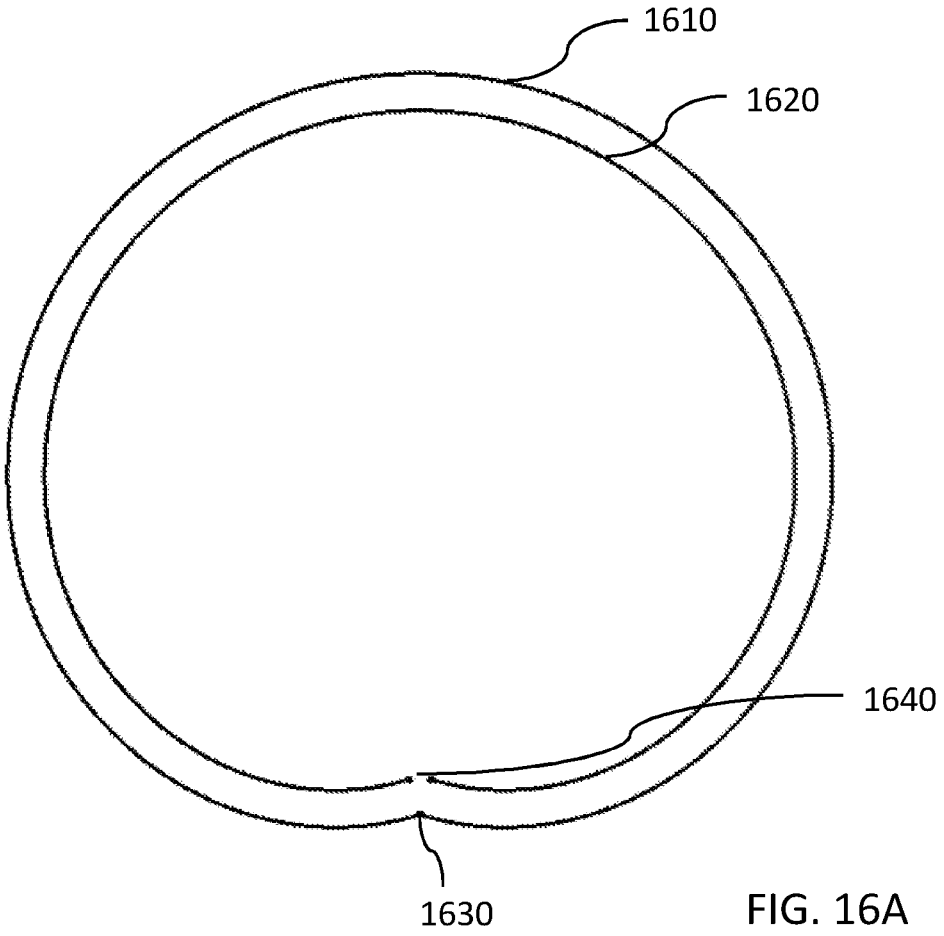
FIGS. 16A and 16B are schematics illustrating the difference in the inverse apex for an elliptical rotor and the inverse apex region for a second smaller rotor constructed as described herein.
Figure 16B:
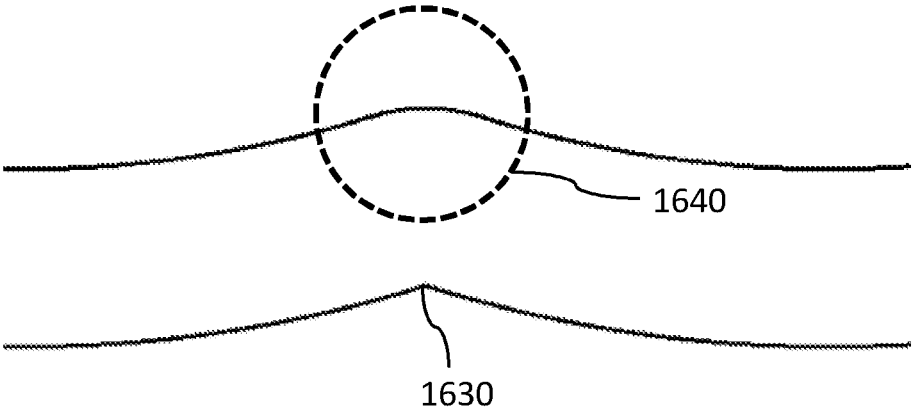

FIGS. 16A and 16B are schematics illustrating the difference in the inverse apex for an elliptical rotor (such as 510 of FIG. 5) and the inverse apex region for a second smaller rotor constructed as described above (such as 1420 of FIG. 14).

FIG. 16A shows shape 1610 generated in the same way as shape 420 of FIG. 4. Shape 1610 comprises inverse apex 1630. FIG. 16A also shows shape 1620 generated in the same way as shape 1520 of FIG. 15A. Shape 1620 comprises inverse apex region 1640.

FIG. 16B shows a close-up of the inverse apex region 1640. All points in inverse apex region 1640 are equidistant from inverse apex 1630 and lie on an arc of a circle. The arc provides continuity between the left and right hands of shape 1610 of FIG. 16A.

Referring again to FIGS. 15A and 15B, shape 1520 has three places of contact with near-elliptical rotor 1420 at the various angles of rotation, namely, for profiles 1510A-1510D and the various intervening profiles that could be generated by rotation of near-elliptical rotor 1420, with the exception of when the long dimension of rotor 1420 is oriented vertically in which case shape 1520 has just two points of contact with rotor 1420. Rotor 1420 remains in contact with a point belonging to inverse apex region 1640 of FIG. 16B. Thus, rotor 1420 is in contact with a fixed point or localized region on an interior surface of a housing, throughout rotation of rotor 1420, where the interior surface of the housing has shape 1520.

As shown in FIG. 15A, the places of contact of profiles 1510A-1510D with shape 1520 do not necessarily coincide with the ends of the long and short dimensions of the profiles.

The smooth transition in inverse apex region 1640 of FIG. 16B has benefits for operation of a rotary machine based on the principles described here. The smooth inverse apex region allows for smooth rolling motion of non-elliptical rotor 1420 of FIG. 14. There is no discontinuity or sharp edge in the surface either to scrape rotor 1420 or to cause it to get caught. Sealing between rotor 1420 and a housing having shape 1520 is easier, and is more effective at reducing the amount of fluid escaping from a first chamber to a second chamber in the inverse apex region.

Furthermore, when the contact of rotor 1420 of FIG. 14 with the housing at inverse apex region 1640 of FIG. 16B is no longer at a single point, the width of a dynamic apex seal (such as a dynamically-sprung apex seal) can be adjusted to suitable widths. Alternatively, the seal can be omitted.

Additionally, the configuration of the rotary machine having a wide dynamic apex seal with suitable geometry of a near-elliptical rotor and corresponding housing can provide an inherent pressure relief mechanism. This can be achieved by configuring the inverse apex region of the housing to move in response to sufficiently high pressure.

More generally, and referring again to FIGS. 14 and 15A, it is possible to use various shapes of inverse apex region 1530 that permit contact of rotor 1420 with inverse apex region 1530 during eccentric rotation of rotor 1420 as described above. Examples of such shapes include, but are not limited to, an arc of a circle (as described above), a portion of a parabolic curve, a portion of a polynomial of degree higher than two, and a portion of a sinusoidal curve. One factor determining the shape is the magnitude of the offset of the second smaller rotor from the elliptical rotor. In some embodiments, the near-elliptical rotor is symmetric about its long dimension and also about its short dimension.

When the difference between the long dimension of the rotor and the short dimension of the rotor is equal to four times the crank radius, and the rotor is in the vertical position, the point of contact with the inverse apex region is in the same location regardless of the shape of the inverse apex region.

For an elliptical rotor, the inverse apex region shape comprises two convex parts that meet at the inverse apex. A housing with this shape does not interfere with motion of the rotor during eccentric rotation of the rotor as described above.

For a near-elliptical rotor described above, the inverse apex region shape is concave and the housing in the inverse apex region does not interfere with motion of the rotor during eccentric rotation of the rotor as described above.

In a preferred embodiment, the rotor is configured to be symmetric about its long dimension and its short dimension. Similarly, in a preferred embodiment, the housing is configured to be symmetric about an axis drawn vertically through the center of the inverse apex region.

Rotolliptic motion can be applied to geometries other than those having symmetric rotors. Rotary machines similar to those described above can comprise a rotor having an asymmetric shape in cross-section. An example of such an embodiment having asymmetry about the long and short axes of the rotor is described below.

Figure 17A:
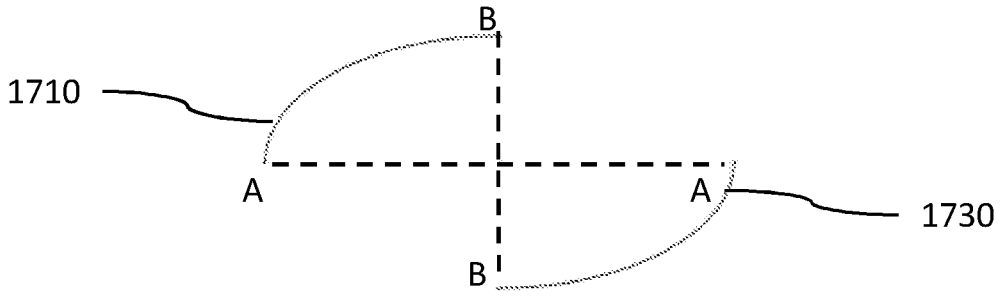
FIGS. 17A-17B are schematics illustrating the construction of an asymmetric rotor cross-sectional outline that is a combination of elliptical and near-elliptical arcs.
Figure 17B:
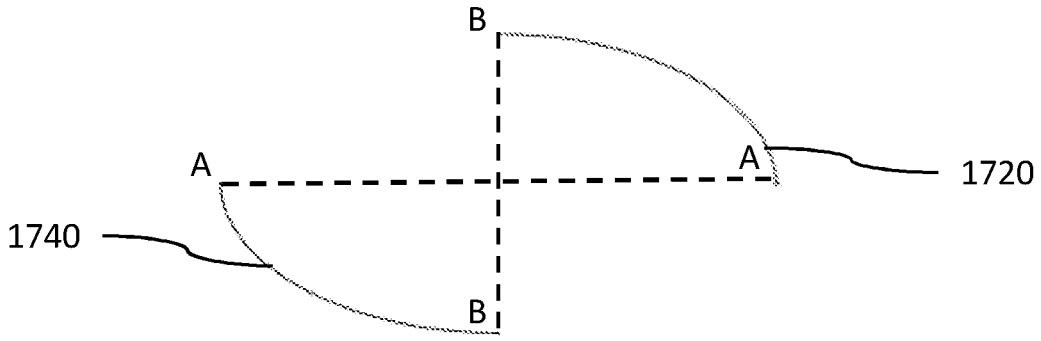

FIGS. 17A-17B are schematics illustrating the construction of a rotor 1700 with an asymmetric cross-sectional outline that is a combination of elliptical and near-elliptical arcs.

For the purposes of the following explanation, outline of rotor 1700 is divided into four substantially equal quadrants 1710, 1720, 1730 and 1740. FIG. 17A shows two quadrants 1710 and 1730 of an ellipse with major axis AA and minor axis BB. FIG. 17B shows two quadrants 1720 and 1740 of a near-elliptical outline constructed by inwardly offsetting each point around an elliptical outline with major axis AA+distance 2d and minor axis BB+distance 2d by a fixed distance d measured perpendicular to a tangent to the elliptical outline at that point.

Figure 17C:
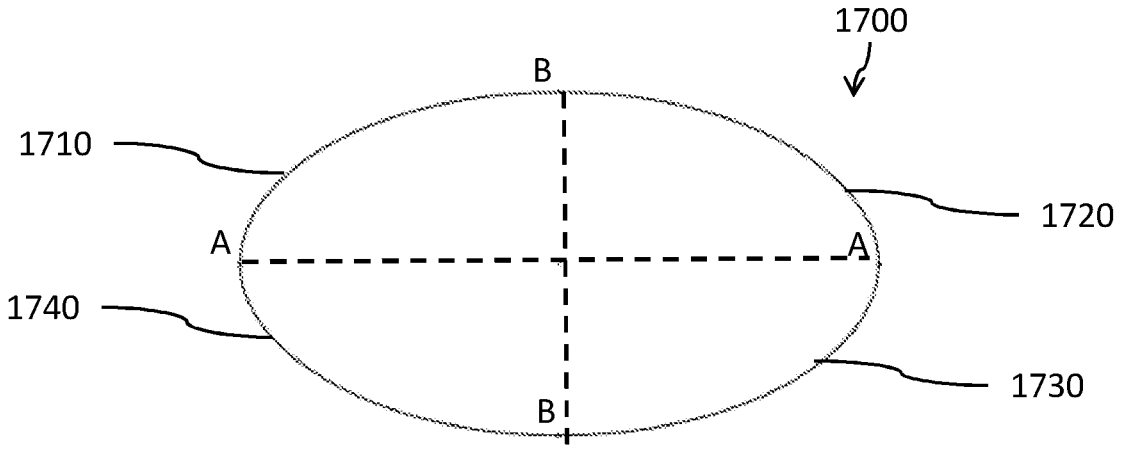
FIG. 17C shows the combination of the four quadrants denoted in FIG. 17A and FIG. 17B to form a complete outline that is a combination of elliptical and near-elliptical outlines.

FIG. 17C shows the combination of four quadrants 1710, 1720, 1730 and 1740 to form a complete outline that is a combination of elliptical and near-elliptical outlines. The resulting rotor 1700 is asymmetric about axis AA and about axis BB.

Figure 18A:
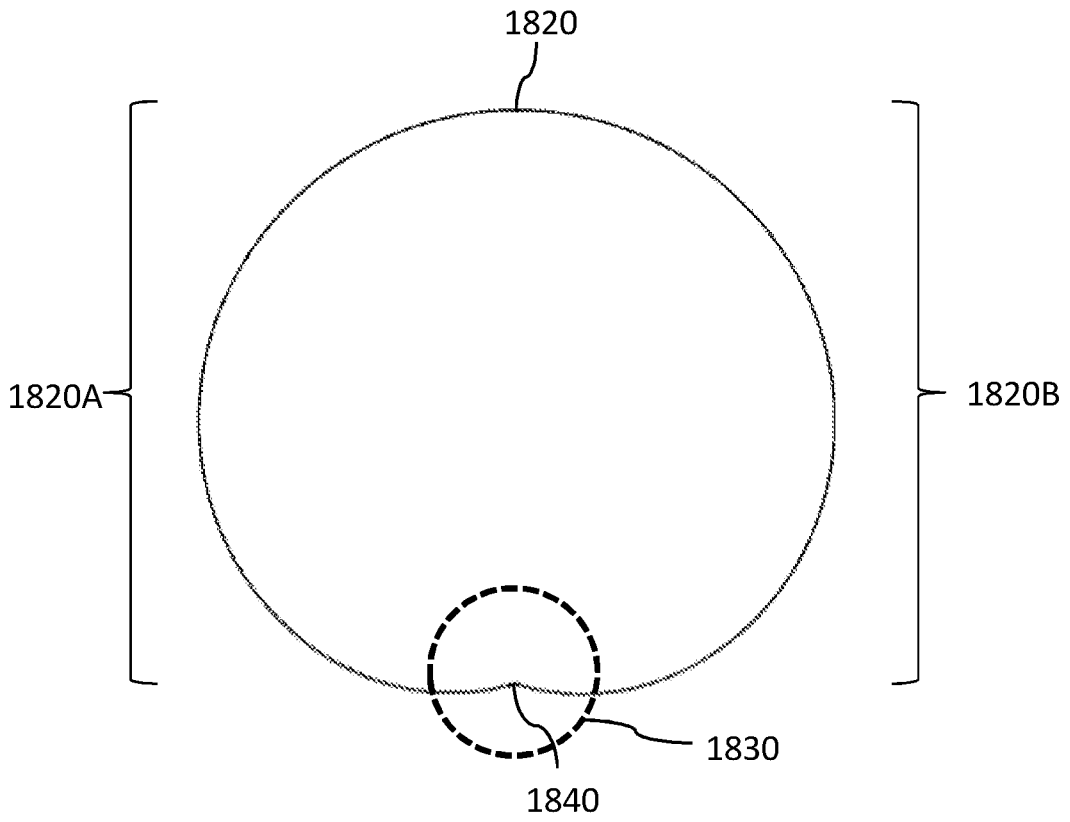
FIGS. 18A and 18B are schematics illustrating the housing shape corresponding to the asymmetric rotor of FIG. 17C.
Figure 18B:
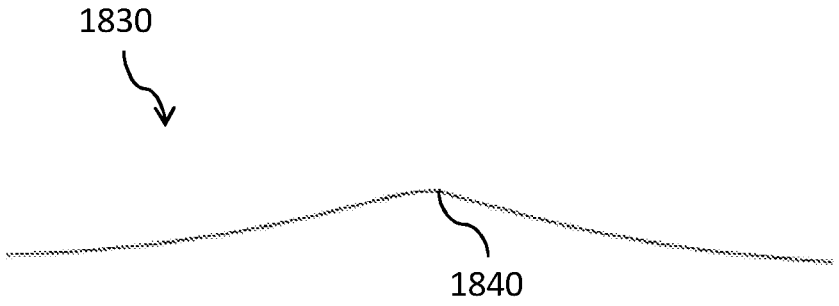

FIGS. 18A and 18B are schematics illustrating the housing shape corresponding to asymmetric rotor 1700 of FIG. 17C. Housing shape 1820 comprises two halves 1820A and 1820B. Housing shape 1820 further comprises an inverse apex region 1830 and an inverse apex 1840.

Figure 19A:
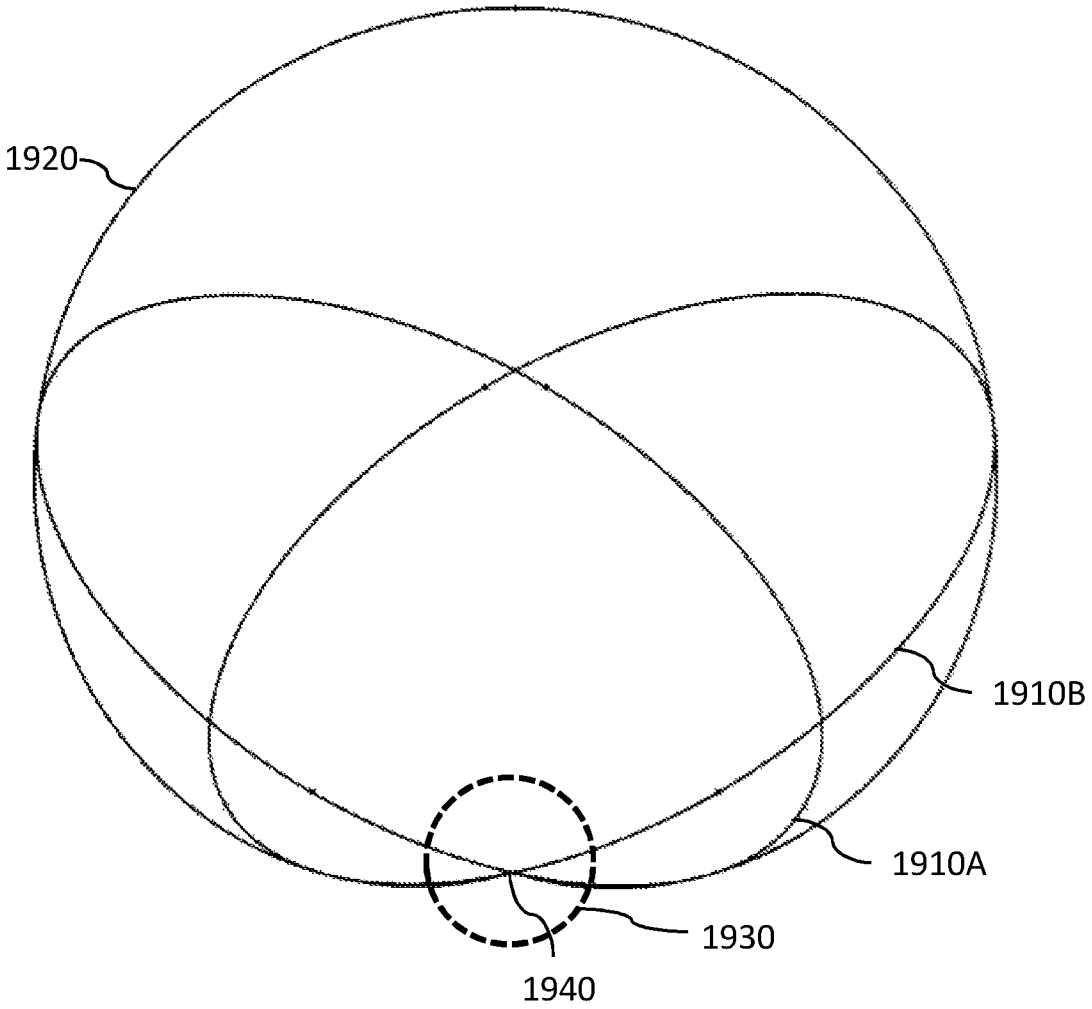
FIG. 19A is a schematic illustrating the shape described by an asymmetric rotor assembly in cross-section as it undergoes rotolliptic motion.

FIG. 19A is another schematic illustrating shape 1920 described by asymmetric rotor 1700 of FIG. 17C as it undergoes rotolliptic motion. Rotor profiles 1910A and 1910B show the orientation of asymmetric rotor 1700 of FIG. 17C as it rotates when a crankshaft (not shown) is rotated to provide eccentric rotation of rotor 1700. The outer envelope of profiles 1910A and 1910B, and other profiles that could be generated by rotation of asymmetric rotor 1700, describes a housing shape 1920 of the inner surface of a housing in which asymmetric rotor 1700 can be situated.

Housing shape 1920 encloses asymmetric rotor 1700 for the various angles of rotation. The instantaneous velocity vector at a given point on the outline of the cross-section of asymmetric rotor 1700 lies perpendicular to a line joining the given point to the instantaneous center of rotation. For a given profile (such as 1910A and 1910B and other profiles that could be generated by rotation of asymmetric rotor 1700), there is a set of points lying on the profile at which the instantaneous velocity vector is tangential to the profile. The locus of such sets of points for the profiles describes housing shape 1920.

Housing shape 1920 further comprises an inverse apex region 1930 and an inverse apex 1940.

Figure 19B:
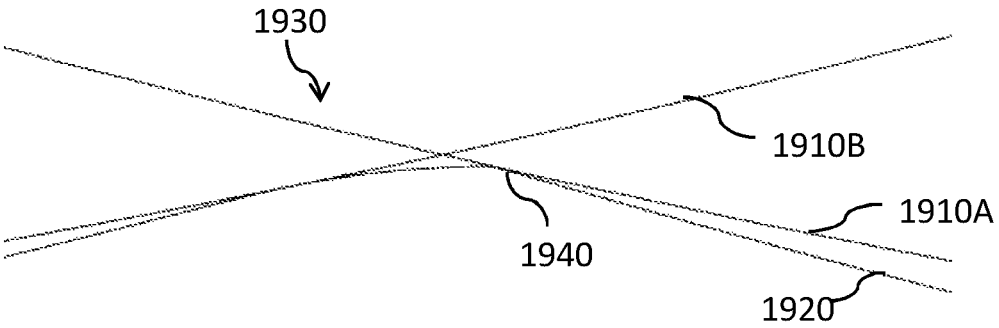
FIG. 19B is a schematic showing the inverse apex region of FIG. 19A in a close-up view.

FIG. 19B is a schematic showing inverse apex region 1930 of FIG. 19A in a close-up view. Inverse apex region 1930 of housing shape 1920 comprises inverse apex 1940. Profiles 1910A and 1910B contact housing shape 1920 in inverse apex region 1930, at or near inverse apex 1940.

Figure 20A:
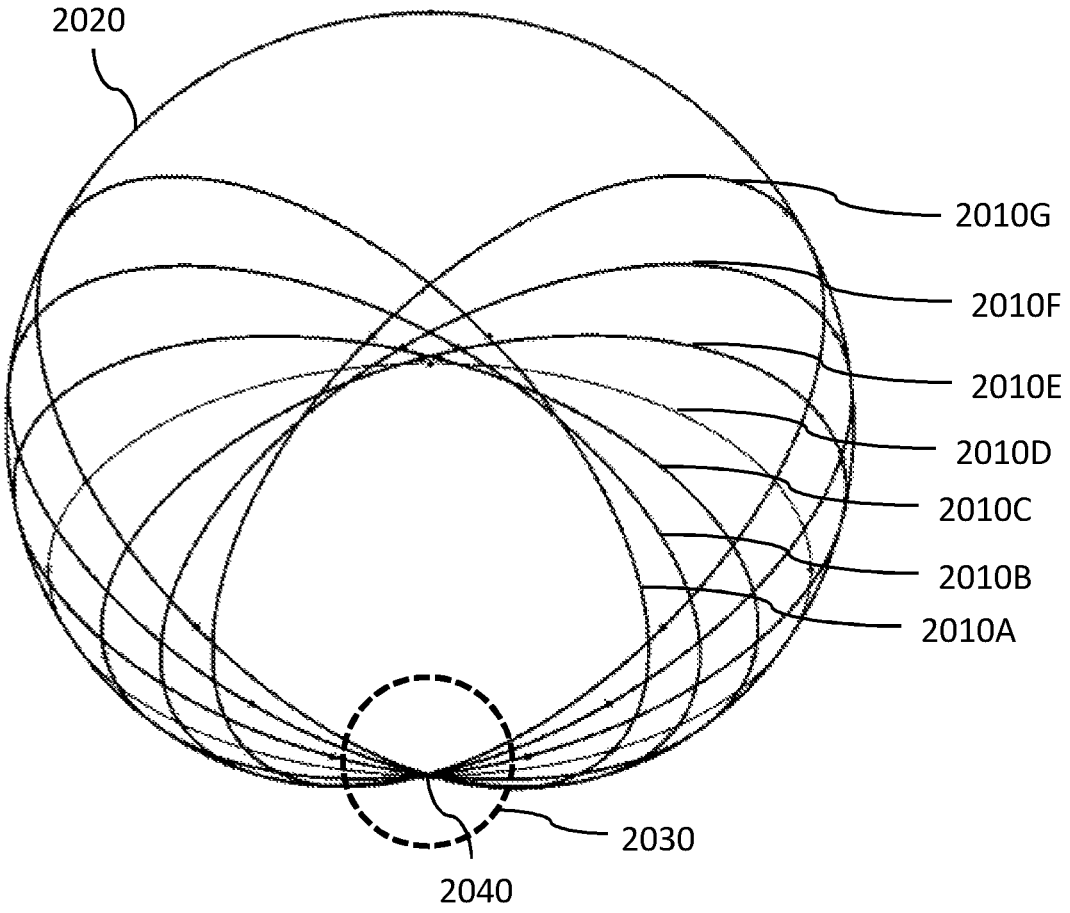
FIG. 20A is a schematic illustrating the shape described by an asymmetric rotor assembly in cross-section as it undergoes rotolliptic motion.

FIG. 20A is another schematic illustrating shape 2020 described by an asymmetric rotor 1700 of FIG. 17C as it undergoes rotolliptic motion. FIG. 20A is similar to FIG. 19A and shows seven rotor profiles 2010A-2010G (rather than the only two rotor profiles of FIG. 19A) describing a housing shape 2020 of the inner surface of a housing in which asymmetric rotor 1700 can be situated.

Housing shape 2020 further comprises an inverse apex region 2030 and an inverse apex 2040.

Figure 20B:
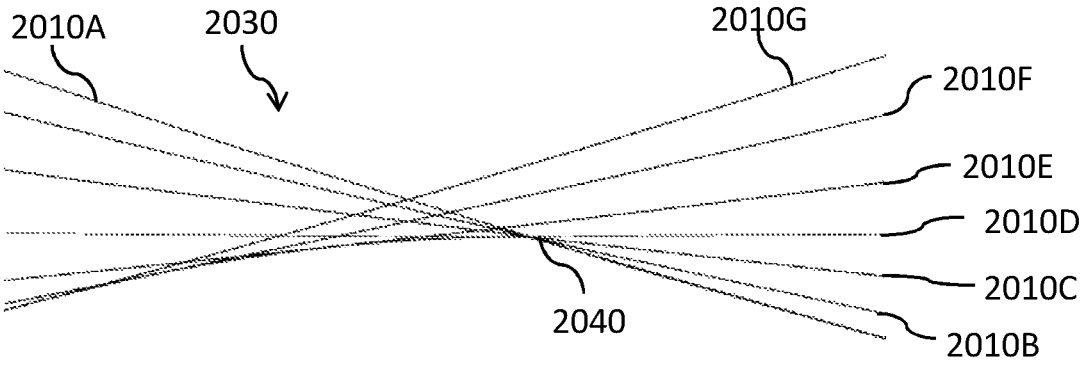
FIG. 20B is a schematic showing the inverse apex region of FIG. 20A in a close-up view.

FIG. 20B is a schematic showing inverse apex region 2030 of FIG. 20A in a close-up view. Inverse apex region 2030 of housing shape 2020 comprises inverse apex 2040. Profiles 2010A-2010G contact housing shape 2020 in inverse apex region 2030, at or near inverse apex 2040.

In some embodiments of the technology described above, the output of the rotary machine tends to vary (or pulsate) during each cycle of operation according to the rate of change of volume of the discharging chamber.

Figure 21A:
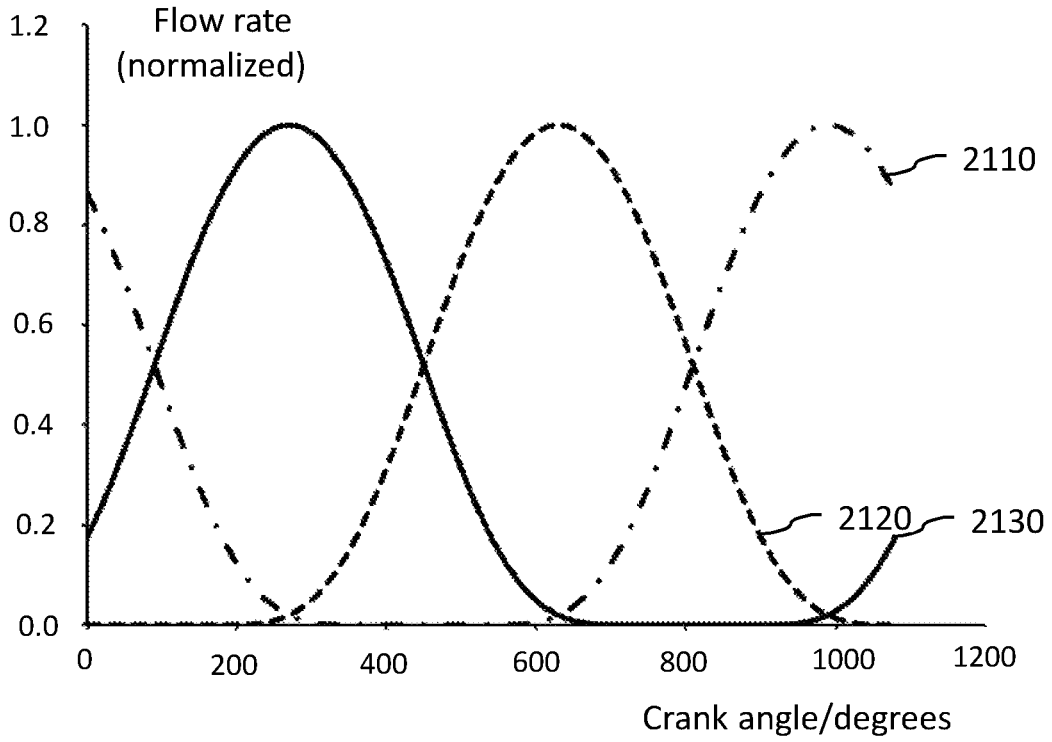
FIG. 21A is a graph illustrating the change in volume of each of three chambers in a rotary machine as the rotor undergoes eccentric motion the housing.

As an example, FIG. 21A is a graph illustrating the change in volume of each of the three chambers 550, 552 and 554 in rotary machine 500 of FIG. 5 as rotor 510 undergoes eccentric motion in housing 520. FIG. 21A shows the normalized change in volume of each of the three chambers. The maximum volume achieved by each of the three chambers is normalized to 1.0. A similar change in volume for each of three chambers would be observed in rotary machine 800 of FIG. 8. Line 2110 illustrates the variation in volume of a first chamber (Chamber 1) as rotor 510 of FIG. 5 undergoes eccentric rotation in housing 520. Line 2120 illustrates the variation in volume of a second chamber (Chamber 2) as rotor 510 of FIG. 5 undergoes eccentric rotation in housing 520. Line 2130 illustrates the variation in volume of a third chamber (Chamber 3) as rotor 510 of FIG. 5 undergoes eccentric rotation in housing 520.

Note that when rotor 510 is in a vertical position, it contacts housing 520 at only two places—at inverse apex 540 and at a point on housing 520 directly above inverse apex 540. In this position, rotor 510 divides the interior of housing 520 into just two chambers of substantially equal size, and the volume of the third chamber is zero.

Lines 2110, 2120 and 2130 of FIG. 21A define an essentially identical relationship between normalized volume of each of the three chambers and angle of rotation of the rotor. Lines 2110, 2120 and 2130 are out of phase with one another by essentially 360 degrees of rotation of the crankshaft. Each of lines 2110, 2120 and 2130 is periodic with a period of 1080 degrees of rotation of the crankshaft.

Figure 21B:
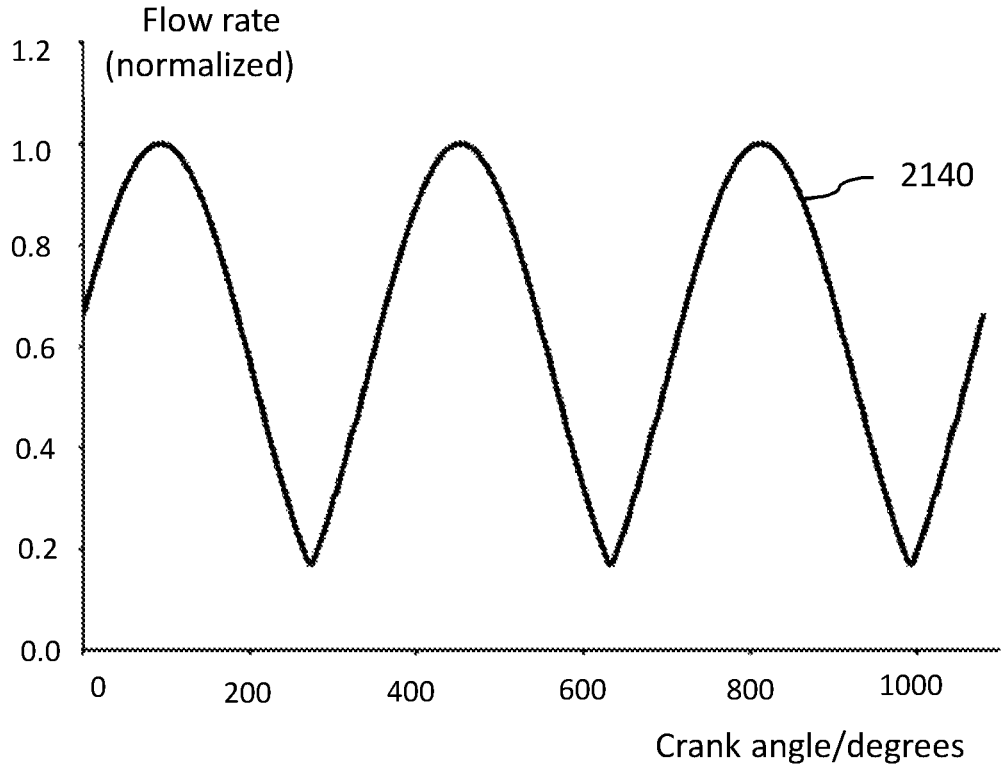
FIG. 21B is a graph illustrating the net output flow rate for a rotary machine with a single rotor.

FIG. 21B is a graph illustrating the net output flow rate for a rotary machine with a single rotor (such as rotary machine 500 of FIG. 5). FIG. 21B illustrates how the net output flow rate varies with rotation of the crankshaft. Line 2140 is the net output flow rate as a function of crank angle. In some embodiments, the net output flow rate can be periodic (with a period of one completion rotation of the crankshaft) and can vary by approximately 83% of the maximum flow.

Uneven output of the rotary machine can be undesirable in at least some applications. It can be beneficial in some applications to reduce or eliminate output flow variation.

Benefits of reducing output flow rate variation include reduced stress on the rotary machine—leading to improved function and durability.

One approach to reduce output flow rate variation is to configure the rotary machine with more than one rotor, the rotors configured to rotate out of phase with one another so as to compensate for flow variations associated with a single rotor. For example, FIG. 22 is an isometric view of an embodiment of a rotodynamic pump assembly 2200 with two elliptical rotors configured to undergo eccentric motion.

Figure 22:
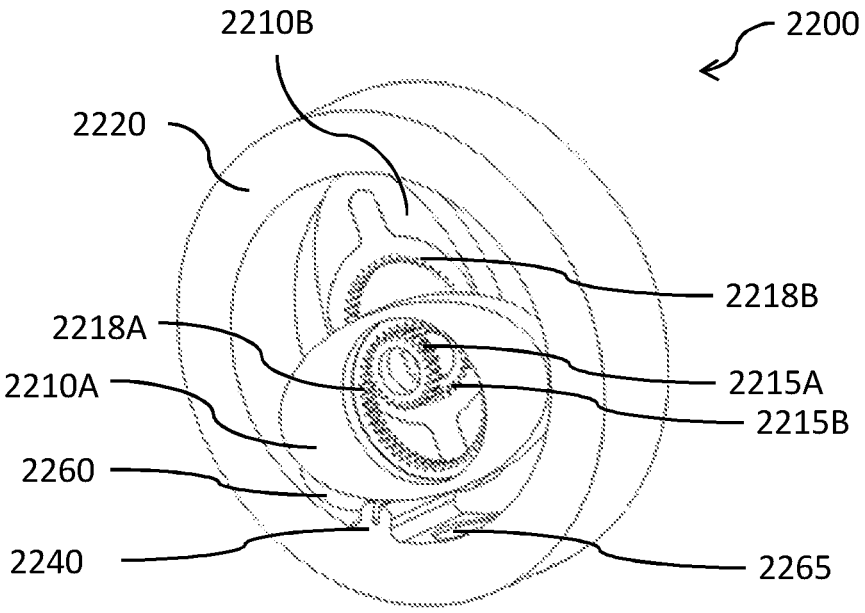
FIG. 22 is an isometric view of an embodiment of a rotodynamic pump assembly with two elliptical rotors configured to undergo eccentric motion.
Figure 23:
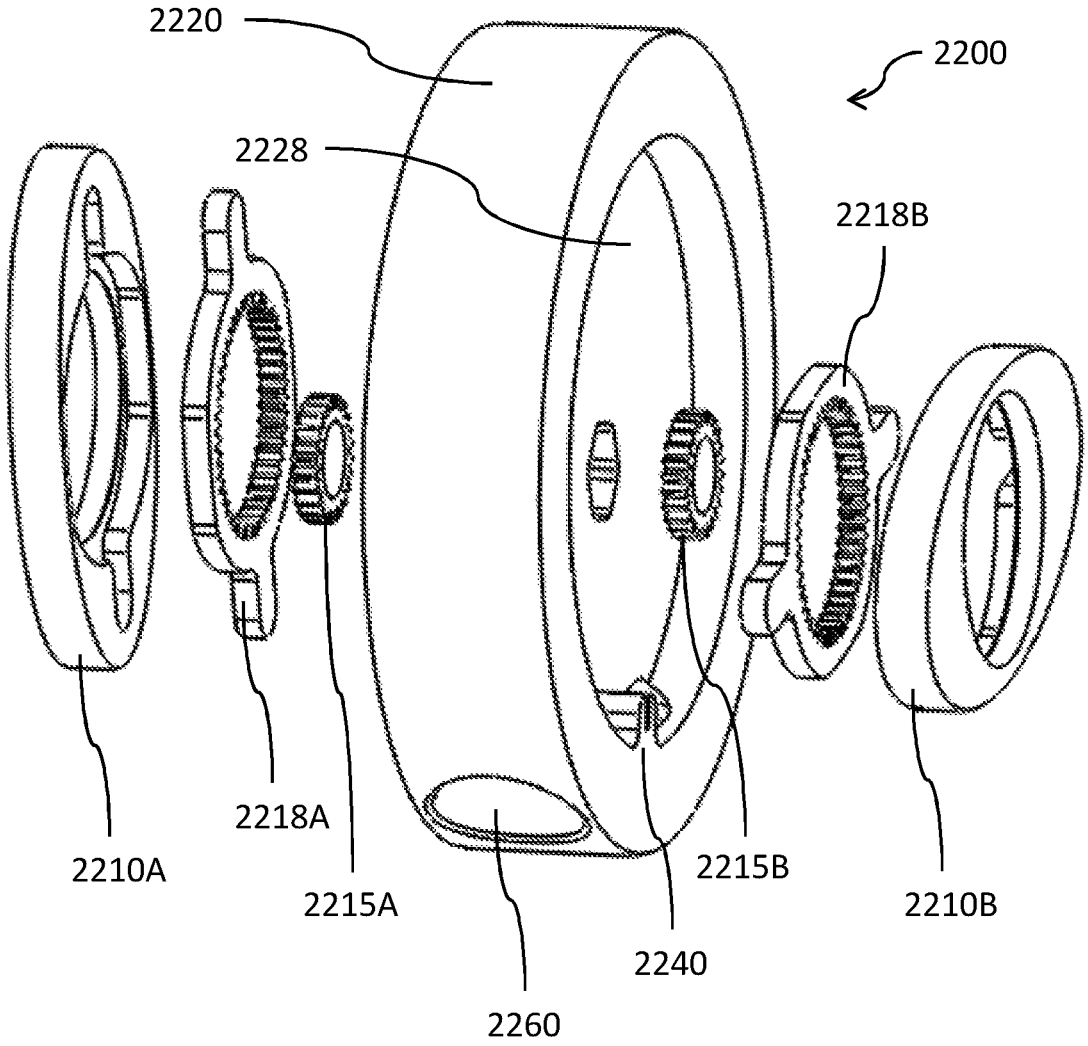
FIG. 23 is an exploded view of the rotodynamic pump assembly of FIG. 22, with two elliptical rotors configured to undergo eccentric motion.

FIG. 23 is an exploded view of rotodynamic pump assembly 2200 of FIG. 22, with two elliptical rotors 2210A and 2210B each configured to undergo eccentric motion.

With reference to FIGS. 22 and 23, pump assembly 2200 comprises a housing 2220 with two elliptical rotors 2210A and 2210B configured to undergo eccentric rotation. Pump assembly 2200 comprises a sun gear 2215A and a ring gear 2218A associated with elliptical rotor 2210A, and a sun gear 2215B and a ring gear 2218B for elliptical rotor 2210B. Housing 2220 comprises an inverse apex 2240. Elliptical rotors 2210A and 2210B are both in contact with inverse apex 2240 during their rotation.

Housing 2220 comprises an inlet 2260 and an outlet 2265. Fluid enters the pump through inlet 2260 and is expelled from the pump through outlet 2265. Rotation of elliptical rotor 2210A can be out of phase with respect to rotation of elliptical rotor 2210B. For example, rotors 2210A and 2210B can have an angular separation about the instantaneous axis of rotation of 90 degrees, and a phase angle between the mechanical couplings (not shown in FIG. 22) of 180 degrees.

Housing 2220 also comprises a center plate 2228 located between the two rotors 2210A and 2210B. For clarity, center plate 2228 is not shown in FIG. 22.

Figure 24A:
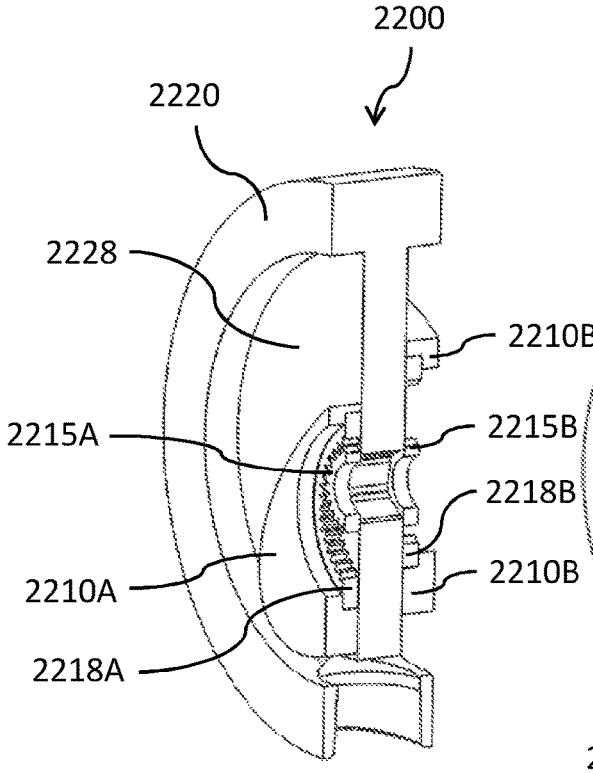
FIGS. 24A and 24B are cut-away isometric and isometric views respectively of the rotodynamic pump assembly of FIG. 22 showing the crank and gear mechanism of each elliptical rotor, as well as the housing.
Figure 24B:
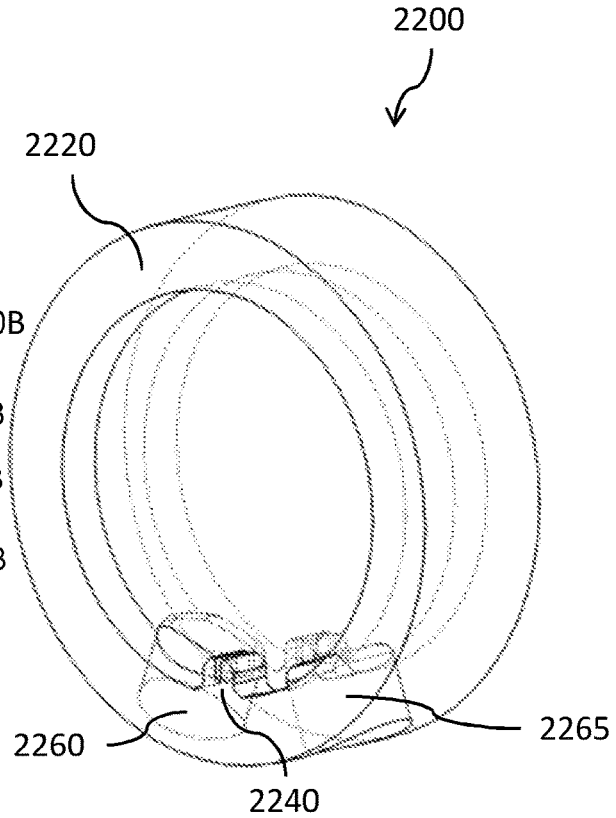

FIGS. 24A and 24B are cut-away isometric and isometric views respectively of the rotodynamic pump assembly of FIG. 22 showing the crank and gear mechanism of each elliptical rotor, and the housing. In FIG. 24A, center plate 2228 is integrated with housing 2220.

FIGS. 25A-25I are schematics illustrating the geometry of the rotodynamic pump assembly of FIG. 22 at different stages of rotation of the two elliptical rotors.

In some embodiments, more than two rotors operating out of phase with each other can be used to compensate for the output flow variation. In general, the flow variation will be reduced further by adding more rotors.

Figure 26:
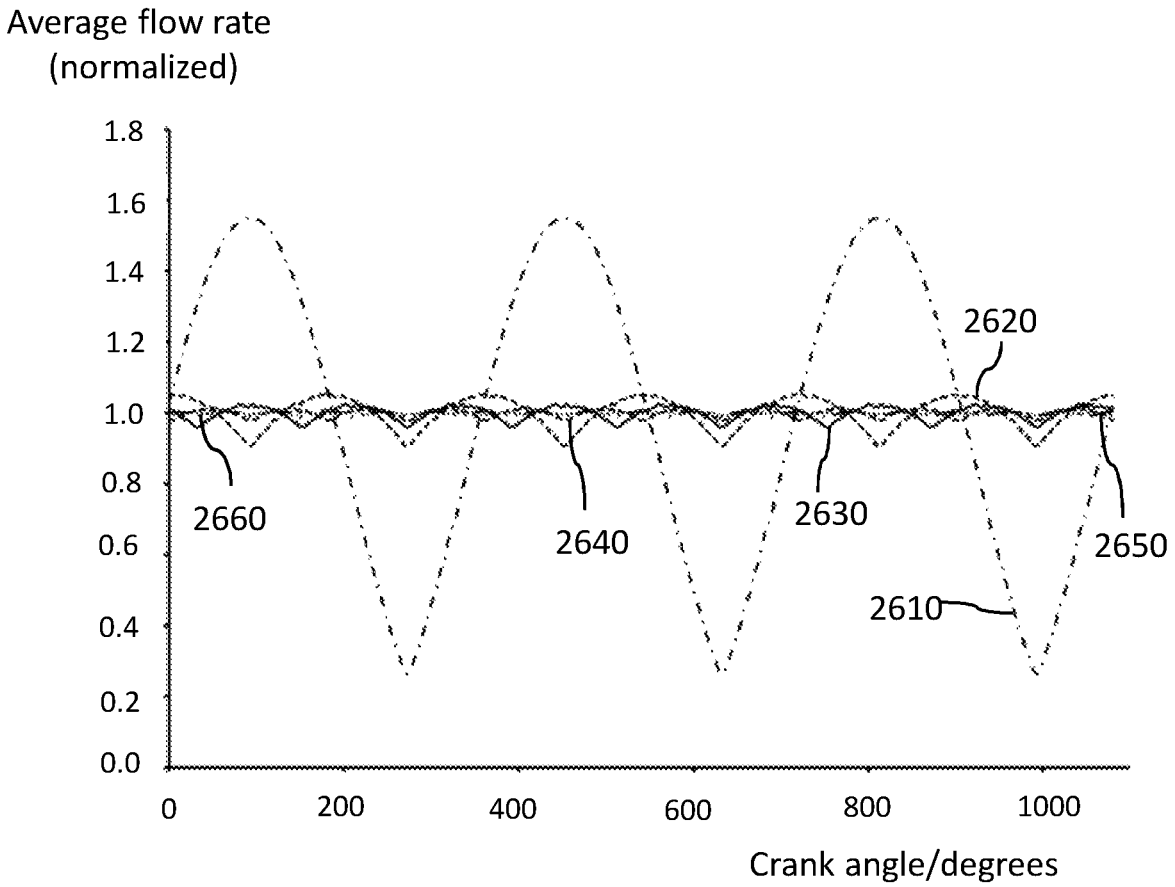
FIG. 26 is a graph illustrating the net output flow rate for a rotary machine with one or more rotors.

FIG. 26 is a graph illustrating the net output flow rate for a rotary machine with one or more rotors. FIG. 26 illustrates how the output flow rate varies with rotation of the crankshaft. In FIG. 26, for rotary machines with multiple rotors, the rotors have been configured to be out of phase with each other. The net output flow rate exhibits less variation as the number of rotors is increased. Line 2610 shows the net output flow rate for a rotary machine with a single rotor. Line 2620 shows the net output flow rate for a rotary machine with two rotors. Line 2630 shows the net output flow rate for a rotary machine with three rotors. Line 2640 shows the net output flow rate for a rotary machine with four rotors. Line 2650 shows the net output flow rate for a rotary machine with six rotors. Line 2660 shows the net output flow rate for a rotary machine with eight rotors.

Another approach to reducing or eliminating output flow rate variation is to vary the rotational speed of the shaft driving the rotary machine to compensate for the variation in the rate of change of volume of the discharging chamber.

One approach to reduce flow variation is to modify the coupling between the rotary machine and the device driving the assembly (for example, a motor and drive shaft) to vary the rotational speed of the drive shaft.

Figure 27A:
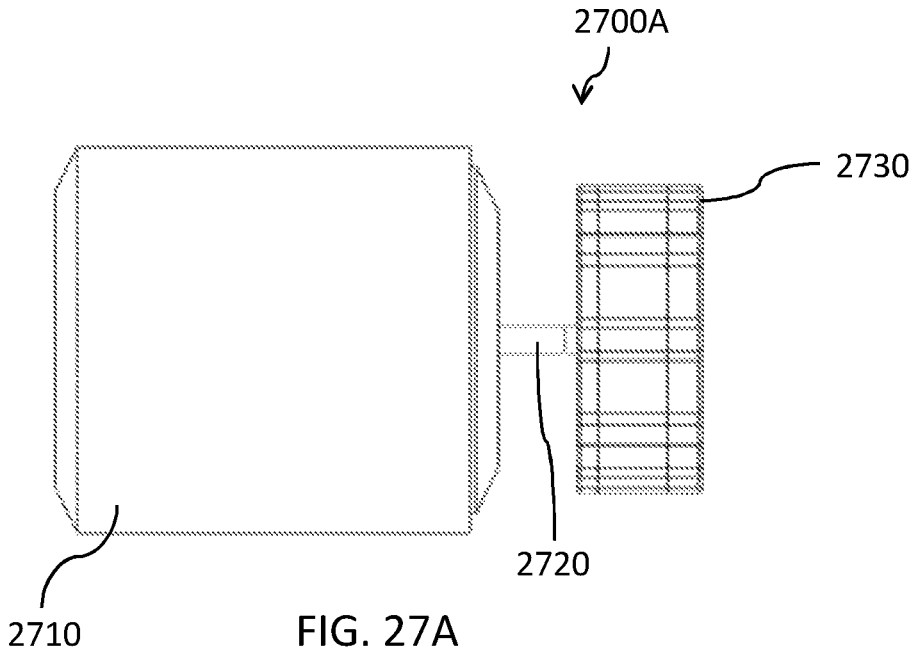
FIG. 27A is a schematic illustrating a rotary machine assembly.

FIG. 27A is a schematic illustrating rotary machine assembly 2700A. Rotary machine assembly 2700A comprises motor 2710, drive shaft 2720, and rotor and housing assembly 2730. Motor 2710 is configured to turn drive shaft 2720. In one mode of operation, motor 2710 is configured to turn drive shaft 2720 at an approximately constant rate.

If drive shaft 2720 rotates at a substantially constant rate, rotary machine assembly 2700A can have considerable net output flow rate variation, for example in accordance with the graph of FIG. 21B.

Figure 27B:
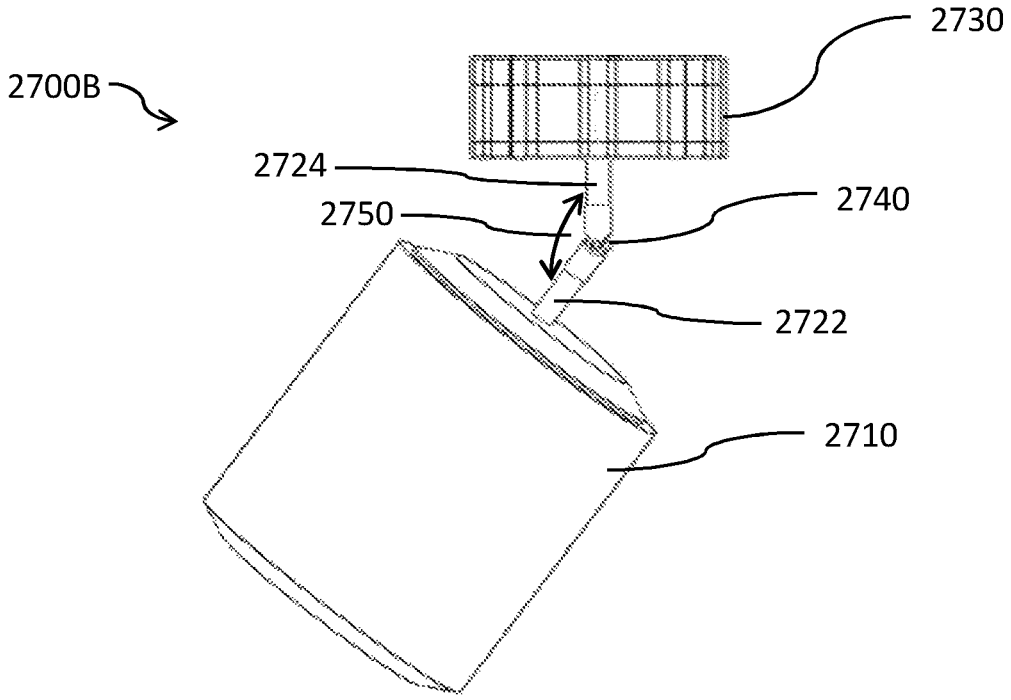
FIG. 27B is a schematic illustrating a rotary machine assembly with a universal joint (U-joint).

FIG. 27B is a schematic illustrating rotary machine assembly 2700B with a modified coupling. In the illustrated embodiment, the modified coupling comprises a universal joint (U-joint). Rotary machine assembly 2700B comprises motor 2710, drive shafts 2722 and 2724, U-joint 2740, and rotor and housing assembly 2730. In an embodiment, rotor and housing assembly 2730 comprises dual rotors 2732 and 2734 (not shown). Rotors 2732 and 2734 can be elliptical or non-elliptical as described above.

To reduce flow variation, it can be beneficial to provide a mechanism that varies the rotational rate of rotors 2732 and 2734 in rotor and housing assembly 2730 so as to at least partially compensate for the flow variation described above. U-joint 2740 acting as a coupling between drive shafts 2722 and 2724 can be used to provide a variation in rotational rate of drive shaft 2724 for an approximately constant rotational rate of drive shaft 2722. The variation in rotational rate of drive shaft 2724 depends on angle 2750 subtended by drive shaft 2722 and drive shaft 2724. (In FIG. 27B drive shafts 2722 and 2724 are drawn in the plane of the paper.)

As shown in FIG. 27B, rotary machine assembly 2700B can be configured as a pump producing reduced variation in the flow rate of fluid output relative to the variation shown in FIG. 21B. With motor 2710 turning drive shaft 2722 at an approximately constant rotational rate, angle 2750, and the phase angle between U-joint 2740 and rotors 2732 and 2734, can be adjusted to produce a reduced variation in the net output flow rate of fluid from rotor and housing assembly 2730.

Figure 28A:
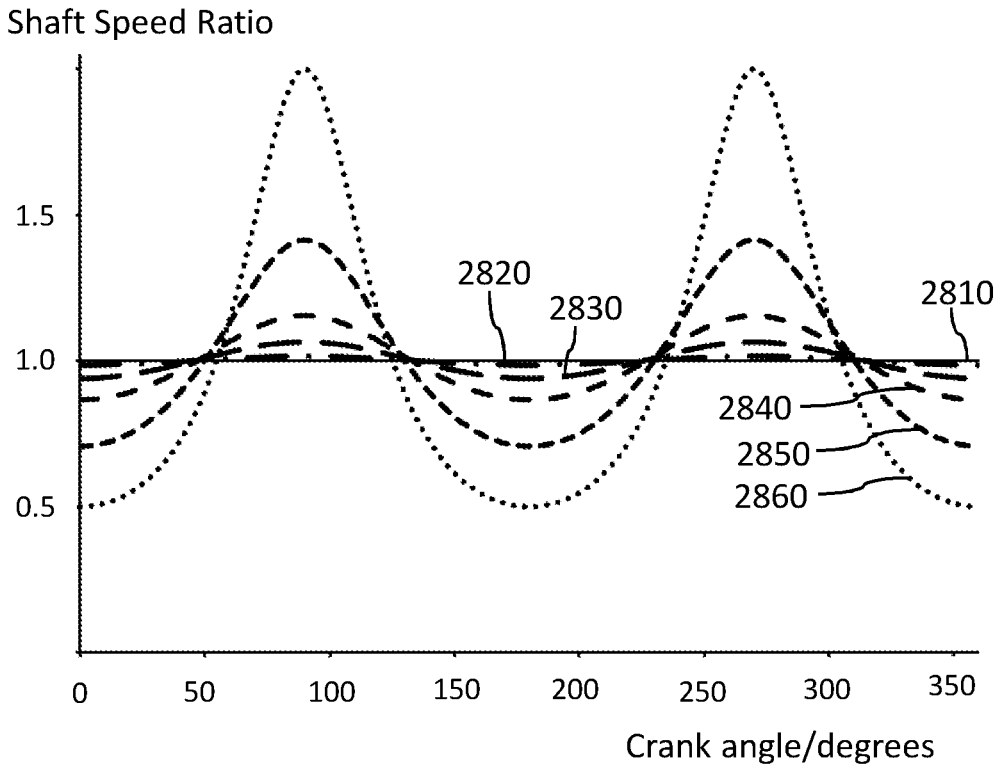
FIG. 28A is a graph illustrating the effect of a U-joint as a coupling mechanism between drive shafts.

FIG. 28A is a graph illustrating the effect of a U-joint as a coupling mechanism between drive shafts. The variation in the rotational rate of an output drive shaft for constant rotational rate of an input drive shaft is shown for different angles subtended by the drive shafts coupled by a U-joint.

Referring also again to FIG. 27B, FIG. 28A is a graph illustrating the variation in the rotational rate of drive shaft 2724 for constant rotational rate of drive shaft 2722 for different angles 2750 subtended by drive shafts 2722 and 2724. Line 2810 is the rotational rate of drive shaft when angle 2750 is zero degrees. Line 2820 is the rotational rate of drive shaft when angle 2750 is 10 degrees. Line 2830 is the rotational rate of drive shaft when angle 2750 is 20 degrees. Line 2840 is the rotational rate of drive shaft when angle 2750 is 30 degrees. Line 2850 is the rotational rate of drive shaft when angle 2750 is 45 degrees. Line 2860 is the rotational rate of drive shaft when angle 2750 is 60 degrees.

Figure 28B:
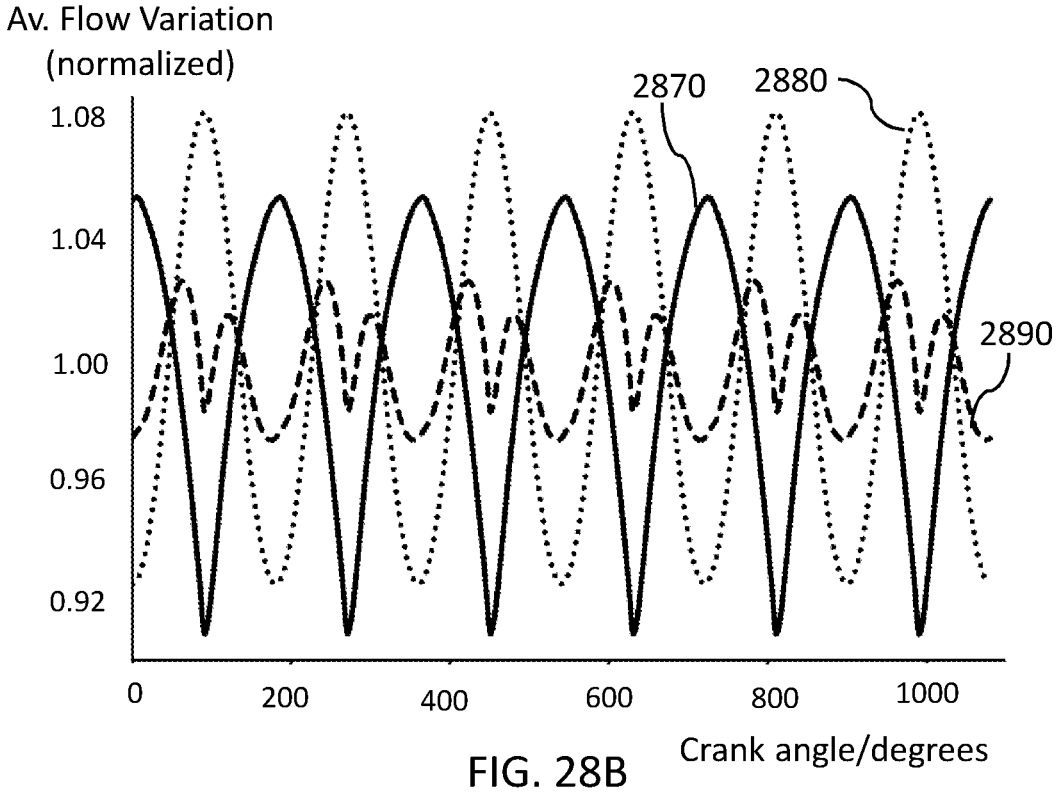
FIG. 28B is a graph illustrating the effect of combining a drive comprising a U-joint with a rotary machine comprising two rotors configured to reduce output flow variation.

Driving the crankshaft of a rotary machine comprising two rotors by a suitably configured U-joint can reduce flow variation in the output of the rotary machine. FIG. 28B is a graph illustrating the effect of combining a drive comprising a U-joint with a rotary machine comprising two rotors configured to reduce output flow variation. The values in the graph of FIG. 28B have been normalized.

Line 2870 shows the output shaft speed of a U-joint coupling for substantially constant rotational speed of the input shaft of the U-joint coupling (for example, line 2840 of FIG. 28A). Line 2880 shows the variation in output flow for a rotary machine comprising two rotors configured to be out of phase with each other. Line 2890 shows the variation in output flow for a rotary machine comprising two rotors configured to be out of phase with each other, where the crankshaft is driven by a motor coupled to the rotary machine via a U-joint configured to reduce the net variation in output flow.

Another approach to reducing output flow rate variation is to use a non-circular gearing mechanism to drive the crankshaft of a rotary machine such as rotary machine 800 of FIG. 8. Non-circular gears can be used to vary the rotational rate of a driveshaft.

Figure 29:
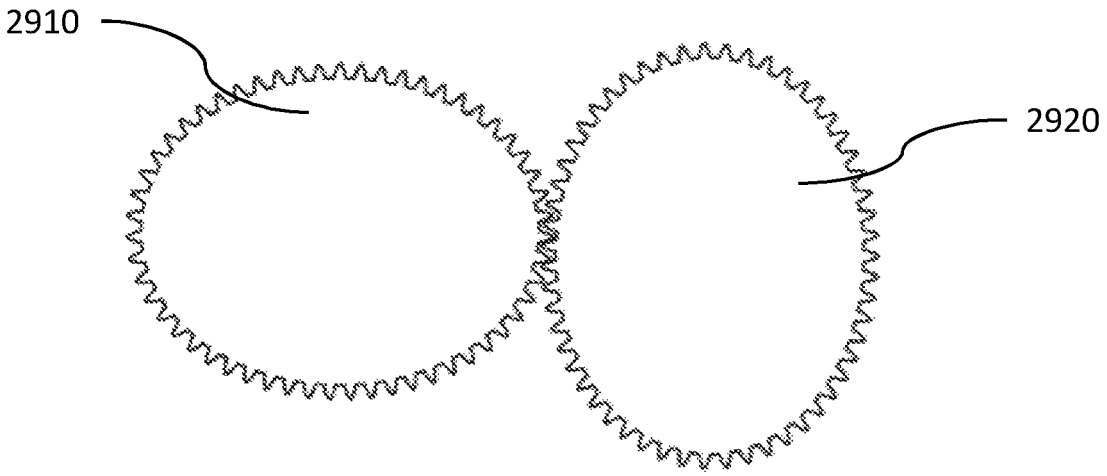
FIG. 29 is a schematic illustrating two oval gears.
Figure 30:
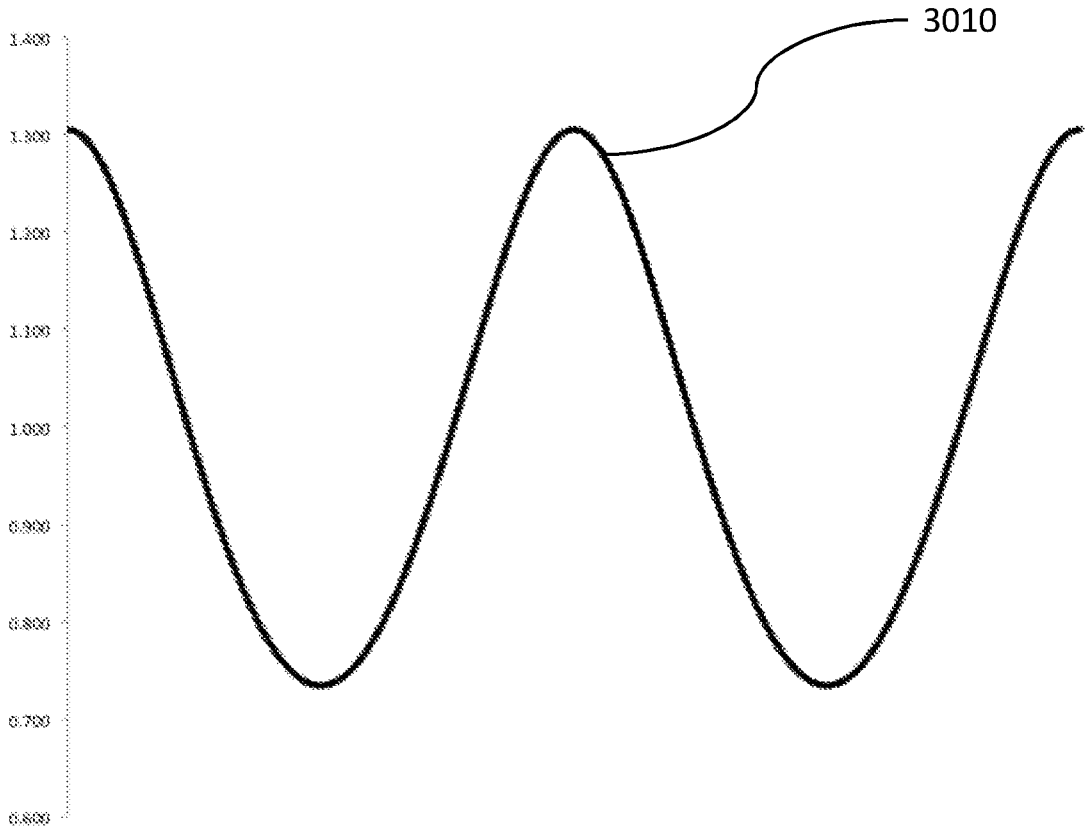
FIG. 30 is a graph illustrating the variation of shaft speed for oval gears.

FIG. 29 is a schematic illustrating an example embodiment of two non-circular gears, in this case two oval gears 2910 and 2920. Oval gears can provide an essentially sinusoidal shaft speed variation. FIG. 30 is a graph illustrating the variation of shaft speed for oval gears such as those illustrated in FIG. 29. Line 3010 shows an essentially sinusoidal shaft speed.

When coupled with a rotary machine comprising one or more rotors, a crankshaft driven by suitably configured oval gears can reduce flow variation in the output of the rotary machine. Furthermore, identical non-circular gears (oval or otherwise) provide a constant axis of rotation.

More generally, a rotary machine comprising one or more rotors can be driven by a crankshaft connected to a transmission comprising non-circular gears configured to modify the output flow variation of the rotary machine. Gear shapes can be chosen and the gearing configured for the rotary machine such that the output flow variation of the rotary machine can be reduced or eliminated.

In addition to the mechanisms described above, the output flow rate variation of the machine can be modified by other suitable mechanisms including, but not limited to, a drive with a variable and electronically controlled rotational speed, or other suitable variable speed transmission.

Figure 31A:
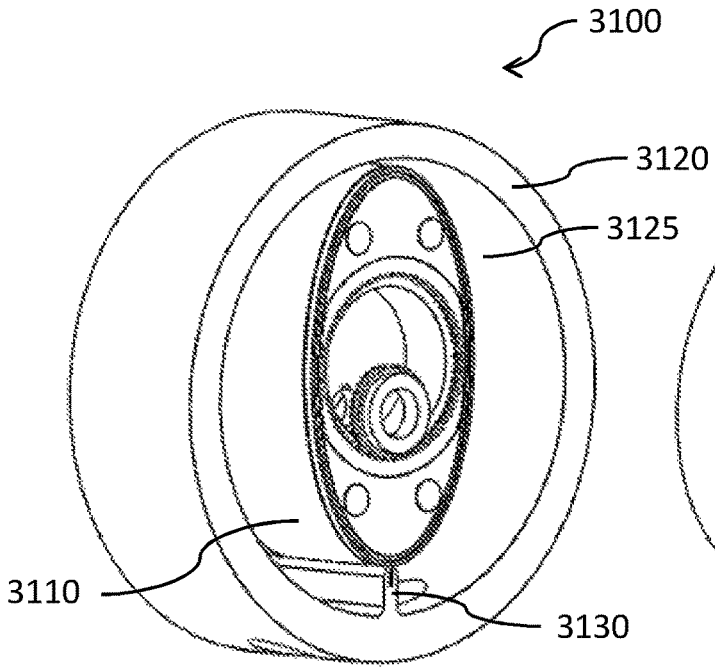
FIGS. 31A-31C are schematics illustrating an embodiment of a rotodynamic pump, a lining for the inner surface of the housing, and a rotodynamic pump comprising a lining for the inner surface of the housing.
Figure 31B:
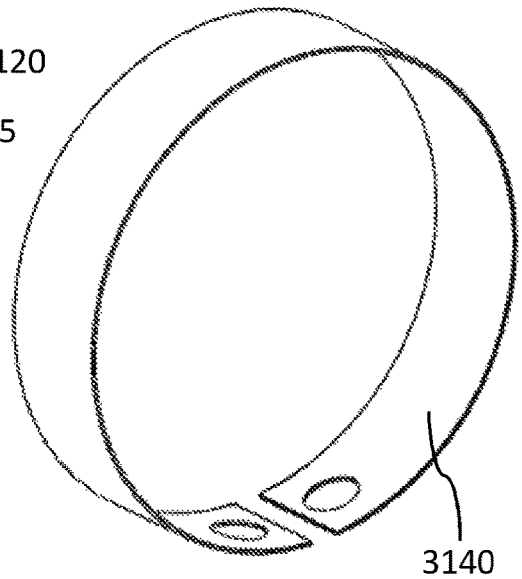
Figure 31C:
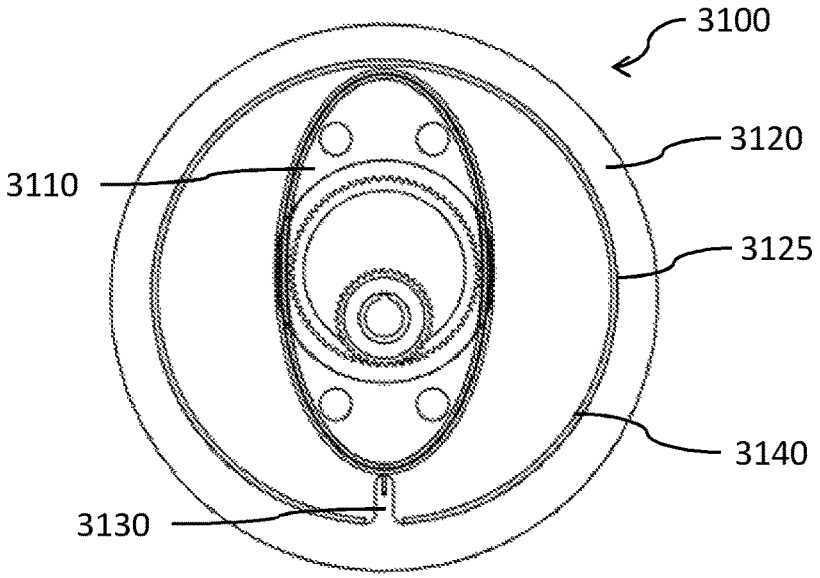

FIGS. 31A-31C are schematics illustrating an embodiment of a rotodynamic pump 3100, a lining 3140 for the inner surface 3125 of the housing, and a rotodynamic pump 3100 comprising a lining for the inner surface of the housing.

Pump 3100 comprises an elliptical rotor 3110 in a housing 3120 having an inverse apex 3130 in contact with elliptical rotor 3110 throughout its rotation. Elliptical rotor 3110 undergoes eccentric rotation as described above.

FIG. 31A shows pump 3100 without a lining for the inner surface 3125 of housing 3120. FIG. 31B shows lining 3140 for the inner surface of housing 3120. FIG. 31C shows a front view of pump 3100 with lining 3140 installed against inner surface 3125 of housing 3120.

In some embodiments, more than one lining 3140 can be installed in housing 3120. Lining 3140 can be a replaceable lining. Lining 3140 can be made from a different material than elliptical rotor 3110 and housing 3120. For example, the material of lining 3140 can be chosen to be more durable and/or softer.

By adding or removing one or more linings 3140, the gap between elliptical rotor 3110 and housing 3120 can be adjusted. In some embodiments, the gap can be approximately 5 mm. Some embodiments of lining 3140 can be of uniform thickness. Other embodiments of lining 3140 can have thickness that varies around the lining thereby providing an adjustment of the gap at different locations around the lining which can be beneficial for certain applications.

One or more linings can optionally be incorporated into the various embodiments of rotary machines described herein.

Figure 32:
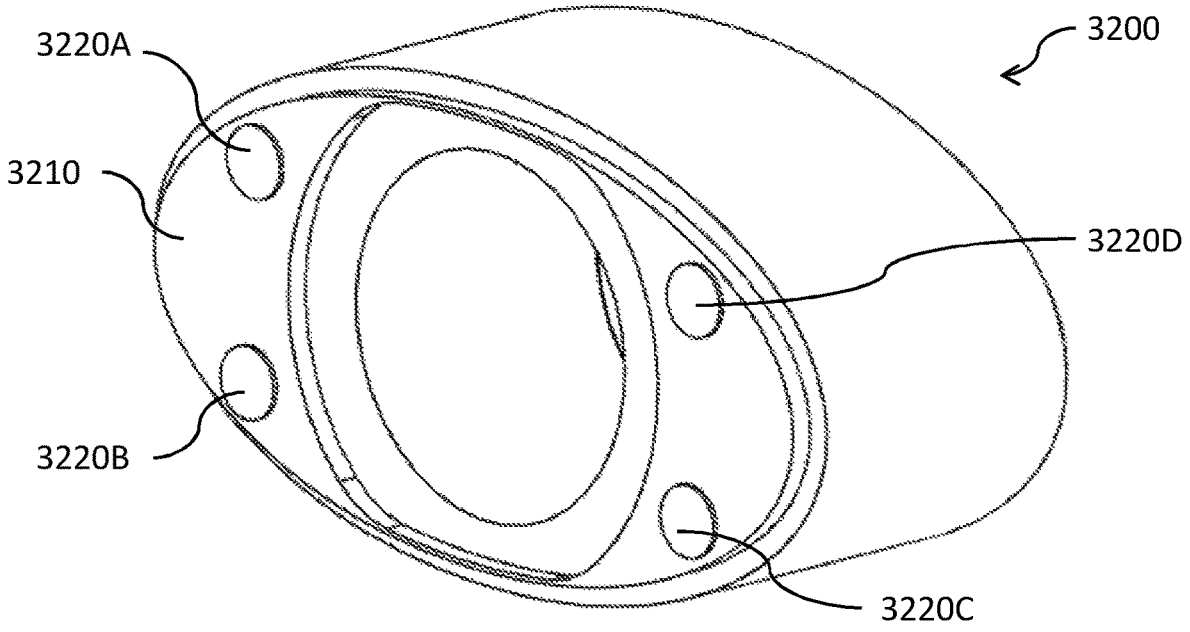
FIG. 32 is an isometric view of an elliptical rotor that can be used in the rotary pump of FIG. 9A, the rotor comprising friction features.

FIG. 32 is an isometric view of an elliptical rotor 3200 that can be used in embodiments of the rotary machines described herein. Elliptical rotor 3200 comprises rotor body face 3210 and friction features 3220A-3220D that can be made of abradable, self-lubricating material. Friction features 3220A-3220D can help to keep elliptical rotor 3200 aligned in the housing between the front and rear plates (not shown in FIG. 32).

Friction features can optionally be incorporated into the various embodiments of rotary machines described herein.

Figure 33:
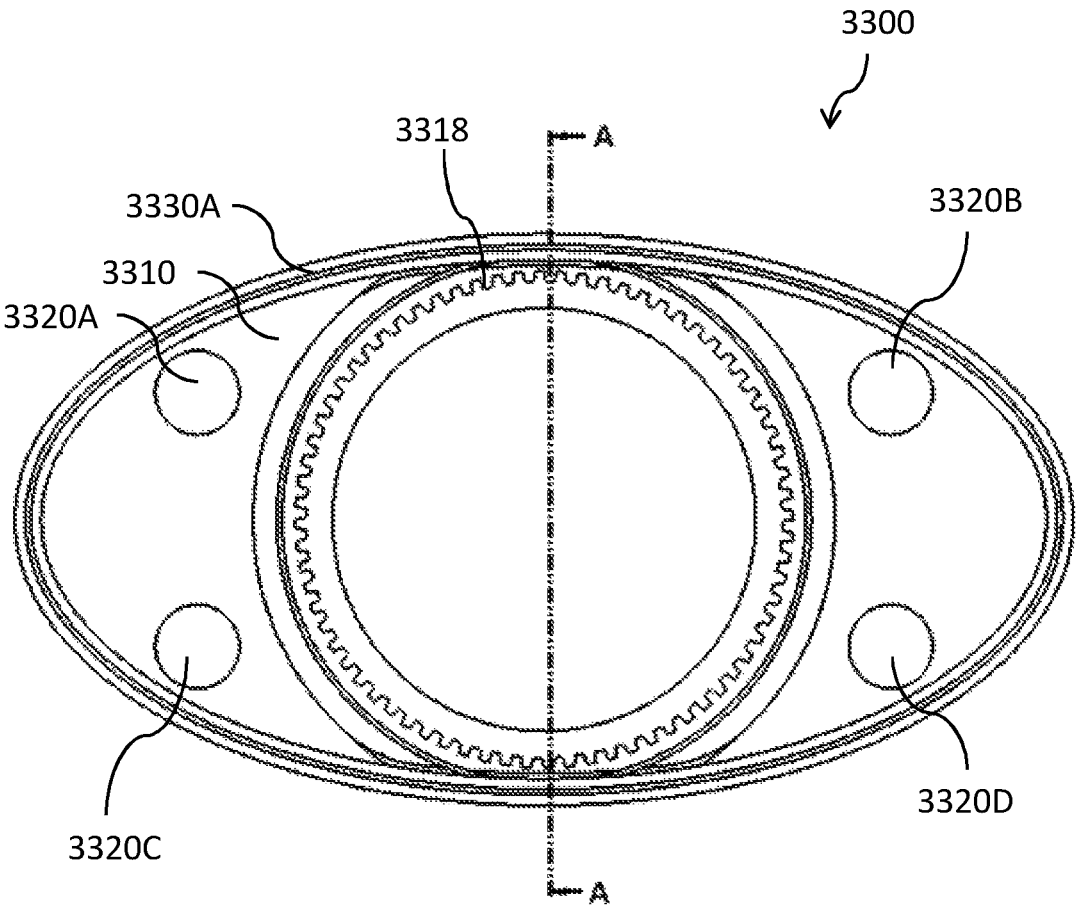
FIG. 33 is a front view of an elliptical rotor, like that shown in FIG. 32, and further comprising a compressible seal around each edge of the rotor.

FIG. 33 is a front view of an elliptical rotor 3300 like that shown in FIG. 32 further comprising a compressible seal around each edge of the rotor. Elliptical rotor 3300 comprises rotor front face 3310, friction features 3320A-3320D, a ring gear 3318, and a seal 3330A. Seal 3330A inhibits fluid from escaping from a volume contained by elliptical rotor 3300, the housing and the front and rear plates (not shown in FIG. 33). Seal 3330A is an elliptical ring seal that runs around the edge of elliptical rotor 3300. Seal 3330A is sprung such that it is in contact with the front plate (not shown) as elliptical rotor 3300 undergoes eccentric rotation in the housing (not shown). A second seal (not shown in FIG. 33) can run around the rear edge of elliptical rotor 3300.

Figure 34A:
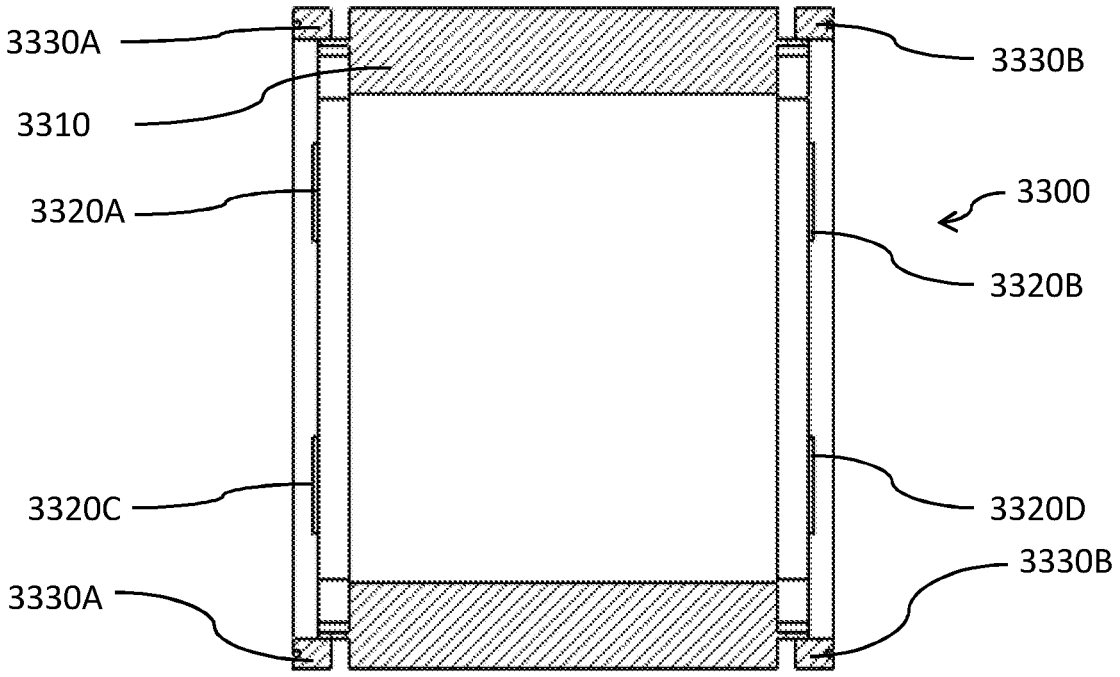
FIGS. 34A and 34B are cross-sectional views, taken in the direction of arrows A-A in FIG. 33, of the elliptical rotor of FIG. 33.
Figure 34B:
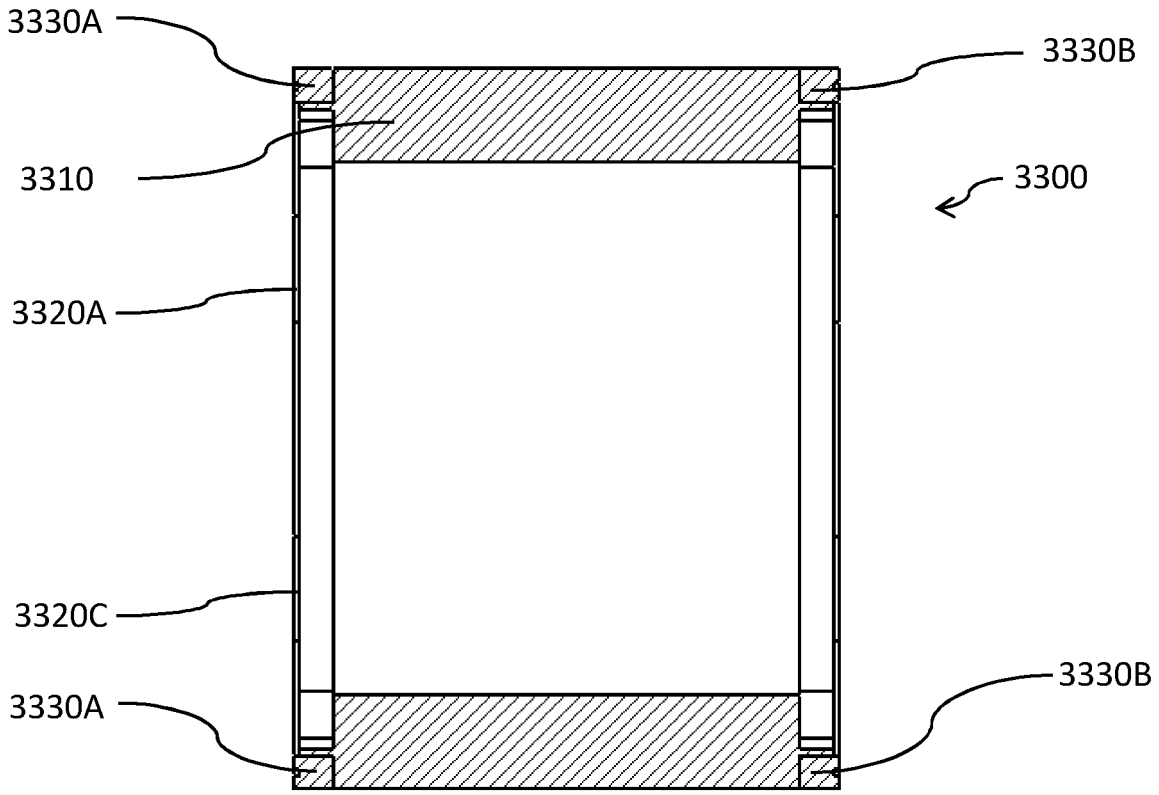

FIGS. 34A and 34B show cross-sectional views of the elliptical rotor 3300 of FIG. 33 through line AA. FIG. 34A shows front and rear seals 3330A and 3330B uncompressed, that is sprung out and away from rotor 3300 towards the front and rear plates respectively. FIG. 34B shows seals 3330A and 3330B compressed, that is pressed against front and rear plates 3380A and 3380B respectively.

Figure 35A:
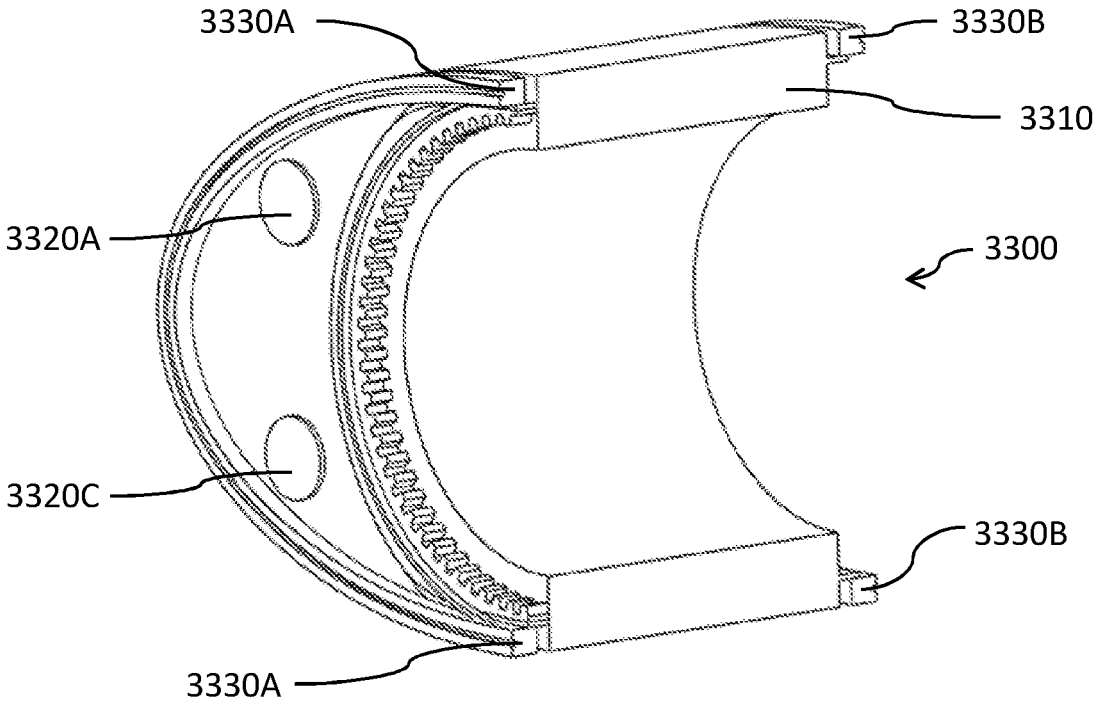
FIGS. 35A and 35B are cut-away views of the elliptical rotor of FIG. 33.
Figure 35B:
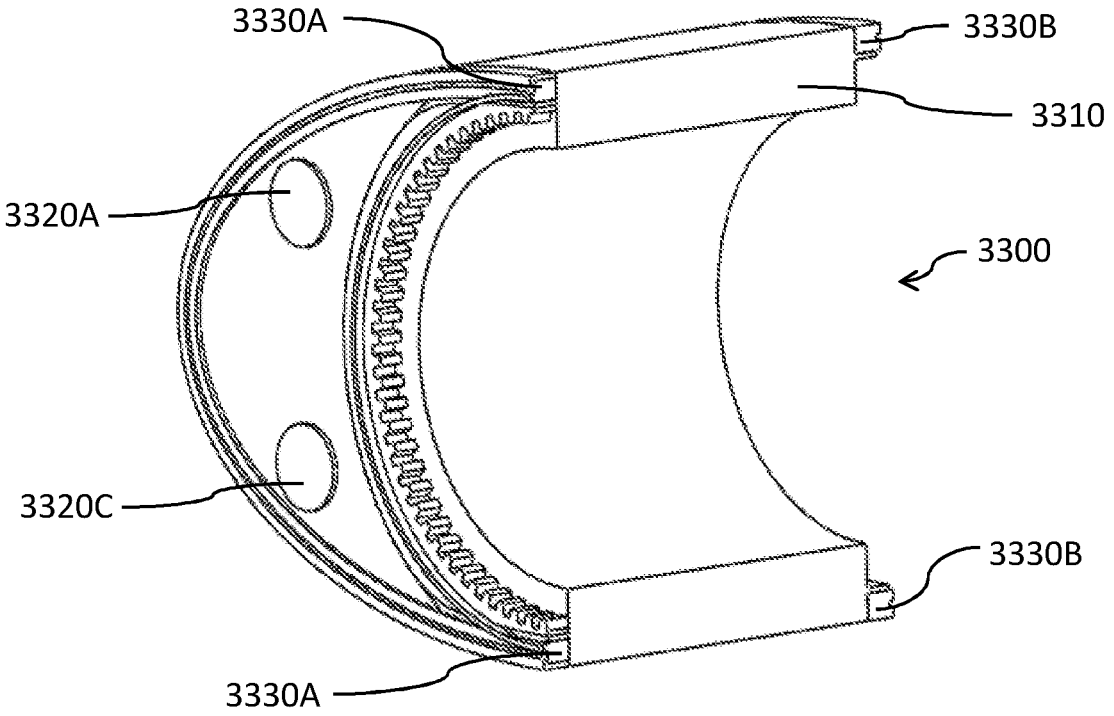

FIGS. 35A and 35B show cut-away views of the elliptical rotor 3300 of FIG. 33. FIG. 35A corresponds to FIG. 34A and shows seals 3330A and 3330B uncompressed. FIG. 35B corresponds to FIG. 34B and shows seals 3330A and 3330B compressed, as they would be against front and rear plates (not shown).

Figure 36A:
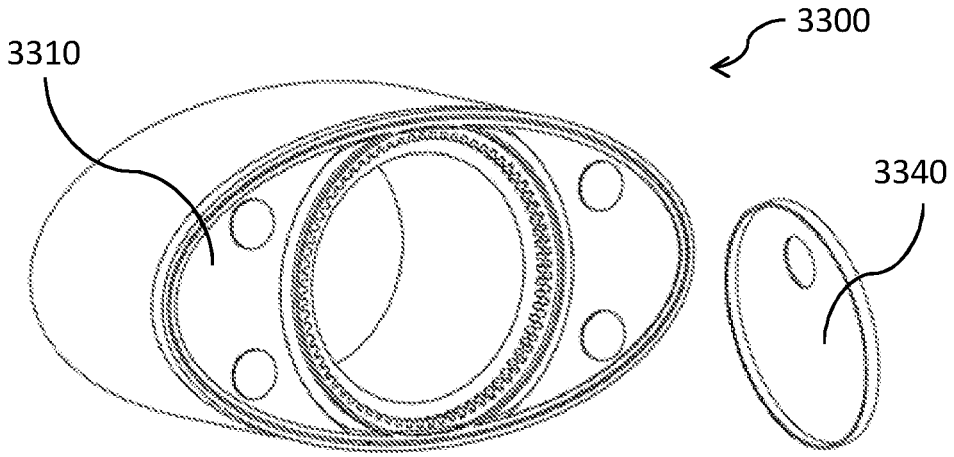
FIGS. 36A and 36B are isometric views of the elliptical rotor of FIG. 33 comprising a secondary seal.
Figure 36B:
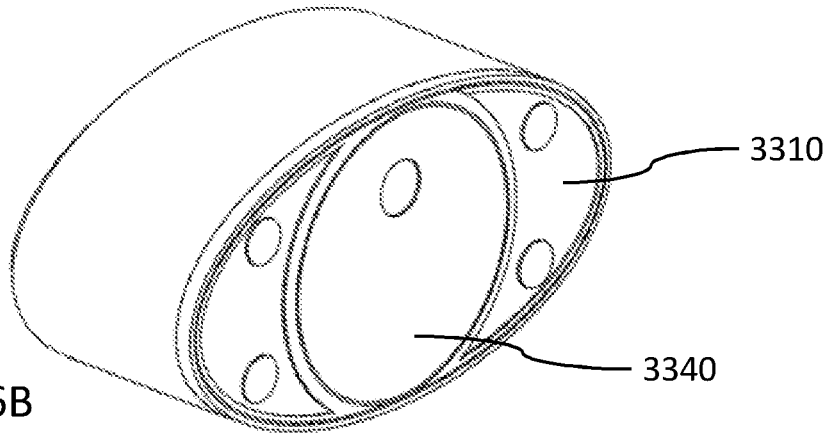

FIGS. 36A and 36B are isometric views of the elliptical rotor of FIG. 33 comprising a secondary seal. FIG. 36A shows elliptical rotor 3300 and secondary seal 3340 separately. FIG. 36B shows elliptical rotor 3300 with secondary seal 3340 installed.

Figure 37A:
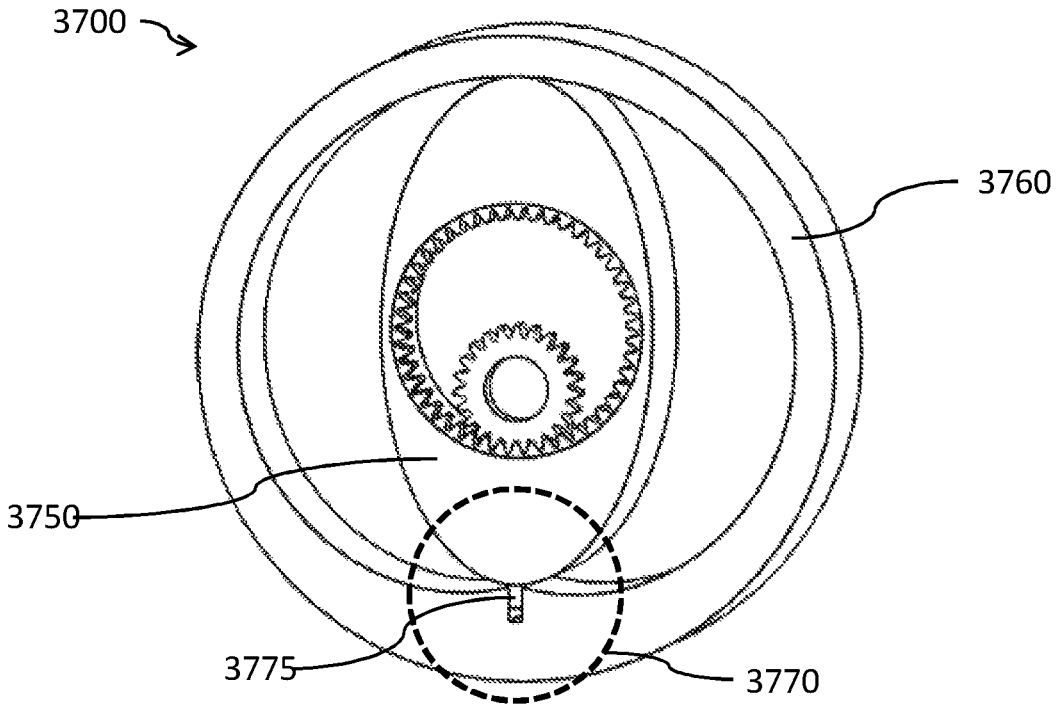
FIG. 37A is a schematic illustrating a rotary machine having a dynamic apex seal.

FIG. 37A is a schematic illustrating a rotary machine 3700 having a dynamic apex seal. Rotary machine 3700 comprises rotor assembly 3750 and housing 3760. Housing 3760 comprises inverse apex region 3770 and dynamic apex seal 3775.

Figure 37B:
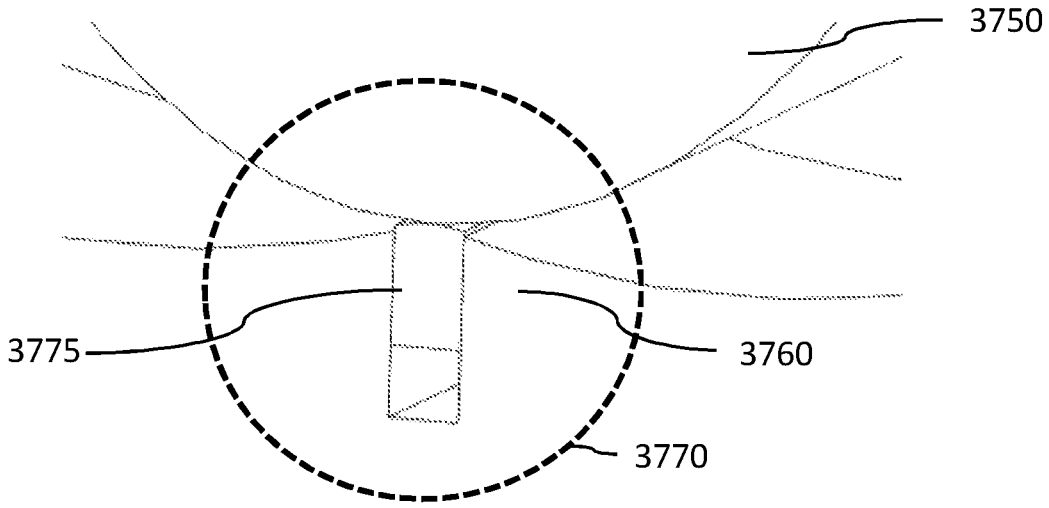
FIG. 37B is a schematic showing a close-up of the rotary machine in the vicinity of the inverse apex region.

FIG. 37B is a schematic showing a close-up of rotary machine 3700 in the vicinity of inverse apex region 3770. Inverse apex region 3770 is wide enough to allow for an increased surface area of dynamic apex seal 3775 when rotor 3750 is in a position that would yield the largest pressures. Dynamic apex seal 3775 can be configured to produce a force nearly equal to the net force of the internal pressure of rotary machine 3700 on the applicable surface area. When the product of the internal pressure and the surface area equals the force produced by dynamic apex seal 3775, apex seal 3775 will move away from rotor 3750. When this occurs, pressure can pass from one side of rotor 3750 (the side at higher pressure) to the other side of rotor 3750 (the side at lower pressure).

In this manner, the system can be configured to provide pressure relief by means of dynamic apex seal 3775. While apex seal 3775 is in contact with rotor 3750, apex seal 3775 functions as a seal between rotor 3750 and inverse apex region 3770.

Dynamic apex seals can optionally be incorporated into the various embodiments of rotary machines described herein.

Figure 38:
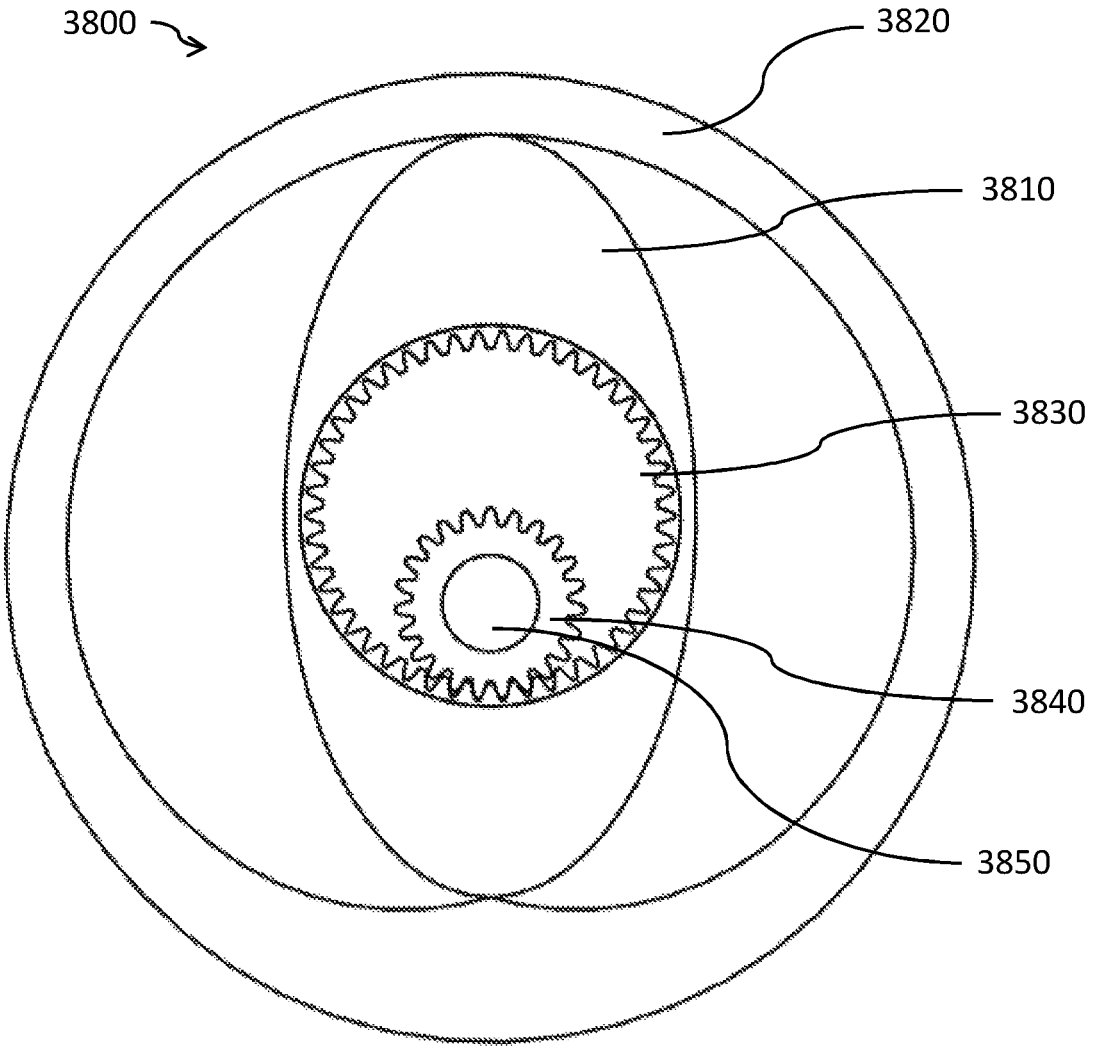
FIG. 38 is a schematic illustrating a cross-section of a rotary machine.

FIG. 38 is a schematic illustrating a cross-section of rotary machine 3800. Rotary machine 3800 comprises rotor 3810, housing 3820, ring gear 3830, sun gear 3840 and crankshaft 3850. In operation, crankshaft 3850 is rotated and causes rotation of sun gear 3840 and corresponding rotation of ring gear 3830. Rotor 3810 undergoes corresponding eccentric rotation within housing 3820.

In a preferred embodiment, the crank radius can be related to the long and short dimensions of the rotor as follows: (AA−BB)=4C, where AA is the long dimension of the rotor (for example, major axis of an elliptical rotor), BB is the short dimension of the rotor (for example, minor axis of an elliptical rotor) and C is the crank radius. The corresponding ring gear has a pitch circle equal to 4C, and the corresponding sun gear has a pitch circle equal to 2C.

Sun gear 3840 comprises an opening for a drive shaft. The size of the drive shaft is constrained by the size of sun gear 3840. Furthermore, there are additional constraints on the size of the opening for the drive shaft that include the mechanical requirements for fastening sun gear 3840 to a mating surface in the rotor assembly. In one example, sun gear 3840 can be fastened to the mating surface in the rotor assembly by means of alignment pins and fasteners.

One approach to increasing the size of the opening for the drive shaft is to configure sun gear 3840 to comprise a geometric mechanical protrusion that can press into a corresponding socket in the mating surface of the rotor assembly.

Figure 39A:
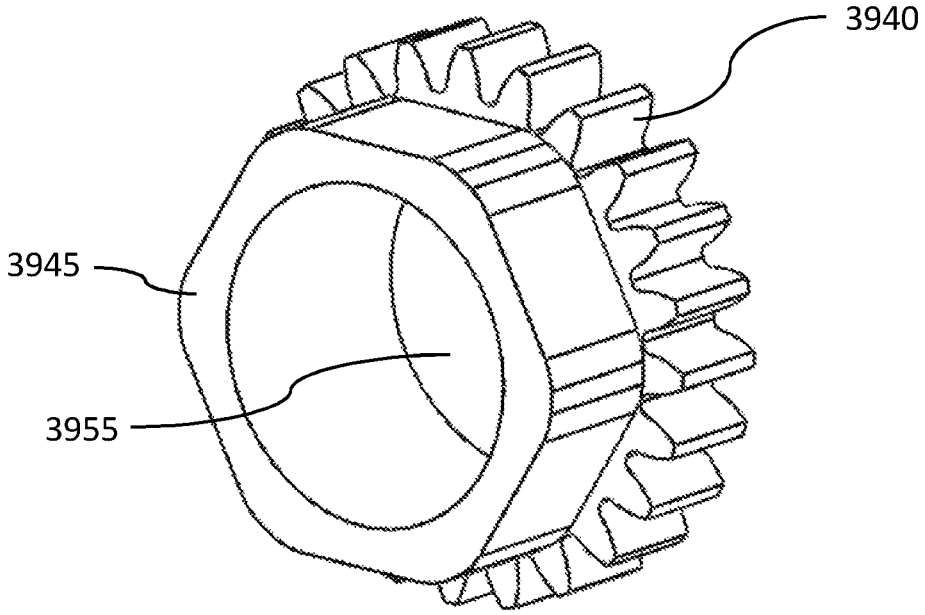
FIG. 39A is a schematic illustrating a sun gear configured to comprise a hexagonal nut.

FIG. 39A is a schematic illustrating sun gear 3940 such as sun gear 3840 in rotary machine 3800 of FIG. 38 configured to comprise a hexagonal nut 3945. Hexagonal nut 3945 and corresponding hexagonal socket (not shown) on the mating surface of the rotor assembly can be used to align and fasten sun gear 3940 to the rotor assembly. In this configuration, opening 3955 for the drive shaft (not shown) can be larger than if alignment pins and fasteners are used to attach sun gear 3940 to the rotor assembly.

A suitably shaped protrusion and corresponding socket can be used including, but not limited to, hexagonal, square, triangle, star and spur.

Figure 39B:
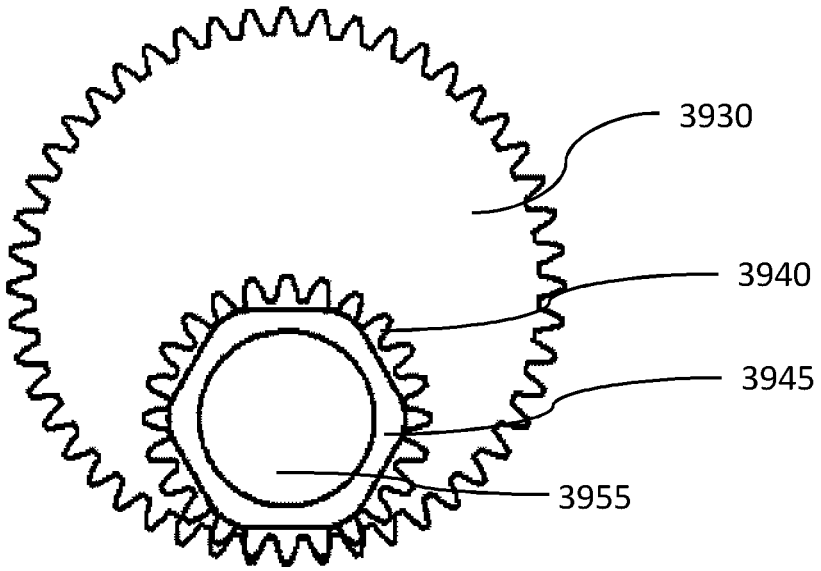
FIG. 39B is a schematic illustrating a sun gear and a ring gear.

FIG. 39B is a schematic illustrating sun gear 3940 and ring gear 3930. Sun gear 3940 comprises hexagonal nut 3945 and opening 3955 for the drive shaft.

Figure 40A:
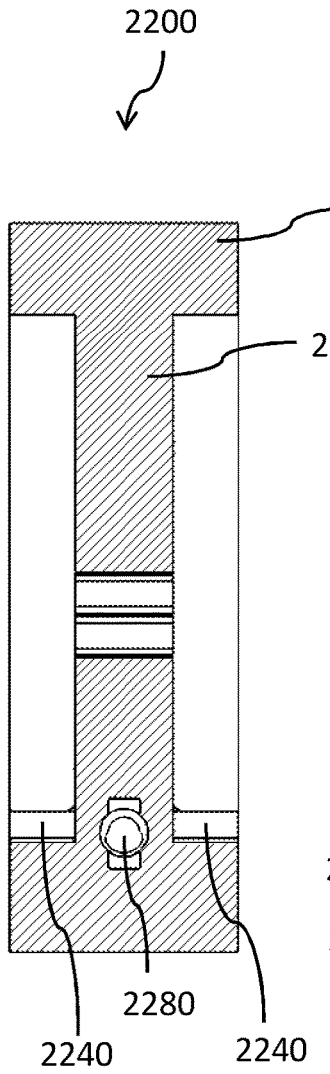
FIGS. 40A and 40B illustrate a first embodiment of an internal pressure relief valve configuration suitable for use in the rotodynamic pump assembly of FIG. 22.
Figure 40B:
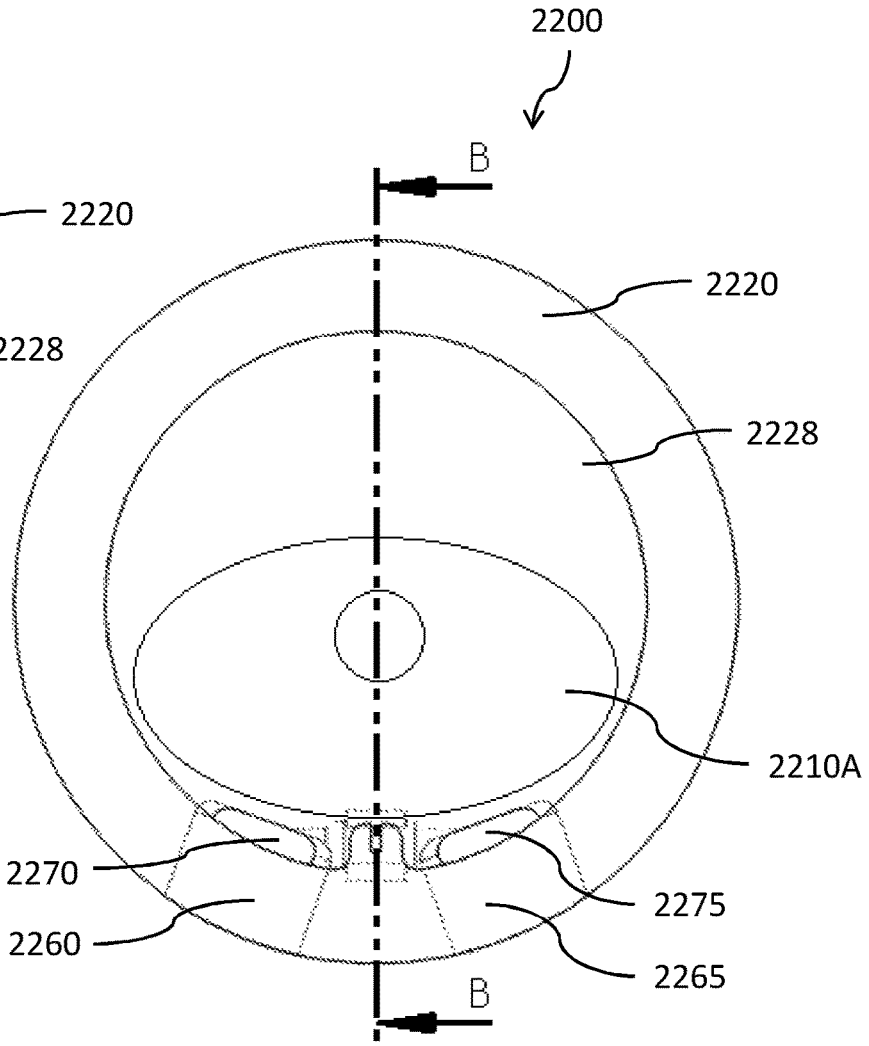

FIGS. 40A and 40B illustrate a first embodiment of an internal pressure relief valve configuration suitable for use in the rotodynamic pump assembly of FIG. 22. Pump assembly 2200 comprises a first elliptical rotor 2210A and a second elliptical rotor (not visible in FIGS. 40A and 40B). The first and second elliptical rotors are separated in housing 2220 by center plate 2228. Housing 2220 has an inlet port 2260 and an outlet port 2265. Center plate 2228 has cut-outs 2270 and 2275 to allow fluid to enter the pump assembly 2200 via inlet 2260, and to exit pump assembly 2200 via outlet 2265, more readily. Cut-outs 2270 and 2275 can serve as manifolds.

FIG. 40A shows a cross-section through line BB of FIG. 40B.

Housing 2220 comprises inverse apex 2240 shown in FIG. 40A on both sides of center plate 2228. Inverse apex 2240 is in contact with the first and second rotors during their eccentric rotation in housing 2220.

Center plate 2228 comprises a pressure relief valve 2280 allowing fluid to cycle back through the pump to relieve pressure in a volume defined by housing 2220 and one or both of the first and second elliptical rotors. Pressure relief valve 2280 can be a one-way sprung check valve.

Figure 41A:
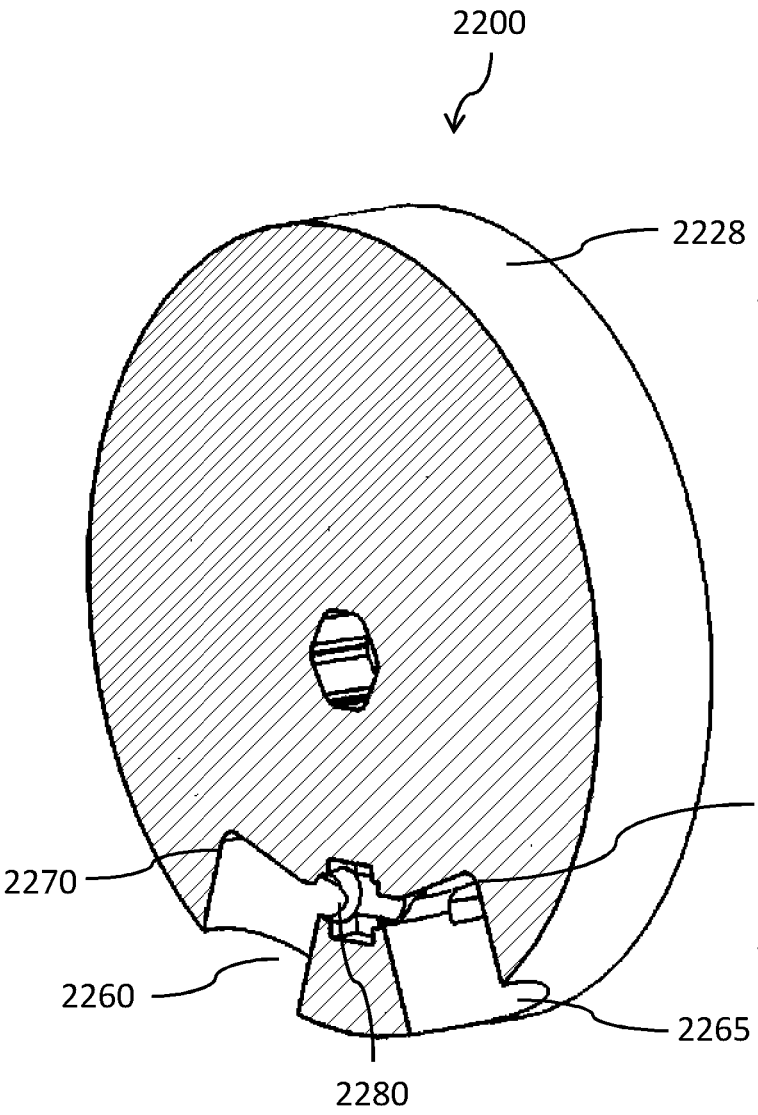
FIGS. 41A and 41B further illustrate the first embodiment of an internal pressure relief valve configuration shown in FIGS. 40A and 40B suitable for use in the rotodynamic pump assembly of FIG. 22.
Figure 41B:
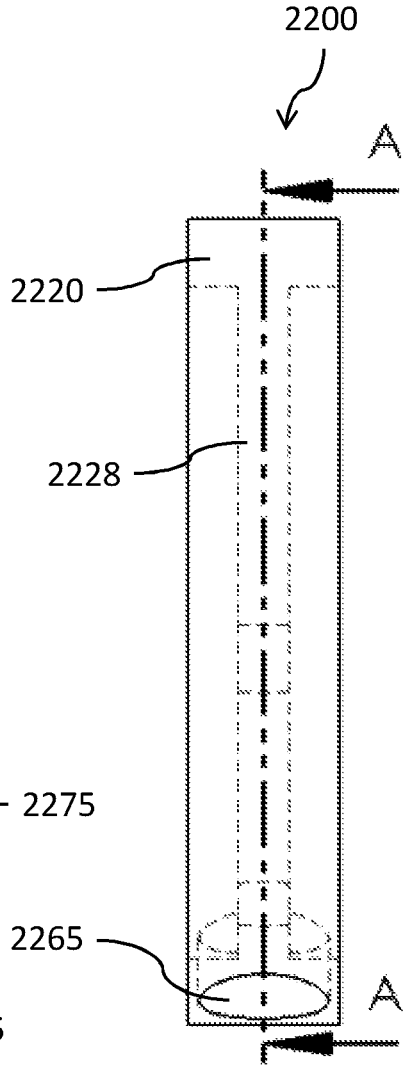

FIGS. 41A and 41B further illustrate the first embodiment of an internal pressure relief valve configuration shown in FIGS. 40A and 40B suitable for use in the rotodynamic pump assembly of FIG. 22.

FIG. 41A is an isometric view, partially in cross-section, through integrated housing 2220 and center plate 2228 of pump assembly 2200, through line AA of FIG. 41B. Integrated housing 2220 and center plate 2228 comprises inlet 2260 and outlet 2265, cut-outs 2270 and 2275, and pressure relief valve 2280.

Figure 42A:
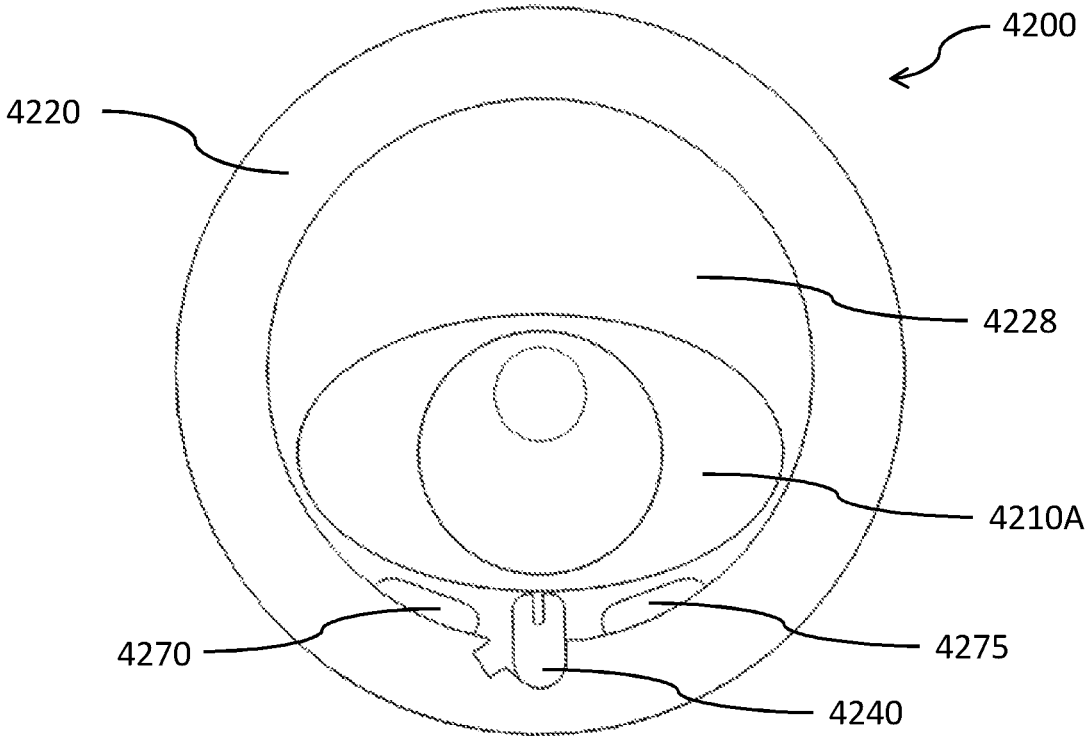
FIGS. 42A and 42B illustrate a second embodiment of an internal pressure relief valve configuration suitable for use in the rotodynamic pump assembly of FIG. 22.
Figure 42B:
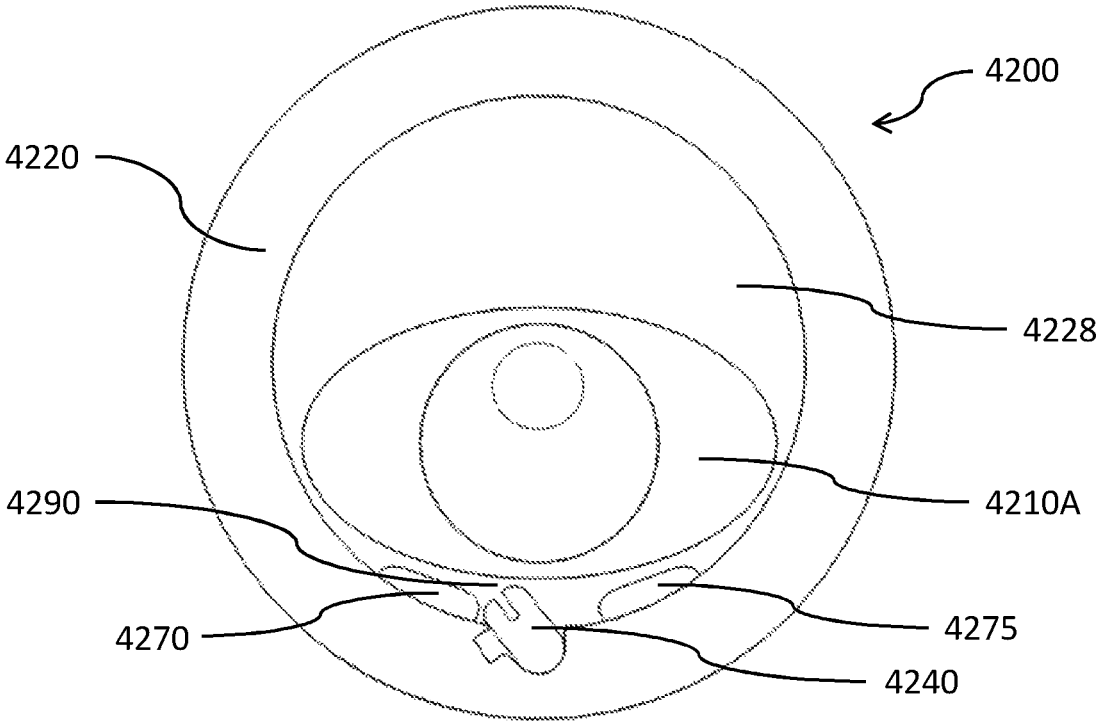

FIGS. 42A and 42B illustrate a second embodiment of an internal pressure relief valve configuration suitable for use in the rotodynamic pump assembly of FIG. 22. Pump assembly 4200 of FIGS. 42A and 42B comprises a housing 4220 with a first elliptical rotor 4210A separated from a second elliptical rotor (not visible in FIGS. 42A and 42B) by a center plate 4228. Center plate 4228 has cut-outs 4270 and 4275, and inlet and outlet ports (not shown in FIGS. 42A and 42B). Housing 4220 has inverse apex 4240 which in normal operation of pump assembly 4200 is in a substantially vertical position as shown in FIG. 42A, and is in contact with the first and second elliptical rotors as they undergo eccentric rotation in housing 4220. Inverse apex 4240 can be configured to act as an internal pressure relief valve for pump assembly 4200. Inverse apex 4240 can be hinged and sprung such that when there is sufficient pressure within the volume of fluid being expelled from pump assembly 4200 through the outlet port (not shown in FIGS. 42A and 42B), inverse apex 4240 rotates away (as shown in FIG. 42B) from the substantially vertical position shown in FIG. 42A. This creates a gap 4290 between inverse apex 4240 and first rotor 4210A and the second rotor (not shown in FIGS. 42A and 42B). Fluid can escape through gap 4290 back through pump assembly 4200, thereby relieving the pressure.

In other embodiments, a pressure relief valve (such as one of those described above) can be used to provide pressure relief in a single rotor positive displacement pump assembly or rotodynamic pump assembly, such as those described above with reference to FIGS. 9A and 9B, and FIGS. 11A-11D or in other rotary machines as described herein.

Figure 43:
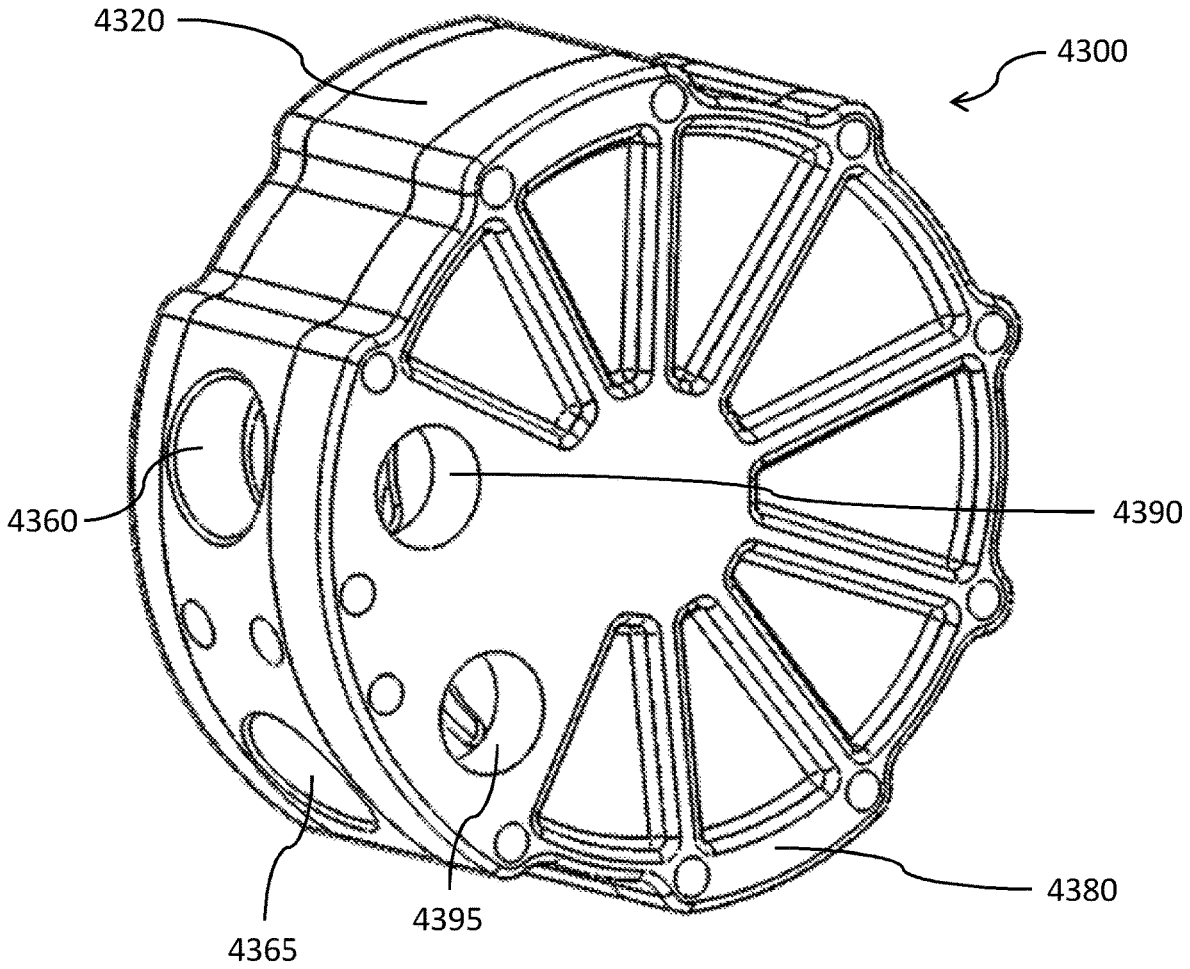
FIG. 43 is an isometric view of an embodiment of a rotodynamic pump assembly configured for external pressure relief.

FIG. 43 is an isometric view of an embodiment of a rotodynamic pump assembly 4300 configured for external pressure relief. Rotodynamic pump assembly 4300 comprises housing 4320 and at least one elliptical rotor (not visible in FIG. 43). Rotodynamic pump assembly 4300 further comprises an inlet 4360 and an outlet 4365, and a back plate 4380 with a pressure relief port 4390 fluidly connected internally to inlet 4360, and a pressure relief port 4395 fluidly connected internally to outlet 4365. Pressure relief ports 4390 and 4395 are configured such that they can be fluidly connected by a length of pipe containing a pressure relief valve (pipe and valve not shown in FIG. 43). In the event the pressure in a first chamber within housing 4320 fluidly connected to outlet 4365 exceeds a threshold, the pressure relief valve will allow the excess pressure to be relieved into a second chamber within housing 4320 fluidly connected to inlet 4360.

FIGS. 44A, 44B, 44C and 44D are schematics illustrating an example embodiment of a rotary machine 4400 comprising elements of the technology described above.

Figure 44A:
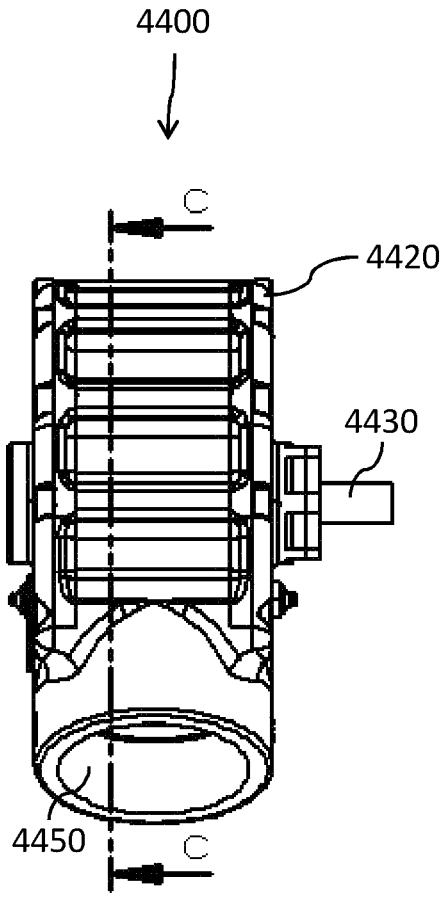
FIGS. 44A-44D are schematics illustrating an example embodiment of a rotary machine.
Figure 44B:
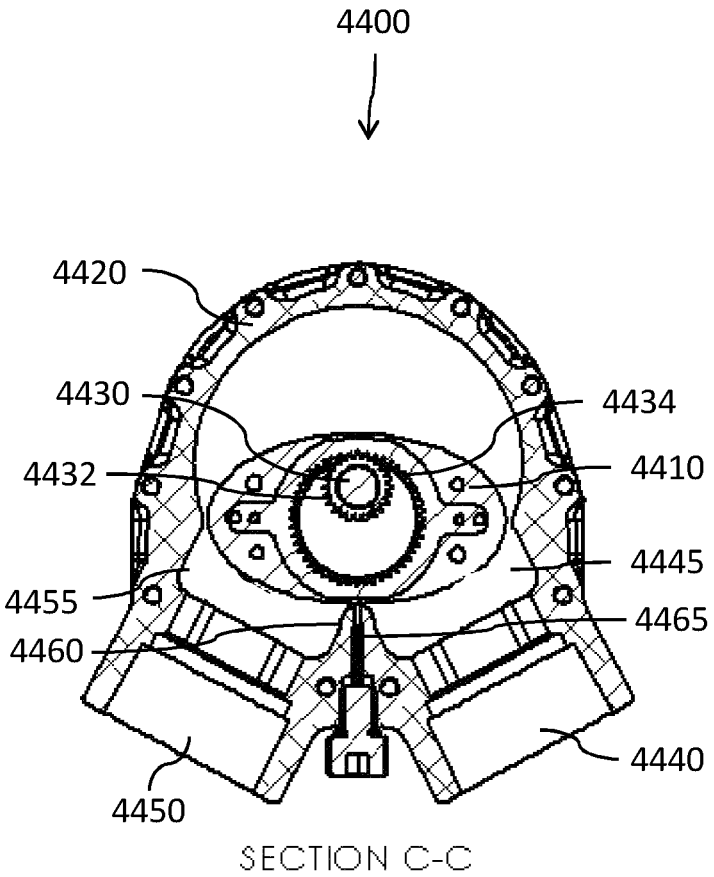
Figure 44C:
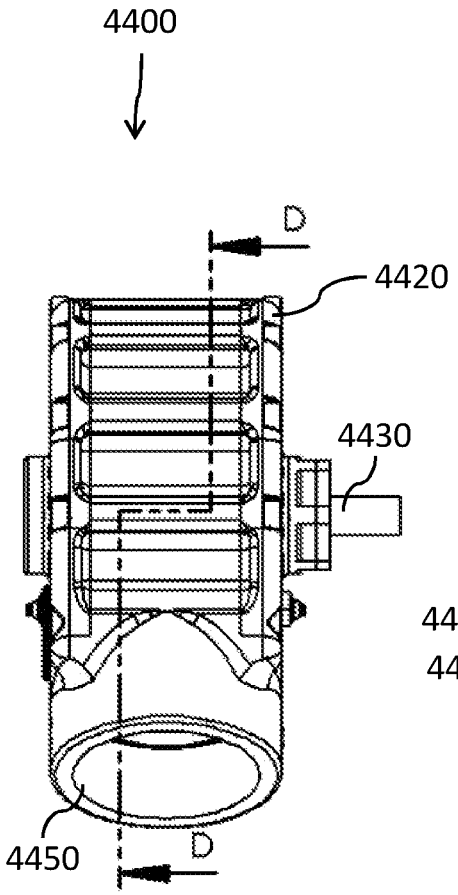

FIGS. 44A and 44C are the same side view of rotary machine 4400. Rotary machine 4400 comprises housing 4420, crankshaft 4430 and outlet port 4450.

FIG. 44B is a cross-sectional view of rotary machine 4400 along the dashed line C-C shown in FIG. 44A. Rotary machine 4400 comprises a first rotor 4410, housing 4420, crankshaft 4430, a first sun gear 4432, a first ring gear 4434, outlet port 4450 and outlet cut-out 4455, inlet port 4440 and inlet cut-out 4445, inverse apex 4460 and dynamic apex seal 4465.

Inlet cut-out 4445 and outlet cut-out 4455 can serve as manifolds for the inlet 4440 and outlet 4450 respectively.

Figure 44D:
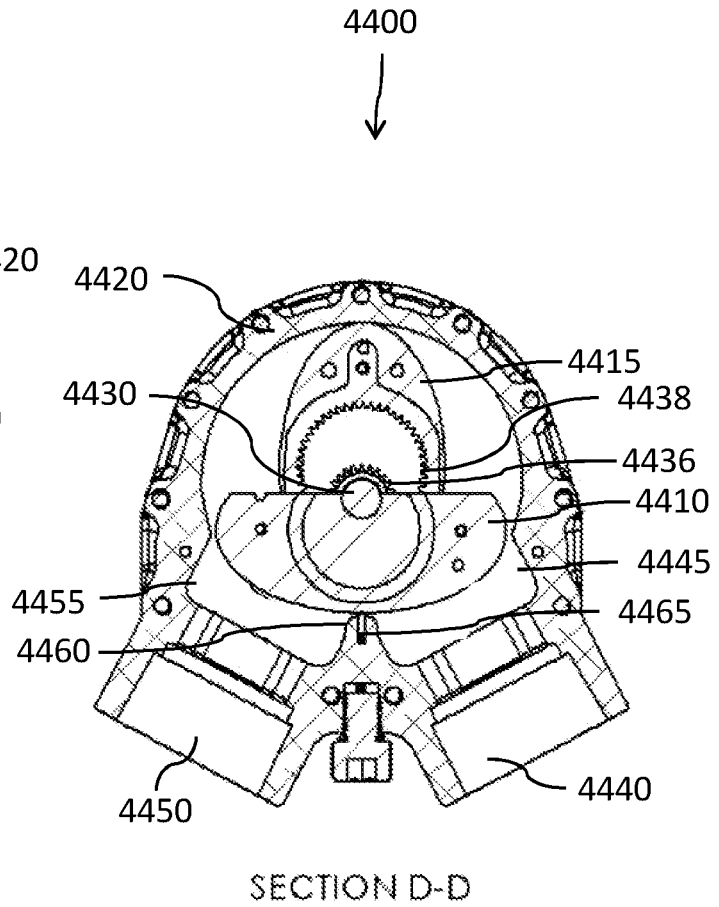

FIG. 44D is a cross-sectional view of rotary machine 4400 along the dashed line D-D shown in FIG. 44C. Rotary machine 4400 further comprises a second rotor 4415, a second sun gear 4436 and a second ring gear 4438.

In operation of rotary machine 4400, crankshaft 4430 rotates and is mechanically coupled via first sun gear 4432 and first ring gear 4434 to cause eccentric rotation of first rotor 4410 within housing 4420. Crankshaft 4430 is also mechanically coupled via second sun gear 4436 and second ring gear 4438 to cause eccentric rotation of second rotor 4415 within housing 4420. Fluid is drawn into rotary machine 4400 via inlet port 4440 and expelled from outlet port 4450. First rotor 4410 and second rotor 4415 are in contact with dynamic apex seal 4465 at inverse apex 4460 throughout rotation of rotors 4410 and 4415.

Particular elements, embodiments and applications of the present invention have been shown and described in relation to pumps and/or rotary machines. Embodiments of the present invention can be utilized in machines and applications including, but not limited to, rotary compressors, positive displacement pumps, dynamic pumps and expansion engines.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A rotary machine comprising:

(a) a rotor comprising an outer surface having an elliptical cross-section;

(b) a crankshaft for providing rotational force to rotate said rotor about a first axis of rotation at a first angular velocity;

(c) a mechanical coupling between said crankshaft and said rotor, said mechanical coupling configured such that:

(i) rotation of said crankshaft about said first axis of rotation induces rotation of said rotor about an instantaneous second axis of rotation at a second angular velocity proportional to said first angular velocity, said second axis of rotation positioned at a fixed distance from said first axis of rotation; and (ii) said second axis of rotation orbits about said first axis of rotation at said first angular velocity;

(d) a housing having an inlet and an outlet formed therein, said housing having an interior cavity within which said rotor is configured to rotate, said housing interior cavity comprising an inner surface having a cross-sectional profile defined by a locus of a set of points on said rotor outer surface for which an instantaneous velocity vector is perpendicular to a line drawn from a member of said set of points to said second axis of rotation as said rotor completes one revolution of rotation, said inner surface of said housing interior cavity having an interiorly-extending inverse apex region between said inlet and said outlet, wherein during its rotation said rotor is in contact with at least a portion of said inverse apex region and at least one location on said inner surface of said housing interior cavity, thereby dividing said housing interior cavity into at least two chambers, said at least two chambers comprising an inlet chamber fluidly connected to said inlet and an outlet chamber fluidly connected to said outlet, whereby upon connecting said inlet to a fluid source, rotation of said rotor draws said fluid into said inlet chamber and discharges said fluid from said outlet chamber;

wherein said inverse apex region comprises a pressure relief mechanism configured to relieve pressure in said inlet chamber or said outlet chamber, when a pressure differential between said inlet chamber and said outlet chamber exceeds a threshold value during operation of said rotary machine, wherein said pressure relief mechanism is a dynamic apex seal, wherein said dynamic apex seal is configured to be in sealing contact with said rotor when said pressure differential between said inlet chamber and said outlet chamber is at or below said threshold value, and is configured to move out of sealing contact with said rotor when said pressure differential between said inlet chamber and said outlet chamber exceeds said threshold value, during operation of said rotary machine, and wherein said dynamic apex seal is configured to move by pivoting to create a gap between said dynamic apex seal and said rotor when said pressure differential between said inlet chamber and said outlet chamber exceeds said threshold value, thereby reducing said pressure differential between said inlet chamber and said outlet chamber.

2. The rotary machine of claim 1, wherein said crankshaft induces rotation of said rotor about said second axis of rotation at a second angular velocity that is half said first angular velocity.

3. The rotary machine of claim 1, wherein said crankshaft is connected to a drive assembly for rotating said crankshaft at a rotational rate that varies during the period of each rotation of said crankshaft.

4. The rotary machine of claim 1, wherein said rotary machine is a pump.

5. A rotary machine comprising:

(a) a rotor comprising an outer surface having an elliptical cross-section;

(b) a crankshaft for providing rotational force to rotate said rotor about a first axis of rotation at a first angular velocity;

(c) a mechanical coupling between said crankshaft and said rotor, said mechanical coupling configured such that:

(i) rotation of said crankshaft about said first axis of rotation induces rotation of said rotor about an instantaneous second axis of rotation at a second angular velocity proportional to said first angular velocity, said second axis of rotation positioned at a fixed distance from said first axis of rotation; and (ii) said second axis of rotation orbits about said first axis of rotation at said first angular velocity;

(d) a housing having an inlet and an outlet formed therein, said housing having an interior cavity within which said rotor is configured to rotate, said housing interior cavity comprising an inner surface having a cross-sectional profile defined by a locus of a set of points on said rotor outer surface for which an instantaneous velocity vector is perpendicular to a line drawn from a member of said set of points to said second axis of rotation as said rotor completes one revolution of rotation, said inner surface of said housing interior cavity having an interiorly-extending inverse apex region between said inlet and said outlet, wherein during its rotation said rotor is in contact with at least a portion of said inverse apex region and at least one location on said inner surface of said housing interior cavity, thereby dividing said housing interior cavity into at least two chambers, said at least two chambers comprising an inlet chamber fluidly connected to said inlet and an outlet chamber fluidly connected to said outlet, whereby upon connecting said inlet to a fluid source, rotation of said rotor draws said fluid into said inlet chamber and discharges said fluid from said outlet chamber;

wherein said inverse apex region comprises a pressure relief mechanism configured to relieve pressure in said inlet chamber or said outlet chamber, when a pressure differential between said inlet chamber and said outlet chamber exceeds a threshold value during operation of said rotary machine, wherein said pressure relief mechanism is a dynamic apex seal, wherein said dynamic apex seal is configured to be in sealing contact with said rotor when said pressure differential between said inlet chamber and said outlet chamber is at or below said threshold value, and is configured to move out of sealing contact with said rotor when said pressure differential between said inlet chamber and said outlet chamber exceeds said threshold value, during operation of said rotary machine, and wherein said dynamic apex seal is hinged and sprung with an adjustable spring, said spring adjustable to set said threshold value for said pressure differential between said inlet chamber and said outlet chamber above which said dynamic apex seal will move out of sealing contact with said rotor.

6. The rotary machine of claim 5, wherein said crankshaft induces rotation of said rotor about said second axis of rotation at a second angular velocity that is half said first angular velocity.

7. The rotary machine of claim 5, wherein said crankshaft is connected to a drive assembly for rotating said crankshaft at a rotational rate that varies during the period of each rotation of said crankshaft.

8. The rotary machine of claim 5, wherein said rotary machine is a pump.

9. A rotary machine comprising:

(a) a rotor comprising an outer surface having an elliptical cross-section;

(b) a crankshaft for providing rotational force to rotate said rotor about a first axis of rotation at a first angular velocity;

(c) a mechanical coupling between said crankshaft and said rotor, said mechanical coupling configured such that:

(i) rotation of said crankshaft about said first axis of rotation induces rotation of said rotor about an instantaneous second axis of rotation at a second angular velocity proportional to said first angular velocity, said second axis of rotation positioned at a fixed distance from said first axis of rotation; and (ii) said second axis of rotation orbits about said first axis of rotation at said first angular velocity;

(d) a housing having an inlet and an outlet formed therein, said housing having an interior cavity within which said rotor is configured to rotate, said housing interior cavity comprising an inner surface having a cross-sectional profile defined by a locus of a set of points on said rotor outer surface for which an instantaneous velocity vector is perpendicular to a line drawn from a member of said set of points to said second axis of rotation as said rotor completes one revolution of rotation, said inner surface of said housing interior cavity having an interiorly-extending inverse apex region between said inlet and said outlet, wherein during its rotation said rotor is in contact with at least a portion of said inverse apex region and at least one location on said inner surface of said housing interior cavity, thereby dividing said housing interior cavity into at least two chambers, said at least two chambers comprising an inlet chamber fluidly connected to said inlet and an outlet chamber fluidly connected to said outlet, whereby upon connecting said inlet to a fluid source, rotation of said rotor draws said fluid into said inlet chamber and discharges said fluid from said outlet chamber;

wherein said inverse apex region comprises a pressure relief mechanism configured to relieve pressure in said inlet chamber or said outlet chamber, when a pressure differential between said inlet chamber and said outlet chamber exceeds a threshold value during operation of said rotary machine, and wherein said pressure relief mechanism comprises a one-way sprung check valve.

10. The rotary machine of claim 9, wherein said crankshaft induces rotation of said rotor about said second axis of rotation at a second angular velocity that is half said first angular velocity.

11. The rotary machine of claim 9, wherein said crankshaft is connected to a drive assembly for rotating said crankshaft at a rotational rate that varies during the period of each rotation of said crankshaft.

12. The rotary machine of claim 9, wherein said rotary machine is a pump.

13. A rotary pump comprising:

(a) a rotor comprising an outer surface having an elliptical cross-section;

(b) a crankshaft for providing rotational force to rotate said rotor about a first axis of rotation at a first angular velocity;

(c) a mechanical coupling between said crankshaft and said rotor, said mechanical coupling configured such that:

(i) rotation of said crankshaft about said first axis of rotation induces rotation of said rotor about an instantaneous second axis of rotation at a second angular velocity proportional to said first angular velocity, said second axis of rotation positioned at a fixed distance from said first axis of rotation; and (ii) said second axis of rotation orbits about said first axis of rotation at said first angular velocity;

(d) a housing having an inlet and an outlet formed therein, said housing comprising an inner surface and an interior cavity within which said rotor is configured to rotate, said housing interior cavity substantially circular in cross-section and comprising an interiorly-extending inverse apex region between said inlet and said outlet, wherein during its rotation said rotor is in contact with at least a portion of said inverse apex region and at least one location on said inner surface of said housing interior cavity, thereby dividing said housing interior cavity into at least two chambers, said at least two chambers comprising an inlet chamber fluidly connected to said inlet and an outlet chamber fluidly connected to said outlet whereby, upon connecting said inlet to a fluid source, rotation of said rotor draws said fluid into said inlet chamber and discharges said fluid from said outlet chamber;

wherein said inverse apex region comprises a pressure relief mechanism configured to relieve pressure in said inlet chamber or outlet chamber, when a pressure differential between said inlet chamber and said outlet chamber exceeds a threshold value during operation of said rotary pump, wherein said pressure relief mechanism is a dynamic apex seal, wherein said dynamic apex seal is configured to be in sealing contact with said rotor when said pressure differential between said inlet chamber and said outlet chamber is at or below said threshold value, and is configured to move out of sealing contact with said rotor when said pressure differential between said inlet chamber and said outlet chamber exceeds said threshold value during operation of said rotary pump, and wherein said dynamic apex seal is configured to move by pivoting to create a gap between said dynamic apex seal and said rotor when said pressure differential between said inlet chamber and said outlet chamber exceeds said threshold value, thereby reducing said pressure differential between said inlet chamber and said outlet chamber.

14. The rotary pump of claim 13, wherein said crankshaft induces rotation of said rotor about said second axis of rotation at a second angular velocity that is half said first angular velocity.

15. The rotary pump of claim 13, wherein said crankshaft is connected to a drive assembly for rotating said crankshaft at a rotational rate that varies during the period of each rotation of said crankshaft.

16. A rotary pump comprising:

(a) a rotor comprising an outer surface having an elliptical cross-section;

(b) a crankshaft for providing rotational force to rotate said rotor about a first axis of rotation at a first angular velocity;

(c) a mechanical coupling between said crankshaft and said rotor, said mechanical coupling configured such that:

(i) rotation of said crankshaft about said first axis of rotation induces rotation of said rotor about an instantaneous second axis of rotation at a second angular velocity proportional to said first angular velocity, said second axis of rotation positioned at a fixed distance from said first axis of rotation; and (ii) said second axis of rotation orbits about said first axis of rotation at said first angular velocity;

(d) a housing having an inlet and an outlet formed therein, said housing comprising an inner surface and an interior cavity within which said rotor is configured to rotate, said housing interior cavity substantially circular in cross-section and comprising an interiorly-extending inverse apex region between said inlet and said outlet, wherein during its rotation said rotor is in contact with at least a portion of said inverse apex region and at least one location on said inner surface of said housing interior cavity, thereby dividing said housing interior cavity into at least two chambers, said at least two chambers comprising an inlet chamber fluidly connected to said inlet and an outlet chamber fluidly connected to said outlet whereby, upon connecting said inlet to a fluid source, rotation of said rotor draws said fluid into said inlet chamber and discharges said fluid from said outlet chamber;

wherein said inverse apex region comprises a pressure relief mechanism configured to relieve pressure in said inlet chamber or outlet chamber, when a pressure differential between said inlet chamber and said outlet chamber exceeds a threshold value during operation of said rotary pump, wherein said pressure relief mechanism is a dynamic apex seal, wherein said dynamic apex seal is configured to be in sealing contact with said rotor when said pressure differential between said inlet chamber and said outlet chamber is at or below said threshold value, and is configured to move out of sealing contact with said rotor when said pressure differential between said inlet chamber and said outlet chamber exceeds said threshold value during operation of said rotary pump, and wherein said dynamic apex seal is hinged and sprung with an adjustable spring, said spring adjustable to set said threshold value for said pressure differential between said inlet chamber and said outlet chamber above which said dynamic apex seal will move out of sealing contact with said rotor.

17. The rotary pump of claim 16, wherein said crankshaft induces rotation of said rotor about said second axis of rotation at a second angular velocity that is half said first angular velocity.

18. The rotary pump of claim 16, wherein said crankshaft is connected to a drive assembly for rotating said crankshaft at a rotational rate that varies during the period of each rotation of said crankshaft.

19. A rotary pump comprising:

(a) a rotor comprising an outer surface having an elliptical cross-section;

(b) a crankshaft for providing rotational force to rotate said rotor about a first axis of rotation at a first angular velocity;

(c) a mechanical coupling between said crankshaft and said rotor, said mechanical coupling configured such that:

(i) rotation of said crankshaft about said first axis of rotation induces rotation of said rotor about an instantaneous second axis of rotation at a second angular velocity proportional to said first angular velocity, said second axis of rotation positioned at a fixed distance from said first axis of rotation; and (ii) said second axis of rotation orbits about said first axis of rotation at said first angular velocity;

(d) a housing having an inlet and an outlet formed therein, said housing comprising an inner surface and an interior cavity within which said rotor is configured to rotate, said housing interior cavity substantially circular in cross-section and comprising an interiorly-extending inverse apex region between said inlet and said outlet, wherein during its rotation said rotor is in contact with at least a portion of said inverse apex region and at least one location on said inner surface of said housing interior cavity, thereby dividing said housing interior cavity into at least two chambers, said at least two chambers comprising an inlet chamber fluidly connected to said inlet and an outlet chamber fluidly connected to said outlet whereby, upon connecting said inlet to a fluid source, rotation of said rotor draws said fluid into said inlet chamber and discharges said fluid from said outlet chamber;

wherein said inverse apex region comprises a pressure relief mechanism configured to relieve pressure in said inlet chamber or outlet chamber, when a pressure differential between said inlet chamber and said outlet chamber exceeds a threshold value during operation of said rotary pump, and wherein said pressure relief mechanism comprises a one-way sprung check valve.

20. The rotary pump of claim 19, wherein said crankshaft induces rotation of said rotor about said second axis of rotation at a second angular velocity that is half said first angular velocity.

* * * * *